US008427260B2

(12) United States Patent
Satoh et al.

(10) Patent No.: US 8,427,260 B2
(45) Date of Patent: Apr. 23, 2013

(54) DUAL-BAND BANDPASS RESONATOR AND DUAL-BAND BANDPASS FILTER

(75) Inventors: Kei Satoh, Yokosuka (JP); Shoichi Narahashi, Yokohama (JP)

(73) Assignee: NTT DoCoMo, Inc., Tokyo (JP)

( * ) Notice: Subject to any disclaimer, the term of this patent is extended or adjusted under 35 U.S.C. 154(b) by 1073 days.

(21) Appl. No.: 12/388,076

(22) Filed: Feb. 18, 2009

(65) Prior Publication Data

US 2009/0212886 A1 Aug. 27, 2009

(30) Foreign Application Priority Data

Feb. 22, 2008 (JP) ..... 2008-042018
Jan. 29, 2009 (JP) ..... 2009-018478

(51) Int. Cl.
*H01P 1/203* (2006.01)
*H01P 7/08* (2006.01)

(52) U.S. Cl.
USPC ..... 333/204; 333/205; 333/219; 333/235

(58) Field of Classification Search ..... 333/202, 333/204, 205, 219, 235
See application file for complete search history.

(56) References Cited

U.S. PATENT DOCUMENTS

| | | | | |
|---|---|---|---|---|
| 6,262,640 | B1 | 7/2001 | Tsujiguchi | |
| 7,978,027 | B2 * | 7/2011 | Satoh et al. | 333/204 |
| 2007/0052502 | A1 | 3/2007 | Koizumi et al. | |
| 2008/0278265 | A1 * | 11/2008 | Koizumi et al. | 333/219 |

FOREIGN PATENT DOCUMENTS

| | | | |
|---|---|---|---|
| EP | 0 709 911 | A2 | 5/1996 |
| EP | 1 760 823 | A1 | 3/2007 |
| EP | 1 990 863 | A1 | 11/2008 |

OTHER PUBLICATIONS

Daisuke Koizumi, et al., "A Novel Compact Eight-Pole HTS Bandpass Filter Employing CPW Quarter—Wavelength Symmetric Diverging Resonators", Proceedings of the 36th European Microwave Conference, XP031005675, Sep. 1, 2006, pp. 741-744.
Cheng-Yuan Hung, et al., "A Compact-Size and High Isolation Dual-Band Coplanar-Waveguide Bandpass Filter", Microwave Symposium, XP031112076, Jun. 1, 2007, pp. 925-928.

(Continued)

*Primary Examiner* — Benny Lee
*Assistant Examiner* — Gerald Stevens
(74) *Attorney, Agent, or Firm* — Oblon, Spivak, McClelland, Maier & Neustadt, L.L.P.

(57) ABSTRACT

A dual-band bandpass filter according to the present invention includes a plurality of dual-band bandpass resonators. The dual-band bandpass resonator includes a central conductor having a central axis aligned with an input/output direction, a pair of grounding conductors, a central conductor short-circuit part and a pair of stub conductors that are formed on a surface of a dielectric substrate. The pair of grounding conductors are disposed on the opposite sides of the central conductor with a space interposed therebetween. The central conductor short-circuit part short-circuits the pair of grounding conductors, and one end of the central conductor is connected to the central conductor short-circuit part. The pair of stub conductors are disposed in the spaces on the opposite sides of the central conductor symmetrically with respect to the central axis of the central conductor, extend at least partially parallel with the central conductor and are connected to the central conductor short-circuit part at one ends thereof.

19 Claims, 53 Drawing Sheets

OTHER PUBLICATIONS

Sheng Sun, et al., Novel Design of Microstrip Bandpass Filters with a Controllable Dual-Passband Response: Description and Implementation, IEICE Trans. Electron., vol. E89-C, No. 2, Feb. 2006, pp. 197-202.

Xuehui Guan, et al., "Synthesizing Microstrip Dual-Band Bandpass Filters Using Frequency Transformation and Circuit Conversion Technique", IEICE Trans. Electron., vol. E89-C, No. 4, Apr. 2006, pp. 495-502.

Office Action issued Apr. 5, 2012 in Chinese Patent Application No. 200910007571.7 (with English translation).

* cited by examiner

DUAL-BAND BANDPASS RESONATOR AND DUAL-BAND BANDPASS FILTER

TECHNICAL FIELD

The present invention relates to a resonator and a filter incorporating resonators. In particular, it relates to a dual-band bandpass resonator and a dual-band bandpass filter incorporating resonators used for signal transmission and reception in mobile communication, satellite communication, stationary microwave communication and other communication technologies.

BACKGROUND ART

Conventional dual-band bandpass filters, which have two pass bands, are generally classified into two types according to structure.

One type is a filter 200 shown in FIG. 50 that is composed of a plurality of (three, in this example) dual-band bandpass resonators Q1, Q2 and Q3, which resonate at two frequencies, cascaded to each other and input/output ports P1 and P2 coupled to the opposite ends of the cascade (see the non-patent literature 1, for example). For the filter 200, the dual-band bandpass resonators Q1 and Q3 coupled to the input/output ports P1 and P2 at the opposite ends of the cascade need to have a coupling part having a configuration and dimensions that provide a desired center frequency and bandwidth both in the two bands.

The other type is a filter 300 shown in FIG. 51 that is composed of a plurality of transmission lines T1 to T9 having different impedances and line lengths connected to each other at the ends thereof (see the non-patent literature 2, for example). For the filter 300, the characteristics as the dual-band bandpass filter is achieved by determining the characteristic impedance and length of each transmission line of the filter based on an equivalent circuit theory using lumped parameter elements.

Non-patent literature 1: S. Sun, L. Zhu, "Novel Design of Microstrip Bandpass Filters with a Controllable Dual-Passband Response: Description and Implementation," IEICE Trans. Electron, vol. E89-C, no. 2, pp. 197-202, February 2006

Non-patent literature 2: X. Guan, Z. Ma, P. Cai, Y. Kobayashi, T. Anada, and G. Hagiwara, "Synthesizing Microstrip Dual-Band Bandpass Filters Using Frequency Transformation and Circuit Conversion Technique," IEICE Trans. Electron, vol. E89-C, no. 4, pp. 495-502, April 2006

DISCLOSURE OF THE INVENTION

Problem to be Solved by the Invention

In general, for the dual-band bandpass filter, the center frequency and the bandwidth have to be determined for each of the two pass bands, and therefore, four characteristic values have to be controlled in total. In the case of the dual-band bandpass filter shown in FIG. 50, the four characteristic values have to be controlled by the configuration and dimensions of each coupling part. Consequently, it is difficult to design the dual-band bandpass filter while maintaining high flexibility in designing the four characteristic values.

On the other hand, in the case of the dual-band bandpass filter shown in FIG. 51, the transmission lines including the input-side transmission line Ti and the output-side transmission line T9 are directly connected to each other. Consequently, the dual-band bandpass filter has a problem that signals in the frequency bands other than the desired pass bands cannot be sufficiently filtered and therefore needs to have an additional bandpass filter to completely remove the signals in the unwanted frequency bands. In addition, the structure composed of transmission lines having fixed lengths connected to each other at the ends thereof is disadvantageous for miniaturization of the filter.

An object of the present invention is to solve the problem with the prior art described above or, more specifically, to provide a dual-band bandpass filter that has high flexibility in designing a total of four characteristic values, that is, the center frequency and bandwidth of the two pass bands, is capable of substantially blocking unwanted signals in the bands other than the desired pass bands and can be miniaturized.

Means to Solve Issues

A dual-band bandpass resonator according to the present invention comprises:

a dielectric substrate;

a central conductor having a central axis aligned with an input/output direction formed on a surface of the dielectric substrate;

a pair of grounding conductors that are formed on the surface of the dielectric substrate and disposed on the opposite sides of the central conductor with a space interposed therebetween;

a central conductor short-circuit part that is formed on the surface of the dielectric substrate and short-circuits the pair of grounding conductors to which one end of the central conductor is connected; and a pair of stub conductors that are formed on the surface of the dielectric substrate and disposed in the spaces on the opposite sides of the central conductor symmetrically with respect to the central axis of the central conductor, to extend at least partially parallel with the central conductor and are connected to the central conductor short-circuit part at one ends thereof.

A dual-band bandpass filter according to the present invention comprises a plurality of dual-band bandpass resonators described above that are arranged with the central axes of the central conductors thereof aligned with each other.

Effects of the Invention

There can be provided a dual-band bandpass filter that can adjust the center frequency and bandwidth, which is determined by the external coupling between the input/output signal lines and the resonators, of the two pass bands to any values without degrading the flexibility in setting the values, can effectively block unwanted signals in bands other than the desired pass bands and can be miniaturized.

BEST MODES FOR CARRYING OUT THE INVENTION

[First Embodiment]

Figure 1:
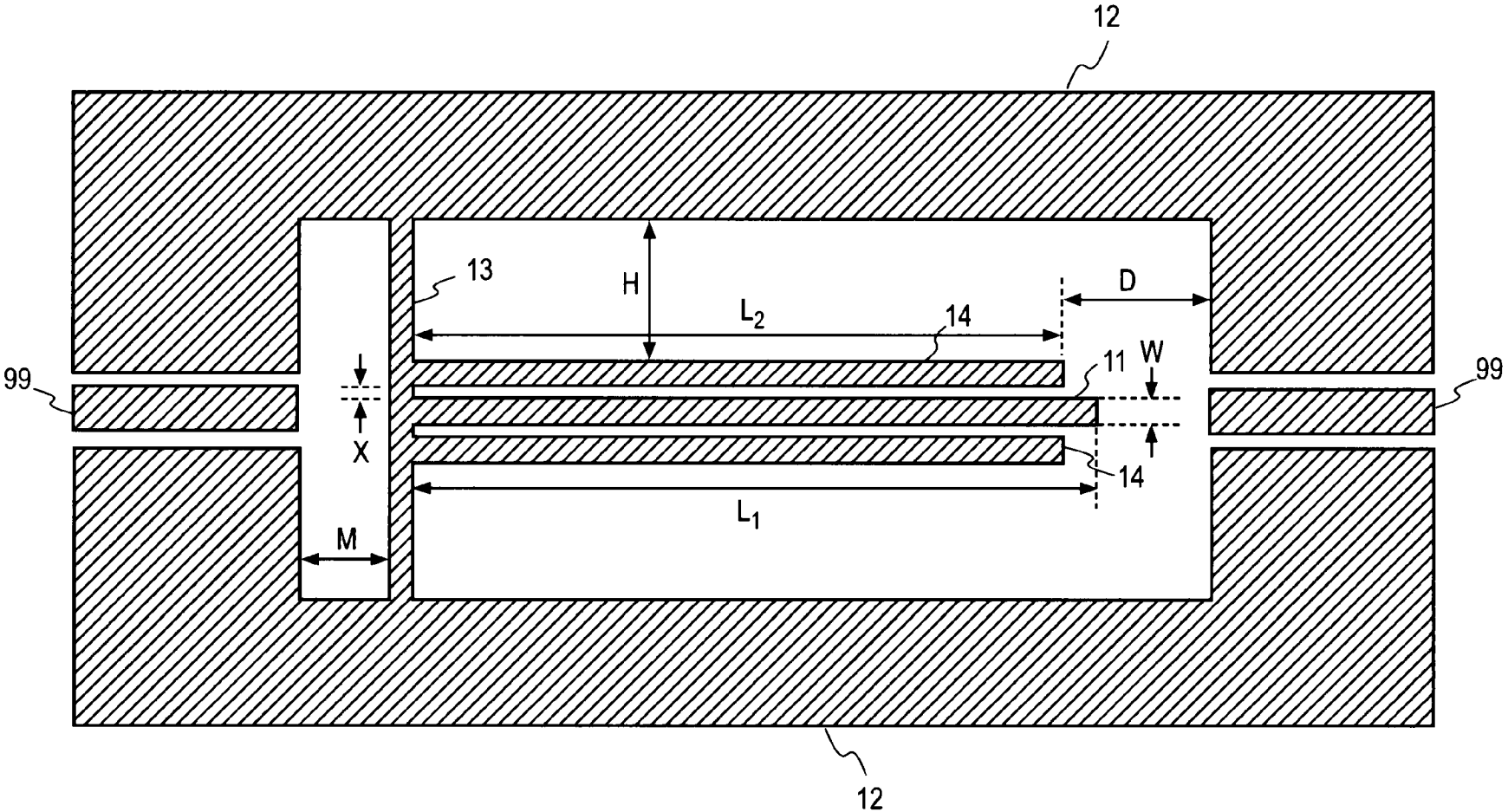
FIG. 1 is a plan view showing an exemplary configuration of a dual-band bandpass resonator according to a first embodiment.

FIG. 1 is a diagram showing an exemplary configuration of a dual-band bandpass resonator according to the present invention, which is composed of a conductive pattern formed on one surface of a rectangular dielectric substrate. In this drawing, the hatched areas indicate areas in which a conductor exists, and the blank areas surrounded by the hatching areas indicate areas in which the dielectric substrate underlying the conductor is exposed. The same holds true for all the drawings showing resonators or filters described below.

The dual-band bandpass resonator comprises a central conductor 11, a pair of grounding conductors 12, a central conductor short-circuit part 13, and a pair of stub conductors 14. The paired grounding conductors are disposed at a distance along one pair of opposite sides of the rectangular dielectric substrate and bent at right angles at the opposite ends thereof to extend along the other pair of opposite sides of the dielectric substrate to come close to each other. Input/output lines 99 of the resonator, the center axes of which are aligned with each other, are formed in spaces between the opposed ends of the extensions of the ends of the paired grounding conductors 12 extending to come close to each other. As required, an exciting part designed for dual-band application may be disposed between the input/output line 99 and the resonator. The central conductor 11, the central conductor short-circuit part 13 and the stub conductors 14 are formed in a region substantially surrounded by the pair of grounding conductors 12.

The central conductor 11 is a linear conductor having a central axis aligned with the central axis of the input/output lines 99 and is connected to the linear central conductor short-circuit part 13 at one end and open at the other end. If no stub conductors 14 are provided, the central conductor 11 integrated with the central conductor short-circuit part 13 forms a quarter-wave resonator. Each grounding conductor 12 has a side edge at which the grounding conductor exchanges charges with the opposed conductor, and the grounding conductors 12 are symmetrically disposed on the opposite sides of the central conductor 11 at equal distances from the central conductors 11. The central conductor short-circuit part 13 is a linear conductor that short-circuits the pair of grounding conductors 12 to each other and is connected to the side edges of the grounding conductors substantially at right angles. The central conductor 11 is connected substantially at right angles at to a central part of the central conductor short-circuit part 13 one end. The paired stub conductors 14 are symmetrically disposed on the opposite sides of the central conductor 11 at a distance X to extend parallel with each other. Each stub conductor 14 is connected at right angles to the central conductor short-circuit part 13 at one end and open at the other end.

Without the pair of stub conductors 14, the dual-band bandpass resonator functions as a simple single-band bandpass quarter-wave resonator because only the central conductor 11 and the grounding conductors 12 resonate and exchange charges. However, according to the present invention, the stub conductors 14 are disposed between the central conductor 11 and the grounding conductors 12. As a result, the central conductor 1 and the stub conductors 14 resonate and exchange charges, and the stub conductors 14 and the grounding conductors 12 resonate and exchange charges. Therefore, a dual-band bandpass resonator is provided.

In FIG. 1, the central conductor 11 and the stub conductors 14 are shown as having substantially the same length. However, the central conductor 11 and the stub conductors 14 do not need to have the same length. The length $L_1$ of the central conductor 11, the length $L_2$ of the stub conductors 14, the distance X between the central conductor 11 and the stub conductors 14, the width of the lines, the distance H between each stub conductor 14 and the opposed grounding conductor 12, the distance M in the longitudinal direction of the central conductor between the central conductor short-circuit part 13 and the grounding conductors 12, the distance D in the longitudinal direction of the central conductor between the central conductor 11 or stub conductors 14 and the grounding conductors 12 or the like can be appropriately determined to change the two resonance frequencies, the transmission losses at the resonance frequencies, the bandwidths or the like and produce a resonator having peaks of transmission characteristics at desired two frequencies.

Figure 2:
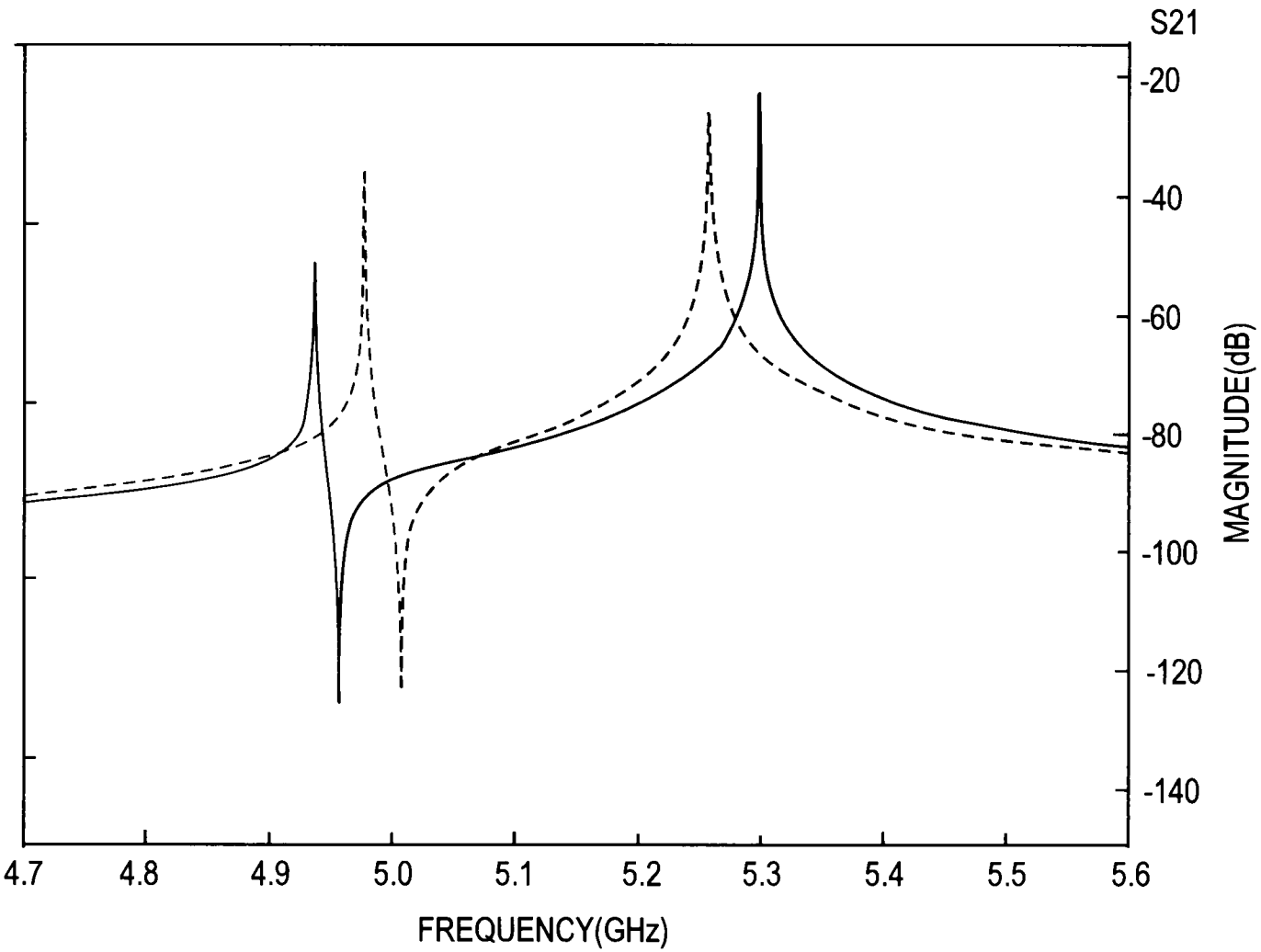
FIG. 2 is a graph showing transmission characteristics in cases where a central conductor is longer than stub conductors and where the central conductor is shorter than the stub conductors in the configuration shown in FIG. 1.

FIG. 2 is a graph showing transmission loss characteristics S21, in which the solid line indicates a case where the central conductor 11 is longer than the stub conductors 14 as shown in FIG. 1, and the dashed line indicates a case where the central conductor 11 is shorter than the stub conductors 14, not shown. In either case, two resonance frequencies are shown. The lower resonance frequency in the case where the central conductor 11 is longer than the stub conductors 14 is lower than the lower resonance frequency in the case where the central conductor 11 is shorter than the stub conductors 14, and the higher resonance frequency in the case where the central conductor 11 is longer than the stub conductors 14 is higher than the higher resonance frequency in the case where the central conductor 11 is shorter than the stub conductors 14.

As described above, the center frequency and bandwidths of the two pass bands can be controlled by adjusting a plurality of parameters including the distance X, the lengths $L_1$ and $L_2$ and the distances H, D and M, so that the design flexibility is improved.

[Second Embodiment]

Figure 3:
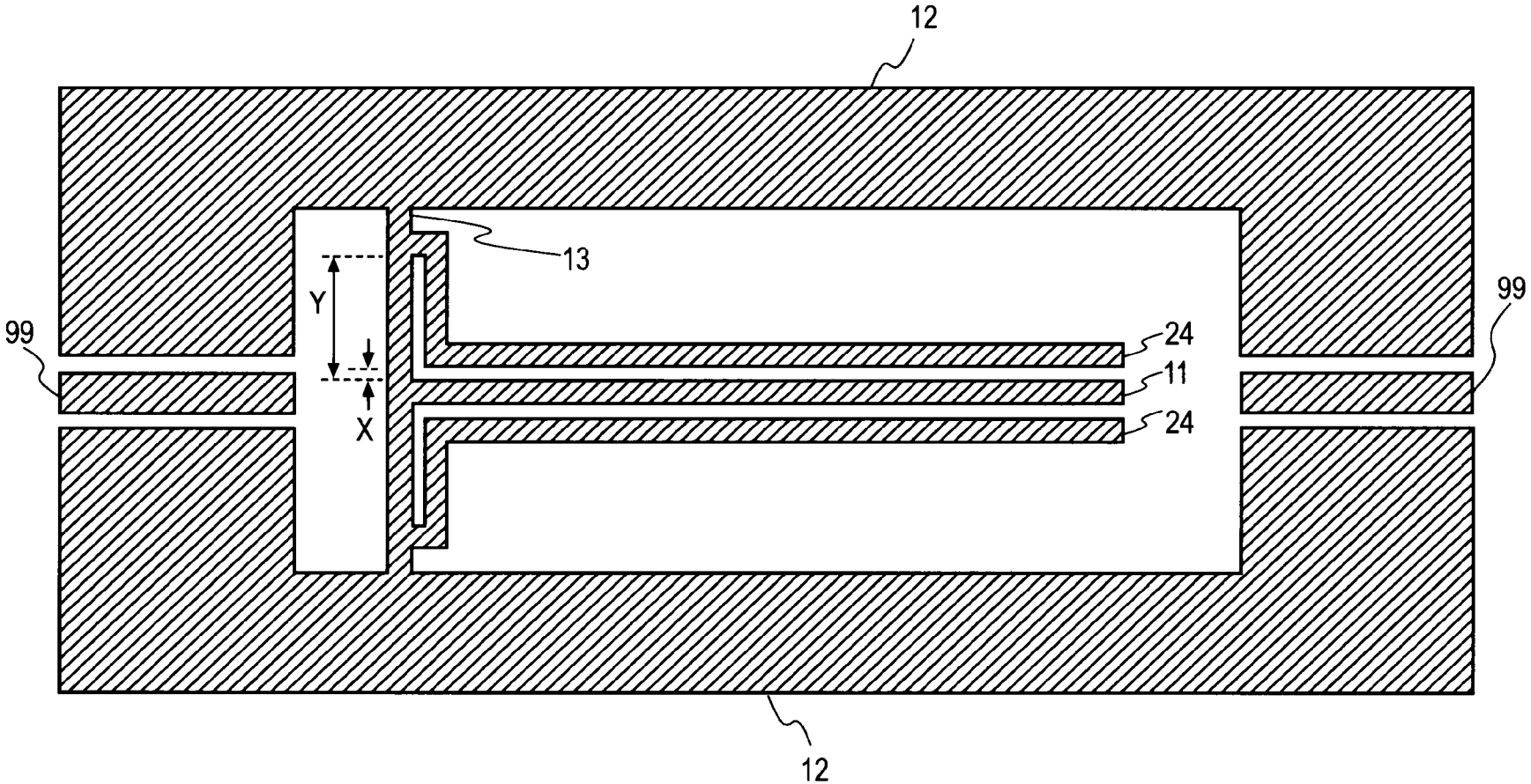
FIG. 3 is a plan view showing an exemplary configuration of a dual-band bandpass resonator according to a second embodiment.

FIG. 3 is a diagram showing a dual-band bandpass resonator according to a second embodiment of the present invention.

The dual-band bandpass resonator shown in FIG. 3 comprises a central conductor 11, a pair of grounding conductors 12, a central conductor short-circuit part 13, and a pair of stub conductors 24. All the components except the stub conductors 24 are the same as those in the first embodiment (FIG. 1) and therefore denoted by the same reference numerals, and descriptions thereof will be basically omitted. The same holds true for the embodiments described later.

The stub conductors 14 in the first embodiment are disposed to extend parallel with the central conductor 11 along the entire length thereof. However, as shown in FIG. 3, although the most part of the pair of stub conductors 24 in the second embodiment from the tip ends thereof extends parallel with the central conductor 11, the stub conductors 24 are bent substantially at right angles at a point close to the central conductor short-circuit part 13 to extend away from each other toward the respective grounding conductors 12, then bent again substantially at right angles toward the central conductor short-circuit part 13 before reaching the respective grounding conductors 12 and then connected to the central conductor short-circuit part 13. The two stub conductors 24 are configured symmetrically with respect to the central axis of the central conductor 11. In the other embodiments, the stub conductors are configured symmetrically with respect to the central axis of the central conductor 11. Thus, the distance Y between the point of connection of each stub conductor 24 to the central conductor short-circuit part 13 and the point of connection of the central conductor 11 to the central conductor short-circuit part 13 is longer than the distance X between the central conductor 11 and each stub conductor 24. With such a configuration, the lower resonance center frequency (center frequency of the lower pass band) can be further lowered by bringing the points of connection of the stub conductors 24 to the central conductor short-circuit part 13 closer to the respective grounding conductors 12 or, in other words, by increasing the distance Y.

As described above, with the configuration according to the second embodiment, the number of parameters for controlling the center frequency of the pass bands increases compared with the first embodiment, and therefore, the design flexibility is further improved.

[Third Embodiment]

Figure 4:
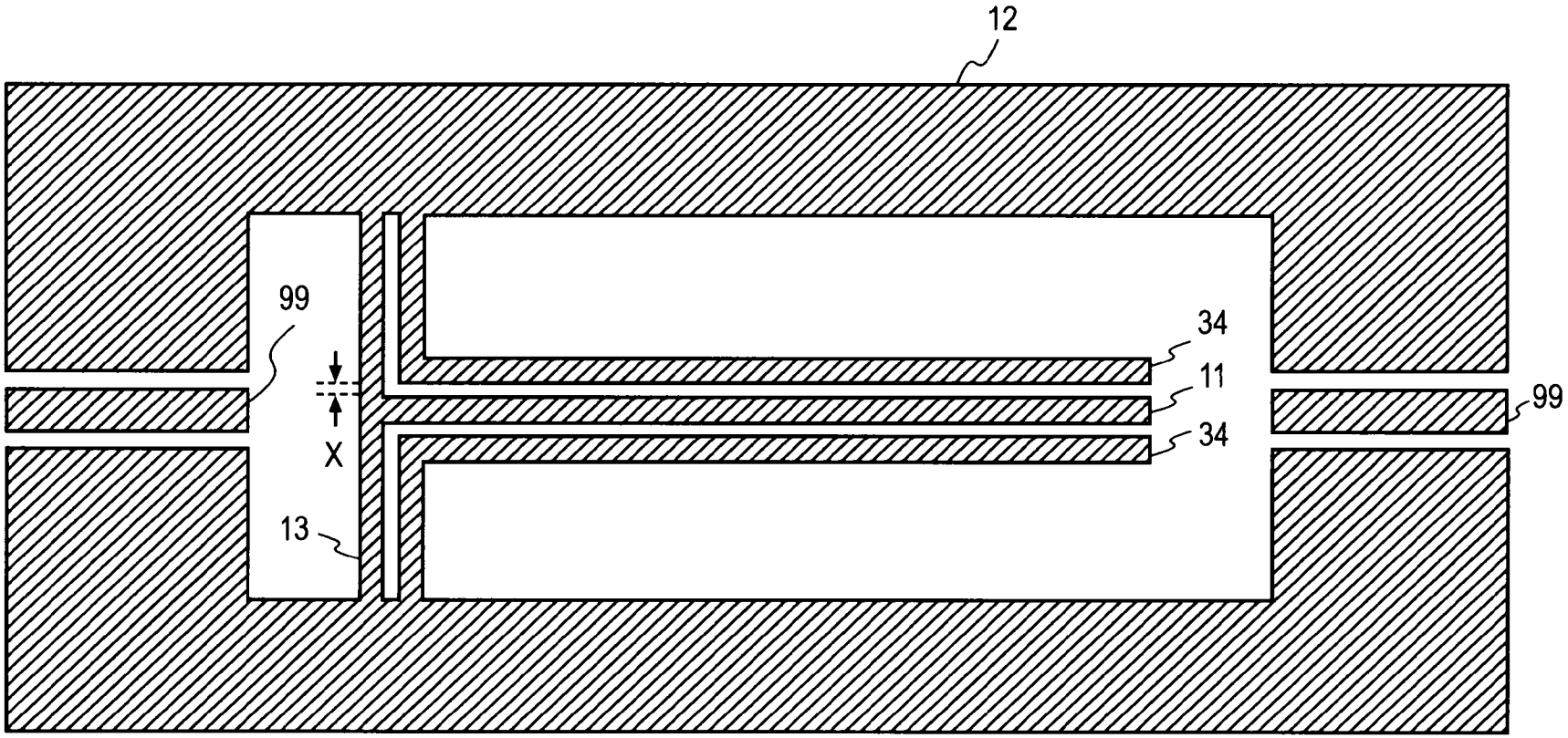
FIG. 4 is a plan view showing an exemplary configuration of a dual-band bandpass resonator according to a third embodiment.

FIG. 4 is a diagram showing a dual-band bandpass resonator according to a third embodiment of the present invention.

The dual-band bandpass resonator shown in FIG. 4 comprises a central conductor 11, a pair of grounding conductors 12, a central conductor short-circuit part 13, and a pair of stub conductors 34. The third embodiment differs from the first and second embodiments only in the shape of the stub conductors 34.

The stub conductors 24 in the second embodiment extend parallel with the central conductor 11 for the most part thereof and are bent toward the respective grounding conductors 12 at a point close to the central conductor short-circuit part 13, bent again toward the central conductor short-circuit part 13 before reaching the grounding conductor 12 and then connected to the central conductor short-circuit part 13. The lower resonance center frequency (center frequency of the lower pass band) can be further lowered by bringing the points of connection of the stub conductors 24 to the central conductor short-circuit part 13 closer to the respective grounding conductors 12. However, instead of bringing the points of connection of the stub conductors 24 to the central conductor short-circuit part 13 closer to the respective grounding conductors 12, the stub conductors 24 may be connected directly to the respective grounding conductors 12. Thus, although the pair of stub conductors 34 in the third embodiment is the same as the stub conductors 24 in the second embodiment in that the stub conductors 34 extend parallel with the central conductor 11 for the most part thereof and are bent substantially at right angles toward the respective grounding conductors 12 at a point close to the central conductor short-circuit part 13, the stub conductors 34 in the third embodiment differs from the stub conductors 24 in the second embodiment in that the stub conductors 34 bent once extend straight to the respective grounding conductors 12 and are connected thereto.

As described above, since the stub conductors 34 are connected directly to the respective grounding conductors 12, the lower resonance center frequency (center frequency of the lower pass band) can be further lowered compared with the second embodiment.

[Fourth Embodiment]

Figure 5:
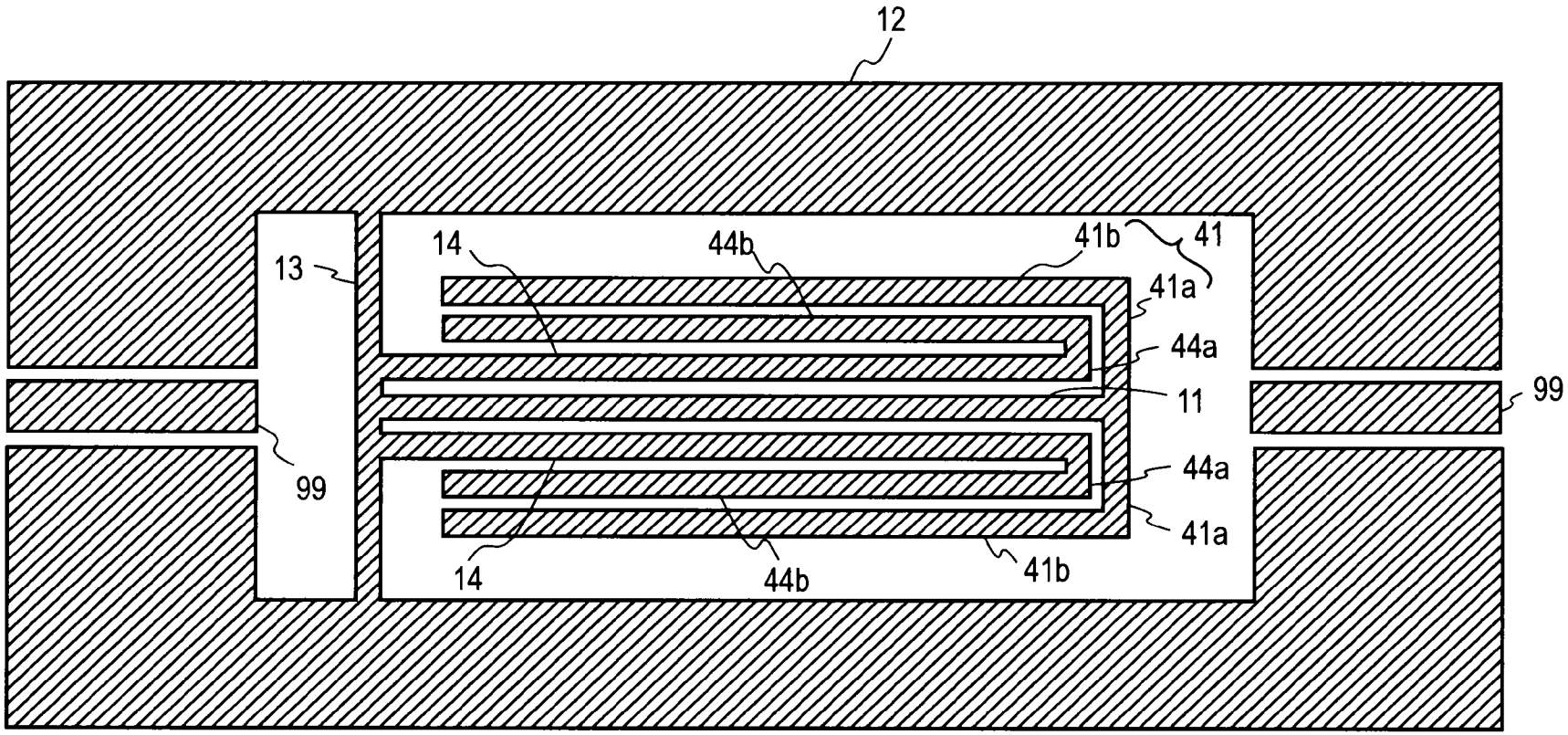
FIG. 5 is a plan view showing an exemplary configuration of a dual-band bandpass resonator according to a fourth embodiment that is based on the configuration according to the first embodiment.
Figure 6:
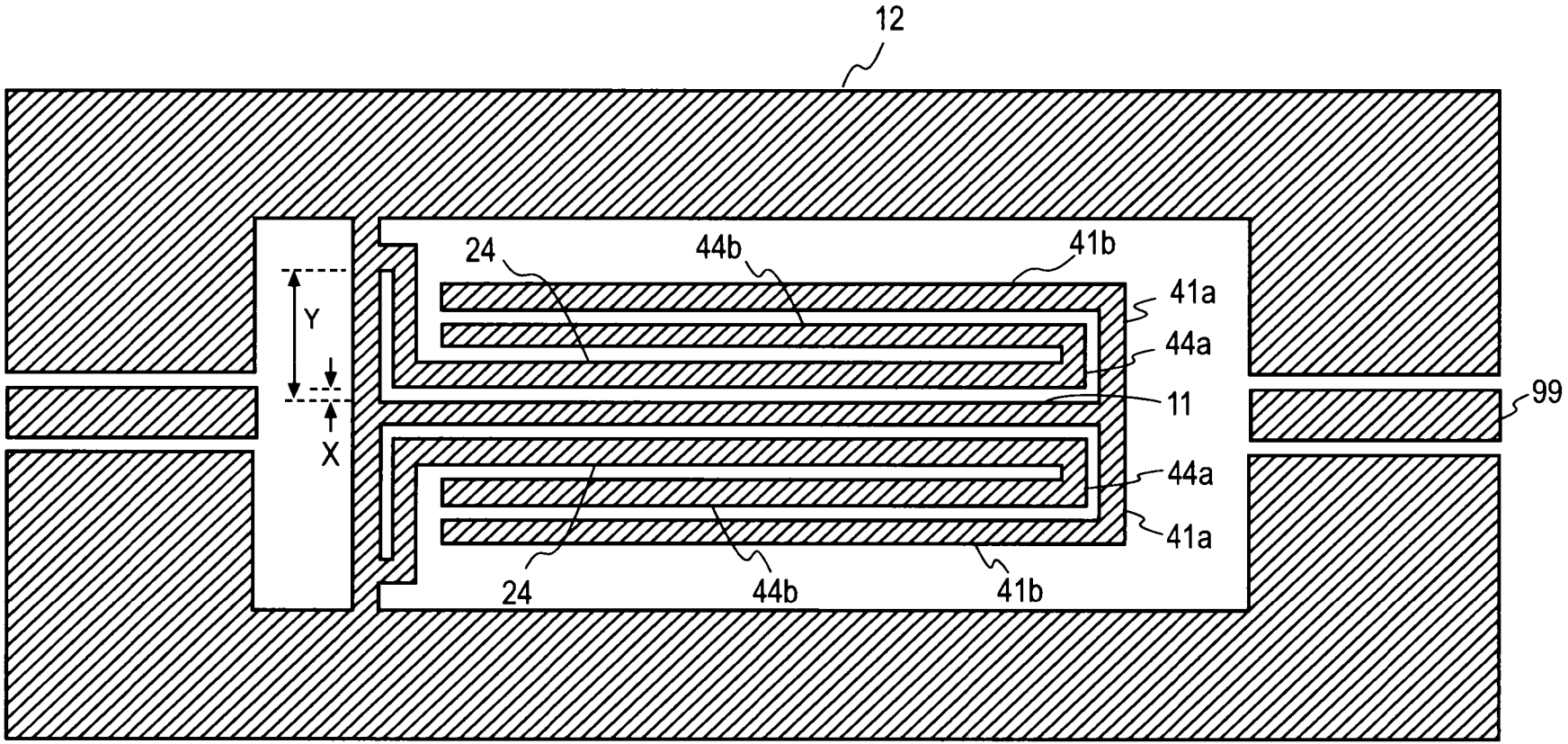
FIG. 6 is a plan view showing an exemplary configuration of the dual-band bandpass resonator according to the fourth embodiment that is based on the configuration according to the second embodiment.
Figure 7:
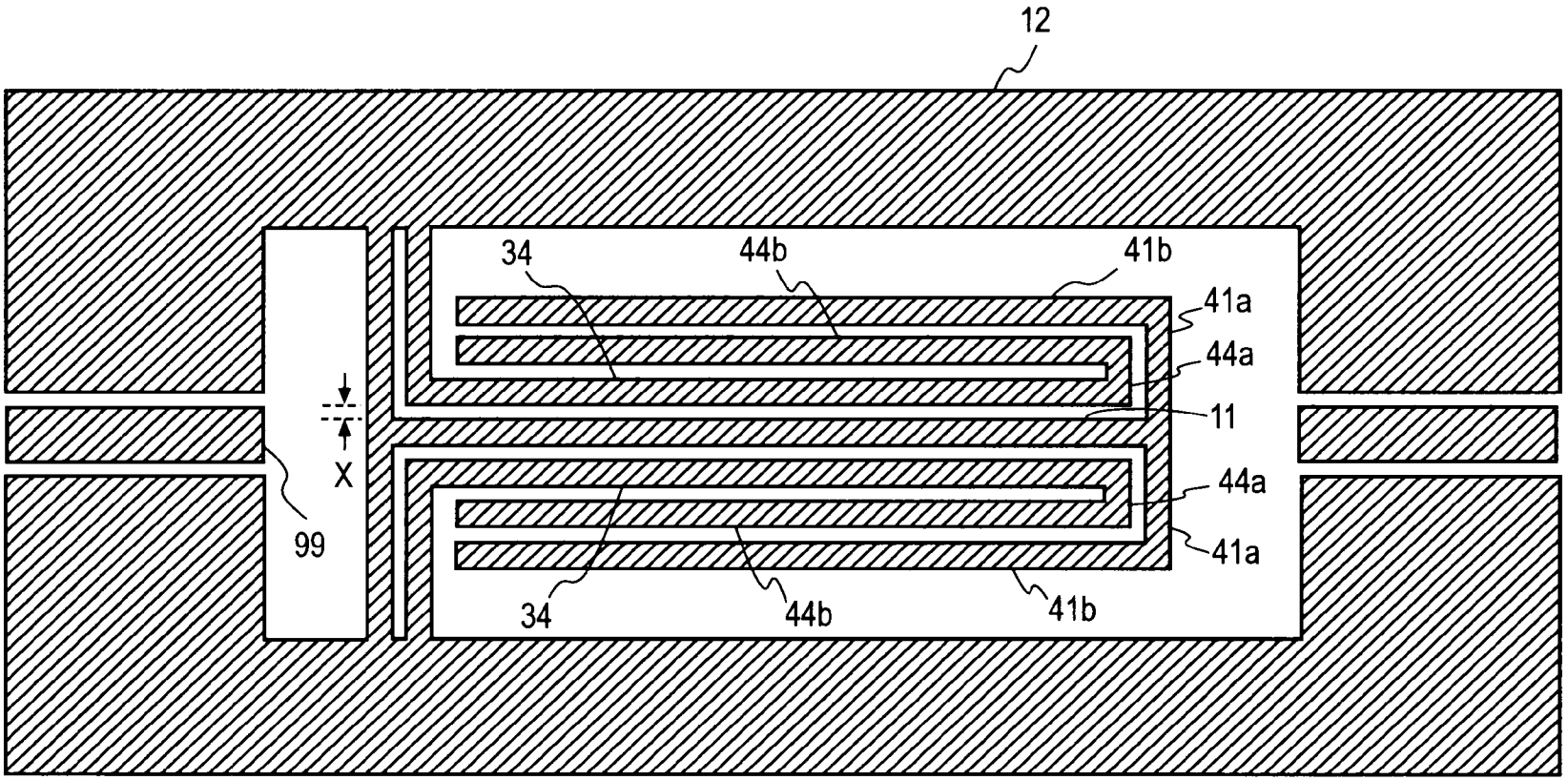
FIG. 7 is a plan view showing an exemplary configuration of the dual-band bandpass resonator according to the fourth embodiment that is based on the configuration according to the third embodiment.

A fourth embodiment is an aspect of the present invention based on the configurations according to the first to third embodiments that is designed to provide a resonator having a lower resonance frequency by elongating the electrical length of the resonator by folding the central conductor to equivalently achieve miniaturization of the resonator. FIGS. 5, 6 and 7 are diagrams showing exemplary configurations of dual-band bandpass resonators according to the present invention, which are equivalent to the configurations according to the first, second and third embodiments (FIGS. 1, 3 and 4), respectively, in which central conductor extension parts and stub conductor extension parts are added to the central conductor and the stub conductors, respectively. In the following, as a representative, the dual-band bandpass resonator shown in FIG. 5 based on the configuration of the dual-band bandpass resonator shown in FIG. 1 will be described.

Two central conductor extension parts 41 branch from the tip end of a central conductor 11 that is the open end in the dual-band bandpass resonator shown in FIG. 1 and are folded back to extend in spaces between grounding conductors 12 and stub conductors 14 on the opposite sides of the central conductor 11. Each central conductor extension part 41 comprises a central conductor folding part 41*a* that extends parallel with a central conductor short-circuit part 13 and is connected to the tip end of the central conductor 11 at one end and a central conductor return part 41*b* that extends parallel with the central conductor 11 and is connected to the other end of the central conductor folding part 41*a* at one end and open at the other end.

A stub conductor extension part 44 extends from the tip end of each stub conductor 14 that is the open end in the dual-band bandpass resonator shown in FIG. 1 and is folded back to extend in a space between the central conductor return part 42 and the stub conductor 14. The stub conductor extension part 44 comprises a stub conductor folding part 44*a* that extends parallel with the central conductor short-circuit part 13 and is connected to the tip end of the stub conductor 14 at one end and a stub conductor return part 44*b* that extends parallel with the stub conductor 14 and is connected to the other end of the stub conductor folding part 44*a* at one end and open at the other end.

With the configuration according to the fourth embodiment described above, the center frequencies of the lower and higher pass bands can be controlled, and the resonator can have an elongated electrical length without increasing the outer dimensions, thus achieving equivalent miniaturization. The same holds true for the configurations shown in FIGS. 6 and 7, and descriptions thereof will be omitted.

[Fifth Embodiment]

Figure 8A:
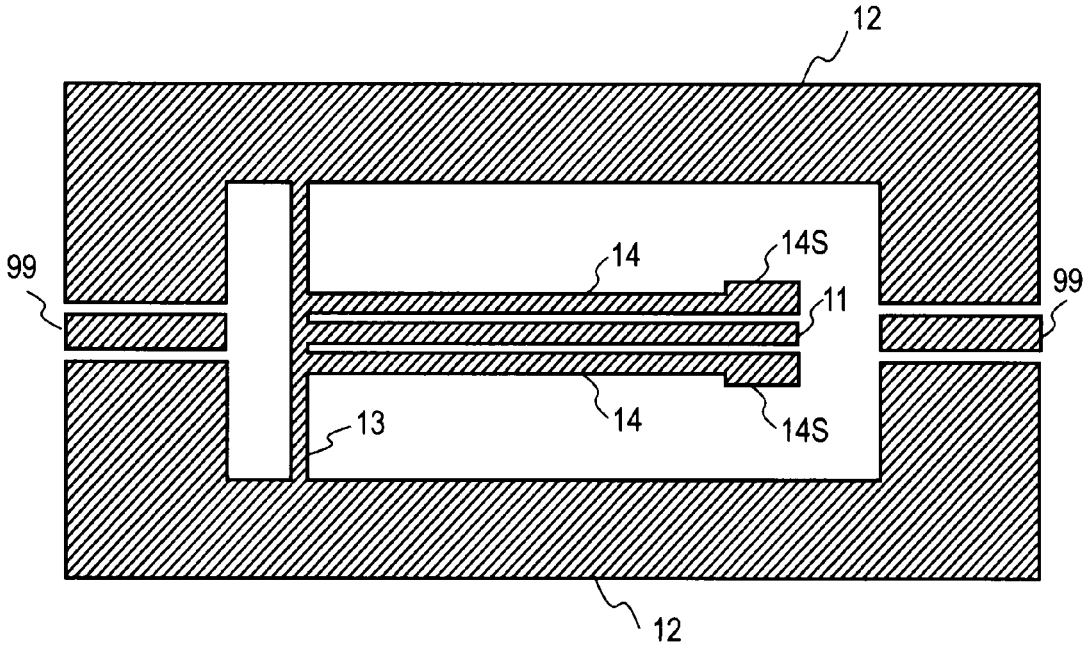
FIG. 8A is a plan view showing a configuration of a dual-band bandpass resonator according to a fifth embodiment.
Figure 8B:
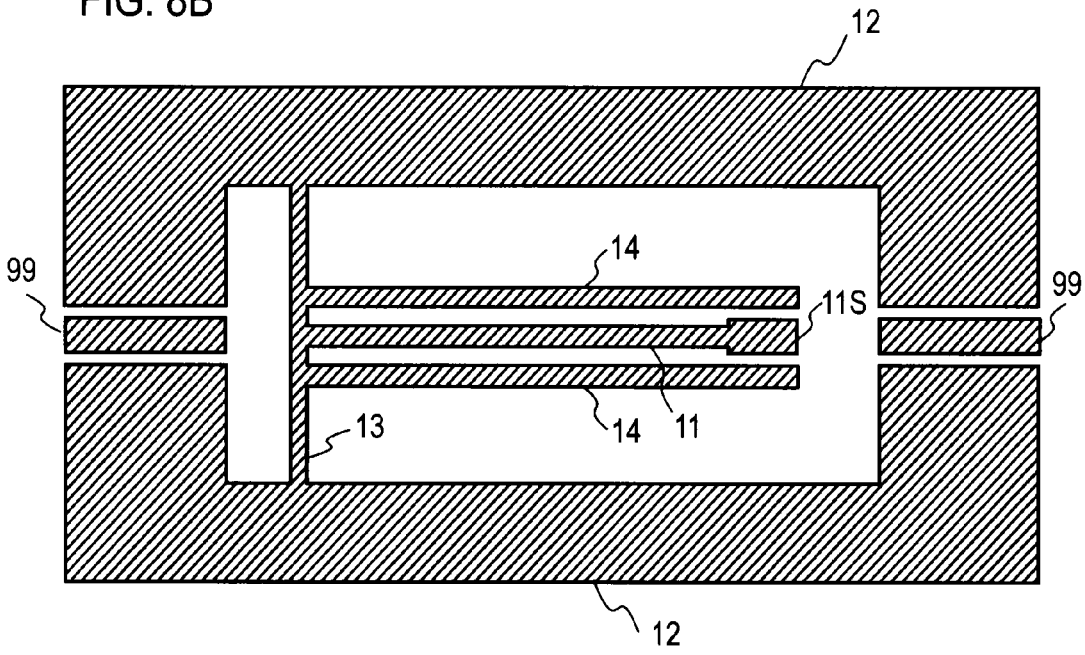
FIG. 8B is a plan view showing a modification of the embodiment shown in FIG. 8A.

Although not shown in FIG. 2, in the example of the resonator shown in FIG. 1, as the length of the central conductor 11 becomes closer to the length of the stub conductors 14, one of the resonance peaks is lowered. In order to achieve high peaks of the transmission characteristics at the two resonance frequencies, the electrical length of the central conductor 11 and the stub conductors 14 can be varied to make signals at the open ends of the conductors 11 and 14 out of phase with each other. The electrical length of the central conductor 11 and the stub conductors 14 can be varied by varying the physical length thereof as described above. However, according to a fifth embodiment, either the stub conductors 14 or the central conductor 11 has a stepped impedance configuration in which the line width is expanded at the open end, as shown in FIGS. 8A and 8B. FIG. 8A shows an example in which each stub conductor 14 has a stepped part 14S having an expanded line width at the open end thereof, and FIG. 8B shows an example in which the central conductor 11 has a stepped part 11S having an expanded line width at the open end thereof. With such a configuration, a desired transmission characteristics can be achieved without changing the line length.

[Sixth Embodiment]

A dual-band bandpass filter can be formed by arranging a plurality of dual-band bandpass resonators according to any of the embodiments described above in such a manner that the center axes of the respective central conductors are aligned with each other. The bandwidth of the lower and higher pass bands can be controlled by arranging at least a pair of dual-band bandpass resonators among the plurality of dual-band bandpass resonators forming the dual-band bandpass filter as shown in sixth to ninth embodiment described below.

In the sixth embodiment, a dual-band bandpass filter composed of two dual-band bandpass resonators according to the fourth embodiment shown in FIGS. 5, 6 and 7 will be described.

Figure 9:
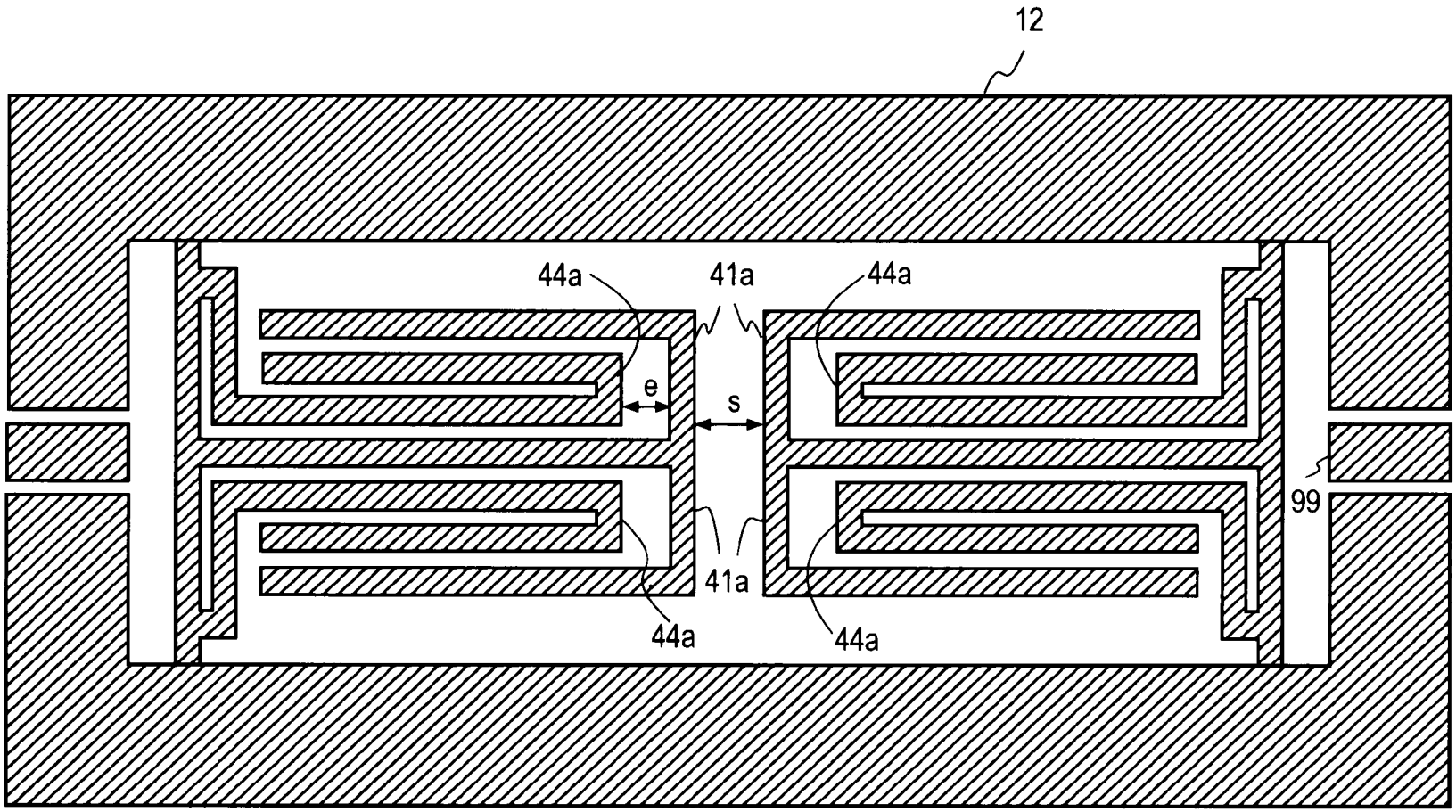
FIG. 9 is a plan view showing an exemplary configuration of a dual-band bandpass filter according to a sixth embodiment.
Figure 10:
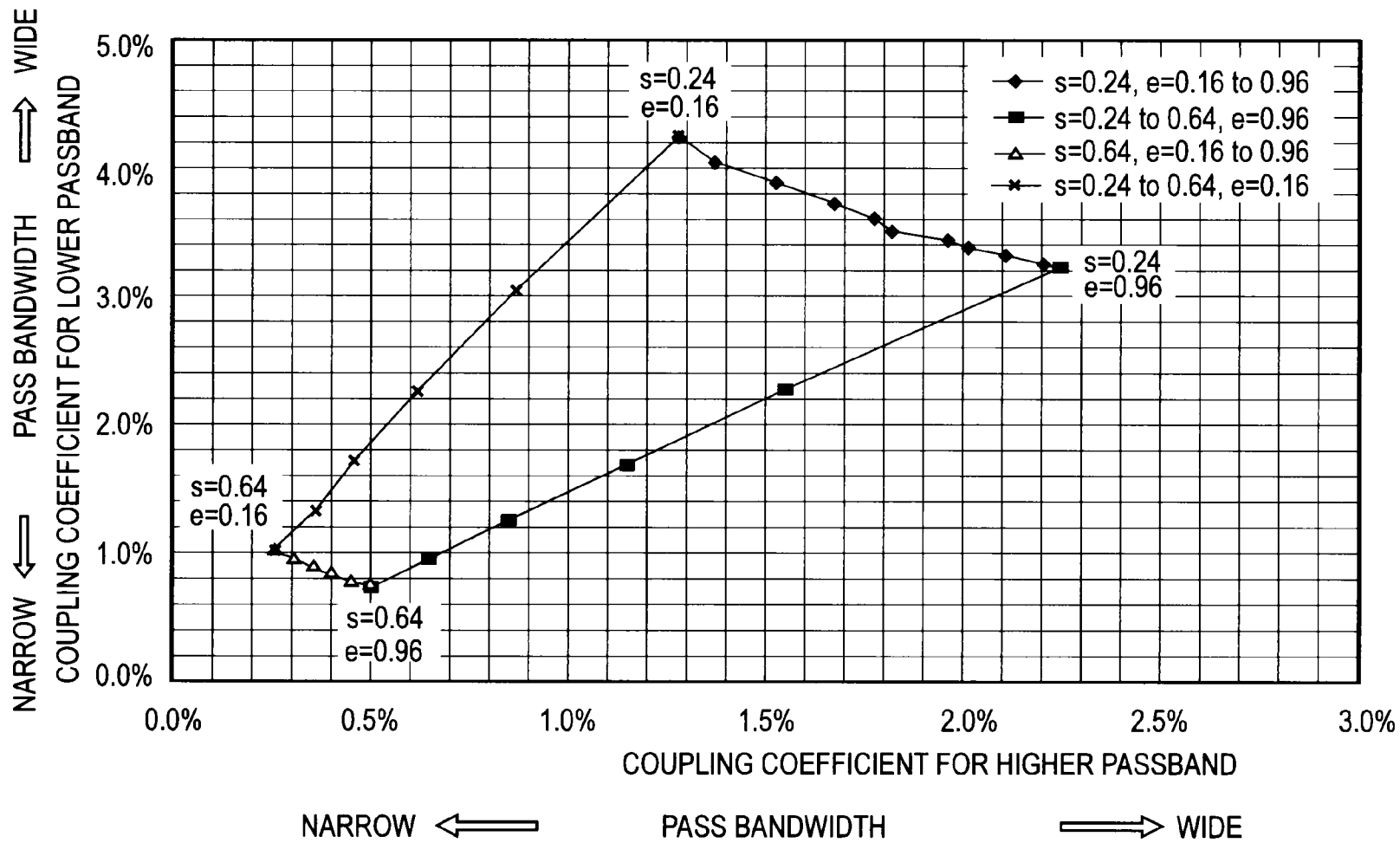
FIG. 10 is a diagram showing characteristics of variations of coupling coefficients when the distances s and e are changed in the configuration shown in FIG. 9.

FIG. 9 is a diagram showing an exemplary configuration of a filter composed of resonators shown in FIG. 6, in which the resonators are arranged with the central conductor folding parts 41*a* opposed to each other. With such an arrangement, the bandwidth of both the lower and higher pass bands can be appropriately changed by changing the distance "s" between the opposed central conductor folding parts 41*a* and the distance "e" between the central conductor folding part 41*a* and the stub conductor folding part 44*a*. FIG. 10 is a graph showing a tendency of variation of the coupling coefficient for the lower and higher pass bands when the distances "s" and "e" are changed. The abscissa indicates the coupling coefficient for the lower pass band, and the ordinate indicates the coupling coefficient for the higher pass band. As the coupling coefficient increases, the bandwidth of the pass bands also increases. As can be seen from FIG. 10, as the distance "s" decreases, the bandwidth of the lower and higher pass bands increases, and as the distance "e" increases, the bandwidth of the lower pass band increases, and the bandwidth of the higher pass band decreases.

With the configuration according to the sixth embodiment described above, a compact dual-band bandpass filter can be provided that not only can control the center frequencies of the lower and higher pass bands but also can appropriately control the bandwidth of the lower and higher pass bands. Although not shown, a dual-band bandpass filter can be formed by cascading a plurality of resonators shown in FIG. 8A and 8B in the same manner.

[Seventh Embodiment]

Figure 11:
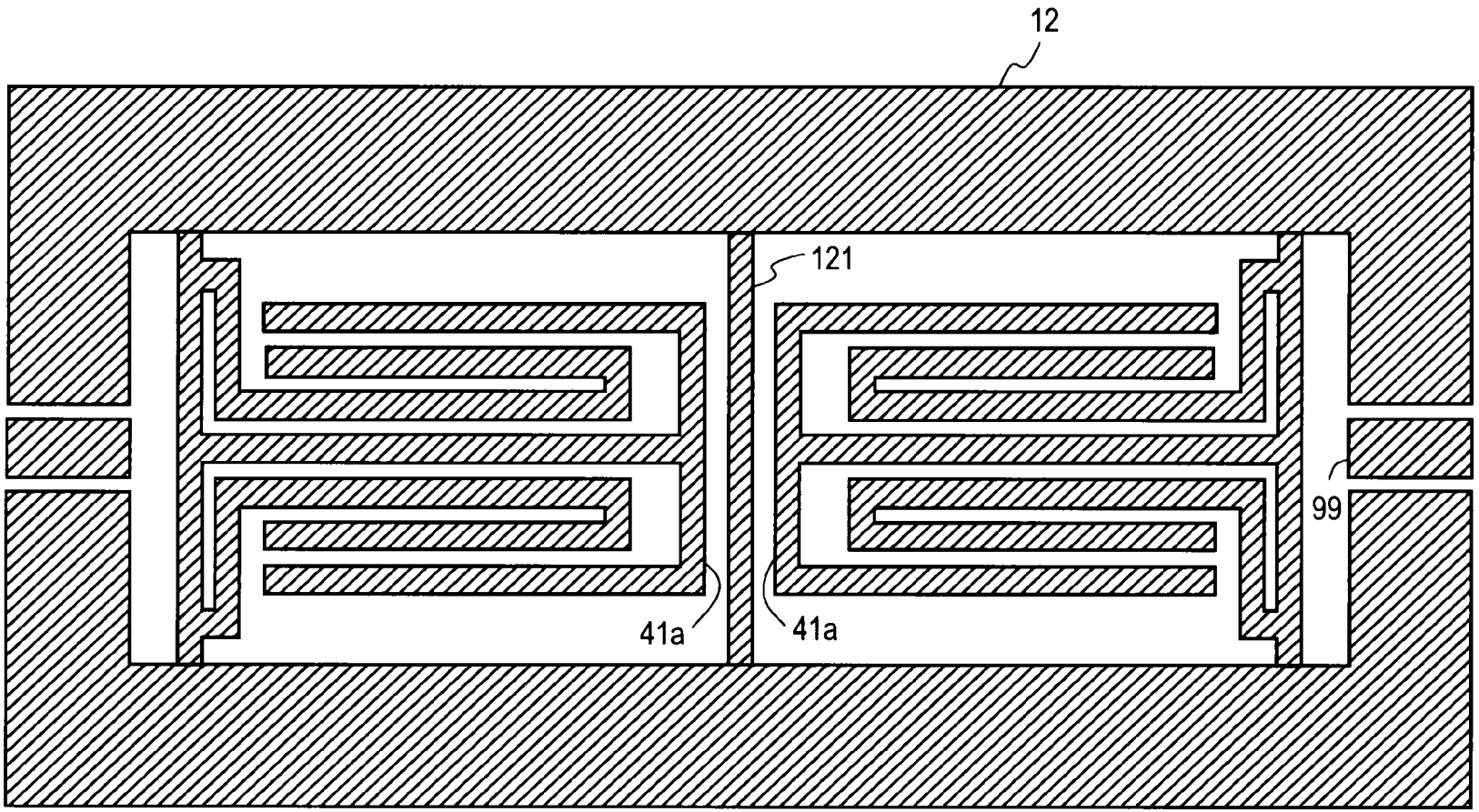
FIG. 11 is a plan view showing an exemplary configuration of a dual-band bandpass filter according to a seventh embodiment.

FIG. 11 is a diagram showing an exemplary configuration of a dual-band bandpass filter according to a seventh embodiment. The dual-band bandpass filter is the same as the dual-band bandpass filter according to the sixth embodiment shown in FIG. 9 except that a short-circuit stub 121 that short-circuits the pair of grounding conductors 12 to each other is further formed in the space between the opposed central conductor folding parts 41*a* of the two resonators.

In the presence of the short-circuit stub 121, the bandwidth of the lower and higher pass bands is reduced. In addition, as the width of the short-circuit stub 121 in the direction of the central axis of the central conductors 11 increases, the bandwidth of the pass bands is further reduced.

With the configuration according to the seventh embodiment described above, the number of parameters for controlling the center frequency of the pass bands increases compared with the sixth embodiment using the resonators shown in FIGS. 5, 6 and 7, and therefore, the design flexibility is further improved.

[Eighth Embodiment]

Figure 12:
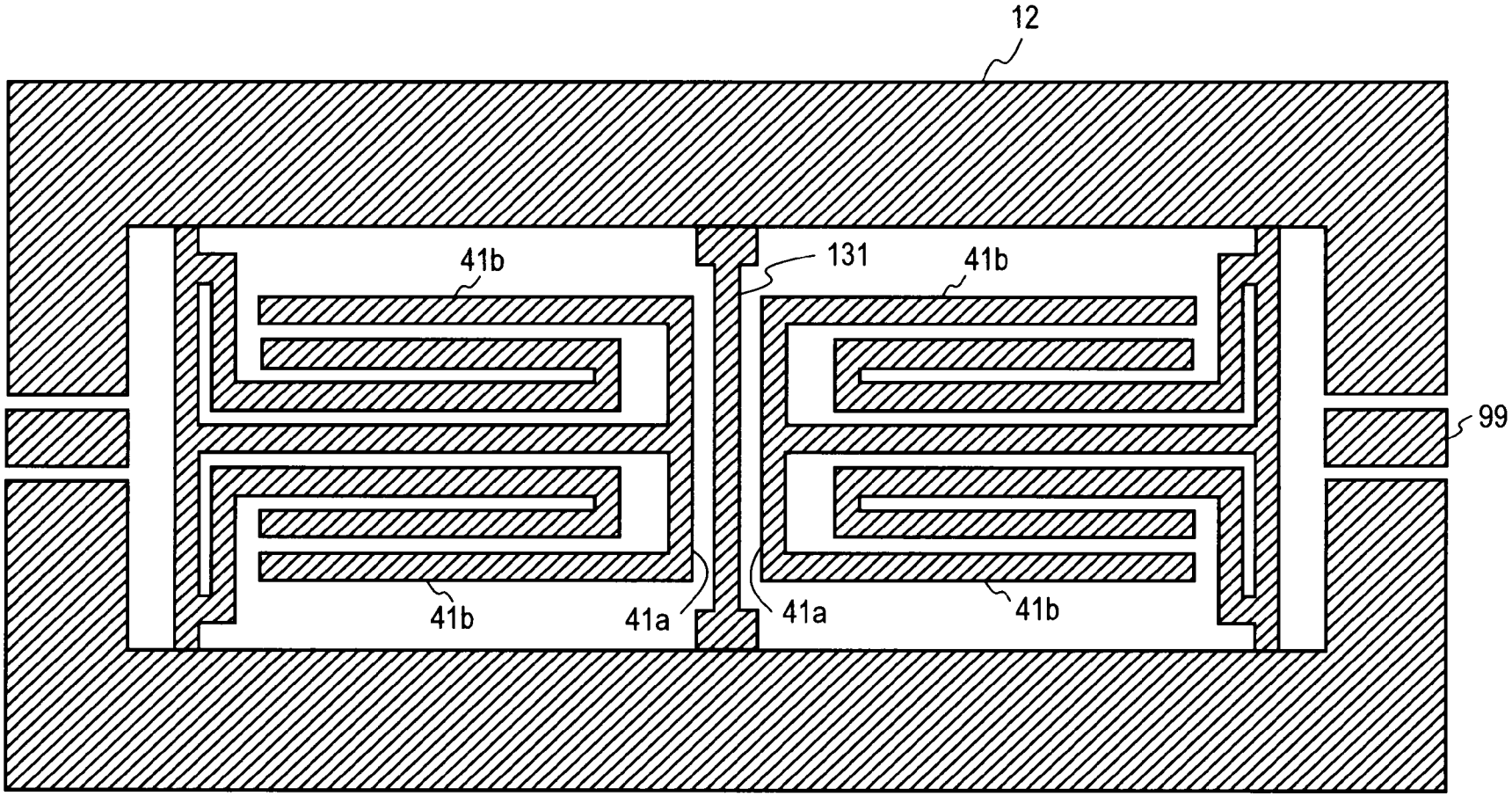
FIG. 12 is a plan view showing an exemplary configuration of a dual-band bandpass filter according to an eighth embodiment.

FIG. 12 is a diagram showing an exemplary configuration of a dual-band bandpass filter according to an eighth embodiment. The dual-band bandpass filter is the same as the dual-band bandpass filter according to the seventh embodiment shown in FIG. 11 except that the short-circuit stub 121 is replaced with a stepped impedance short-circuit stub 131.

The seventh embodiment shown in FIG. 11 shows that the bandwidth of the pass bands can be reduced by inserting the short-circuit stub 121 and can be further reduced by expanding the width of the stub 121. However, if the width of the stub 121 increases, the length of the entire resonator increases, and in some cases, a problem can arise that the center frequency of the pass bands significantly varies. To avoid such a problem and facilitate control of the bandwidth of the pass bands, according to the eighth embodiment, the short-circuit stub 131 has a stepped shape and is expanded to a desired width at parts from the grounding conductors 12 to near the central conductor return parts 41*b*.

With the configuration according to the eighth embodiment described above, a larger number of parameters for controlling the center frequency of the pass bands can be used than in the sixth embodiment, and therefore, the design flexibility is further improved. In addition, the bandwidth of the pass bands can be more easily controlled than in the configuration according to the seventh embodiment.

[Ninth Embodiment]

In a ninth embodiment, a dual-band bandpass filter composed of two dual-band bandpass resonators selected from among the dual-band bandpass resonators shown in FIGS. 5, 6 and 7 will be described.

Figure 13:
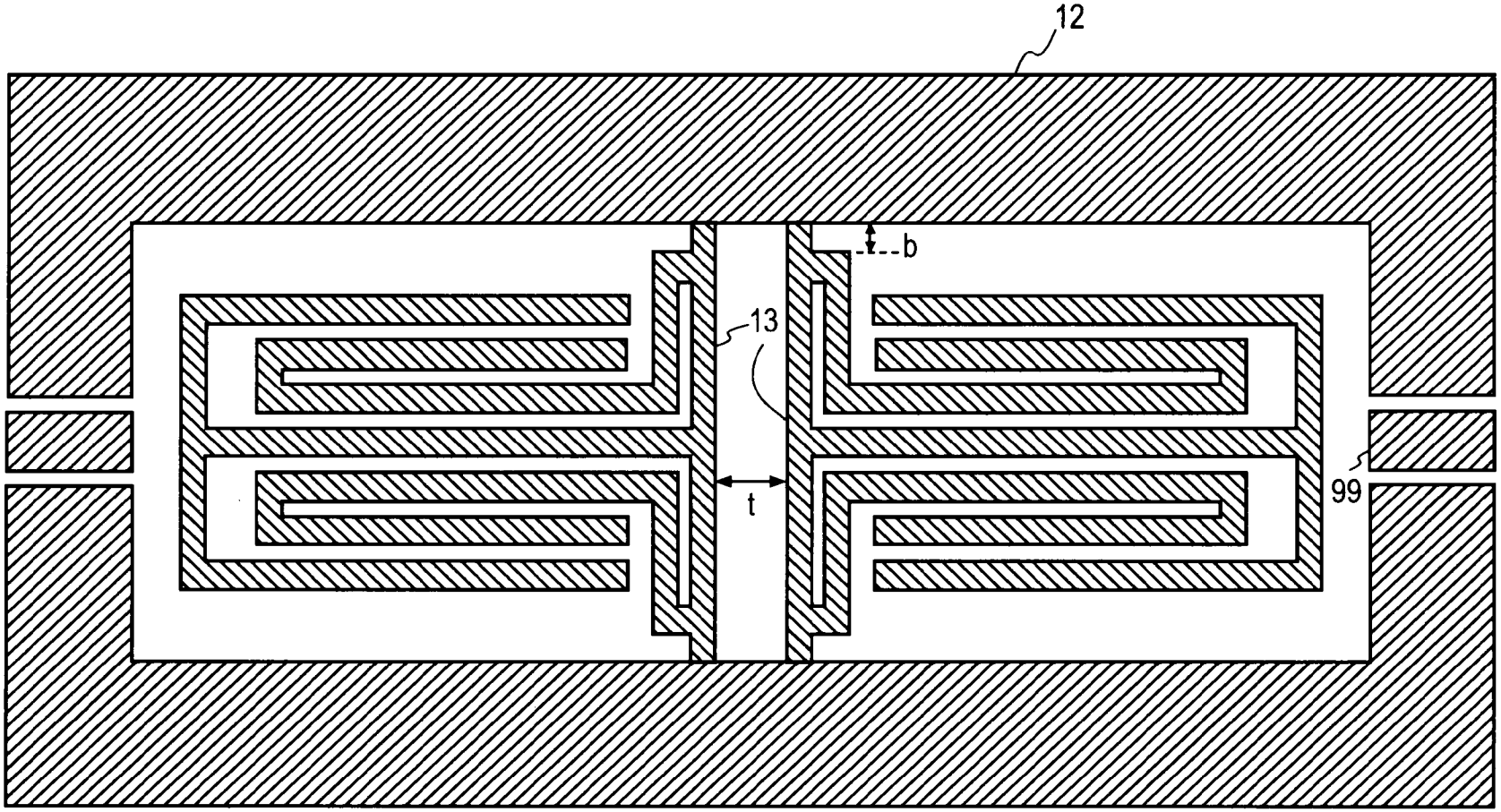
FIG. 13 is a plan view showing an exemplary configuration of a dual-band bandpass filter according to a ninth embodiment.
Figure 14:
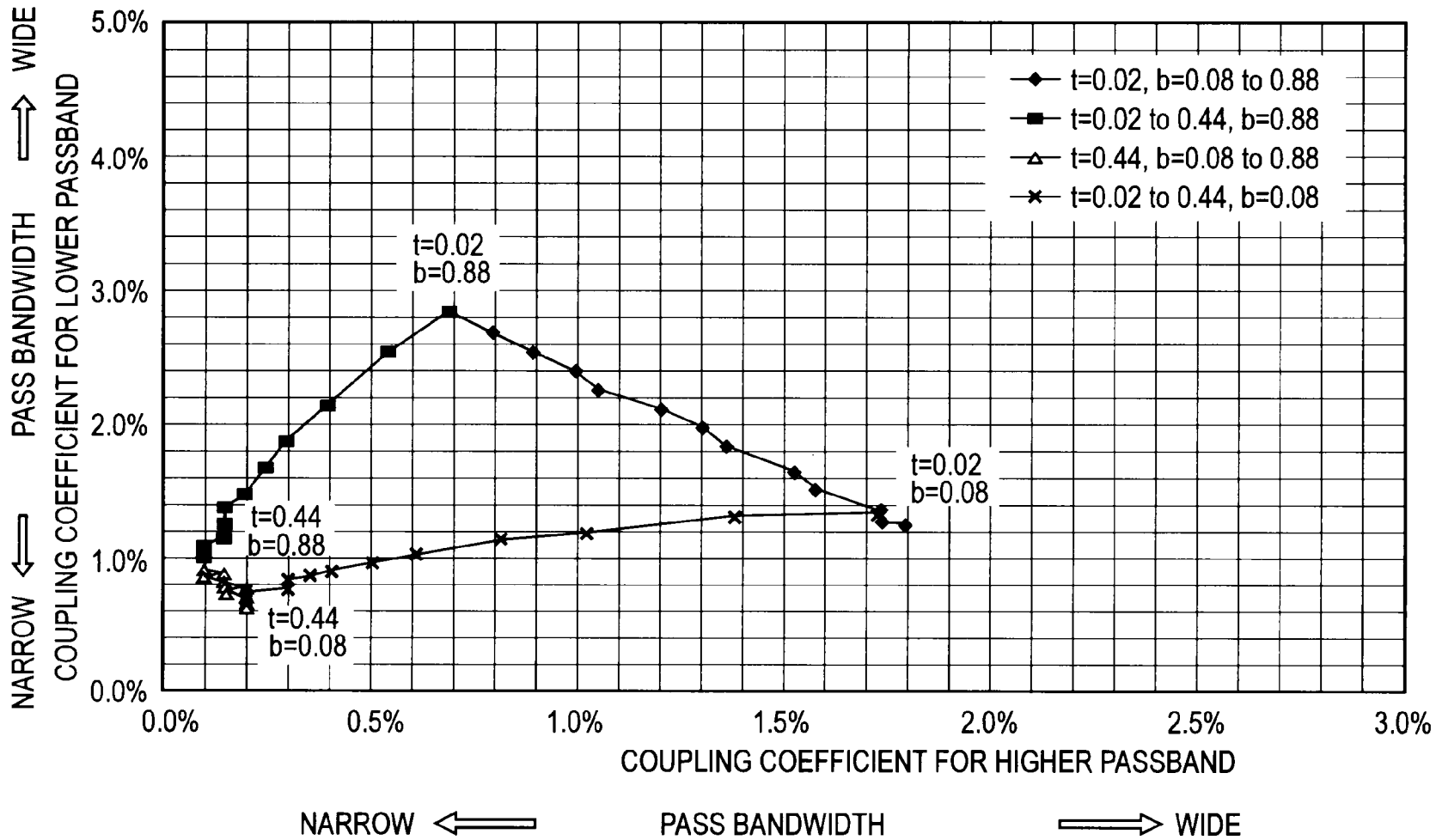
FIG. 14 is a diagram showing characteristics of variations of coupling coefficients when the distances t and b are changed in the configuration shown in FIG. 13.

FIG. 13 is a diagram showing an exemplary configuration in which the resonator shown in FIG. 6 is used, in which the resonators are arranged with the central conductor short-circuit parts 13 opposed to each other. With such an arrangement, the bandwidth of both the lower and higher pass bands can be appropriately changed by changing the distance "t" between the opposed central conductor short-circuit parts 13 and the distance "b" between the point of connection of the stub conductor 24 and the central conductor short-circuit part 13 and the grounding conductor 12. FIG. 14 is a graph showing variations of the coupling coefficient for the lower and higher pass bands when the distances "t" and "b" are changed.

The abscissa indicates the coupling coefficient for the lower pass band, and the ordinate indicates the coupling coefficient for the higher pass band. As the coupling coefficient increases, the bandwidth of the pass bands also increases. As can be seen from FIG. 14, as the distance "t" decreases, the bandwidth of the lower and higher pass bands increases, and as the distance "b" increases, the bandwidth of the lower pass band decreases, and the bandwidth of the higher pass band increases.

With the configuration according to the ninth embodiment described above, a compact dual-band bandpass filter can be provided that not only can control the center frequencies of the lower and higher pass bands but also can appropriately control the bandwidth of the lower and higher pass bands.

[Result of Simulation of Filter Characteristics]

Figure 15:
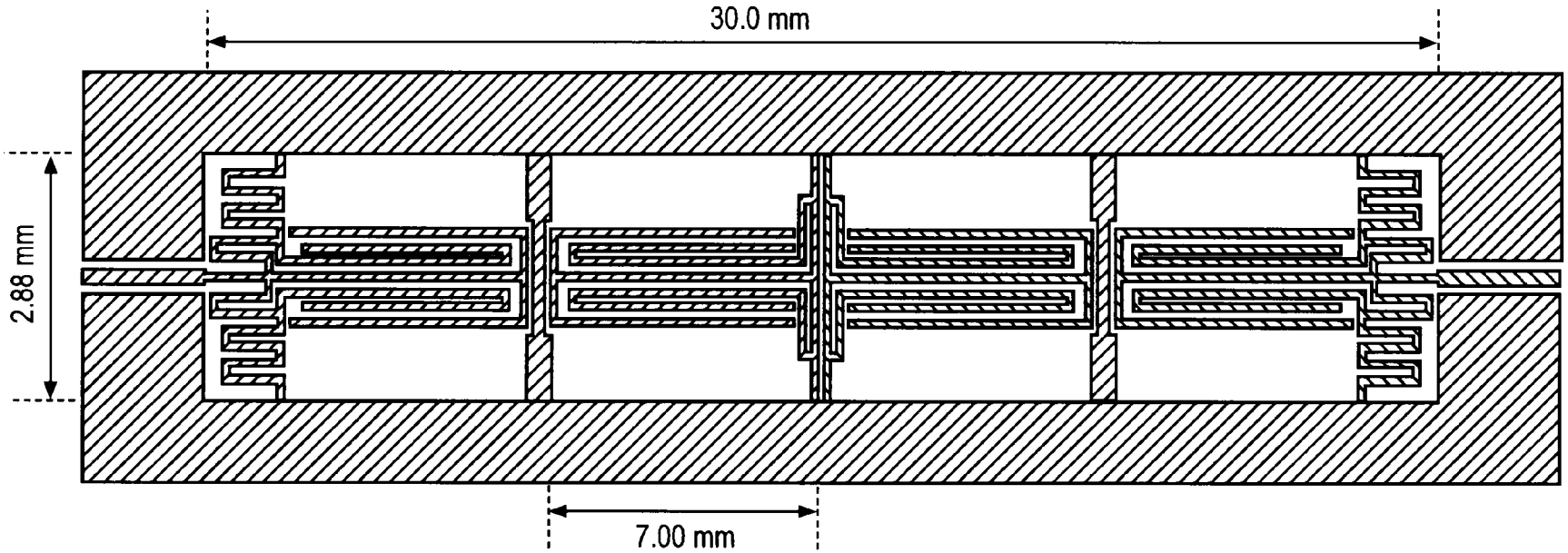
FIG. 15 is a plan view showing a configuration of a filter used in characteristics simulation.
Figure 16A:
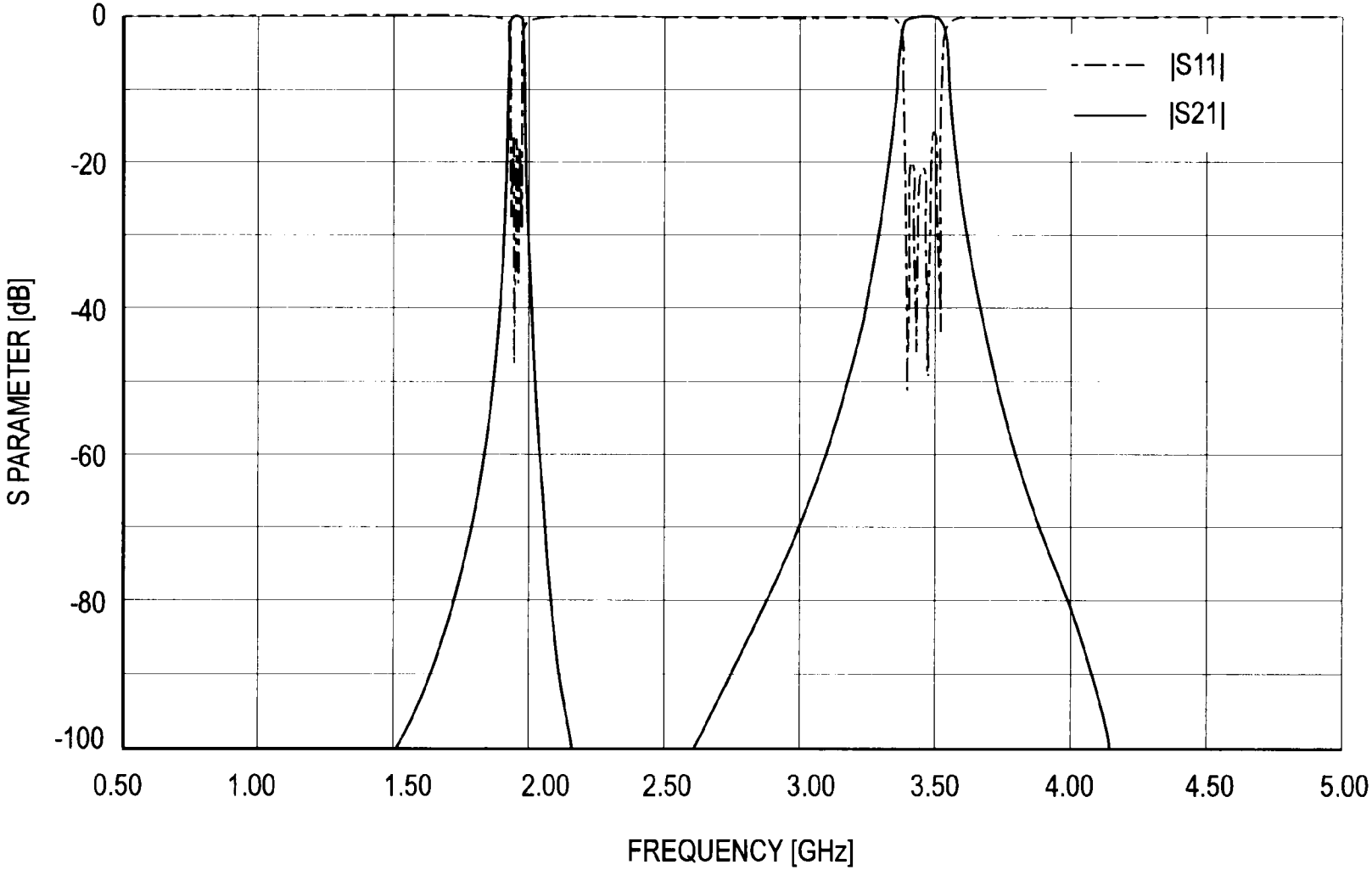
FIG. 16A is a graph showing results of simulation of characteristics of the configuration shown in FIG. 15.
Figure 16B:
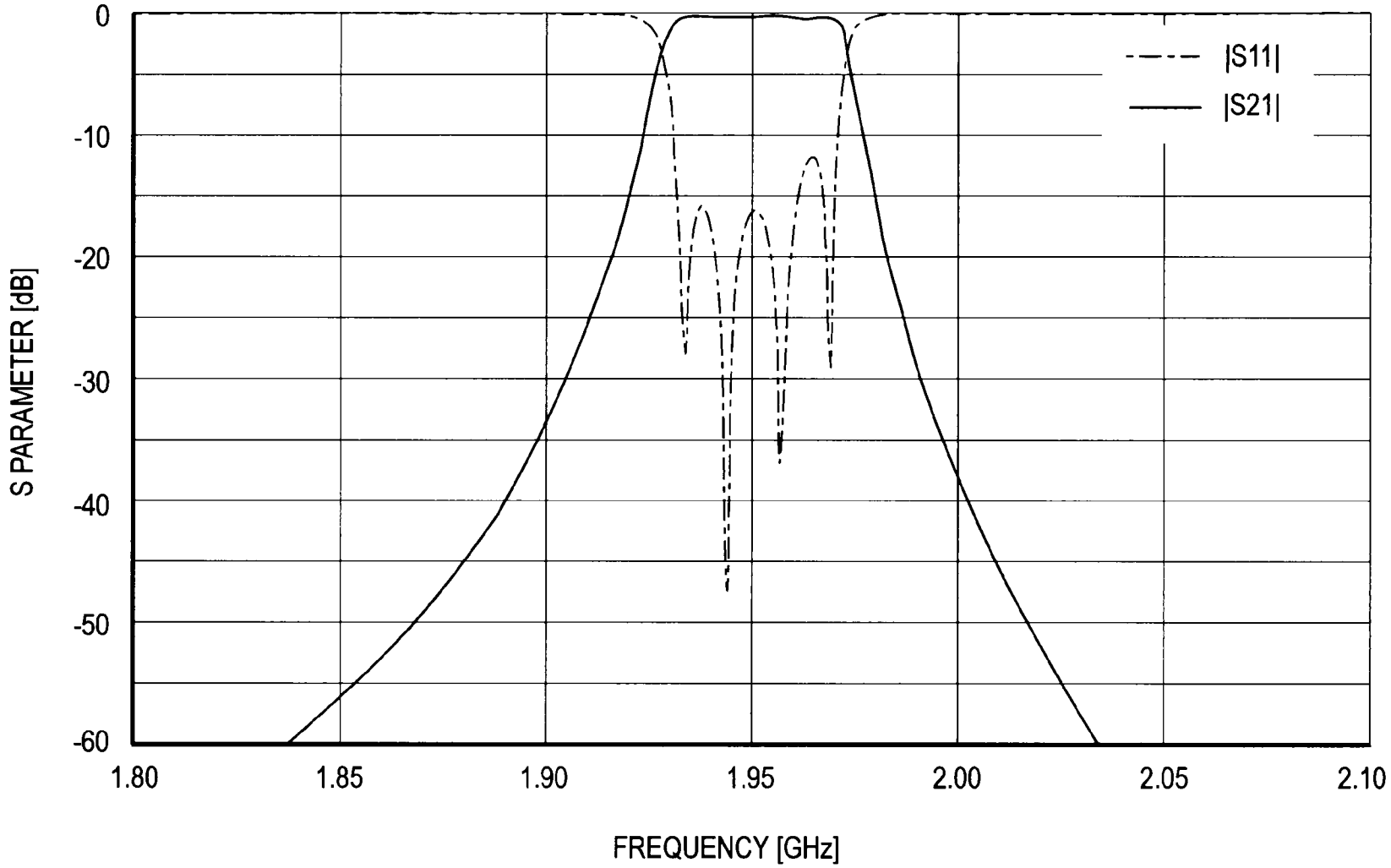
FIG. 16B is an enlarged view of a part of a lower pass band in FIG. 16A.
Figure 16C:
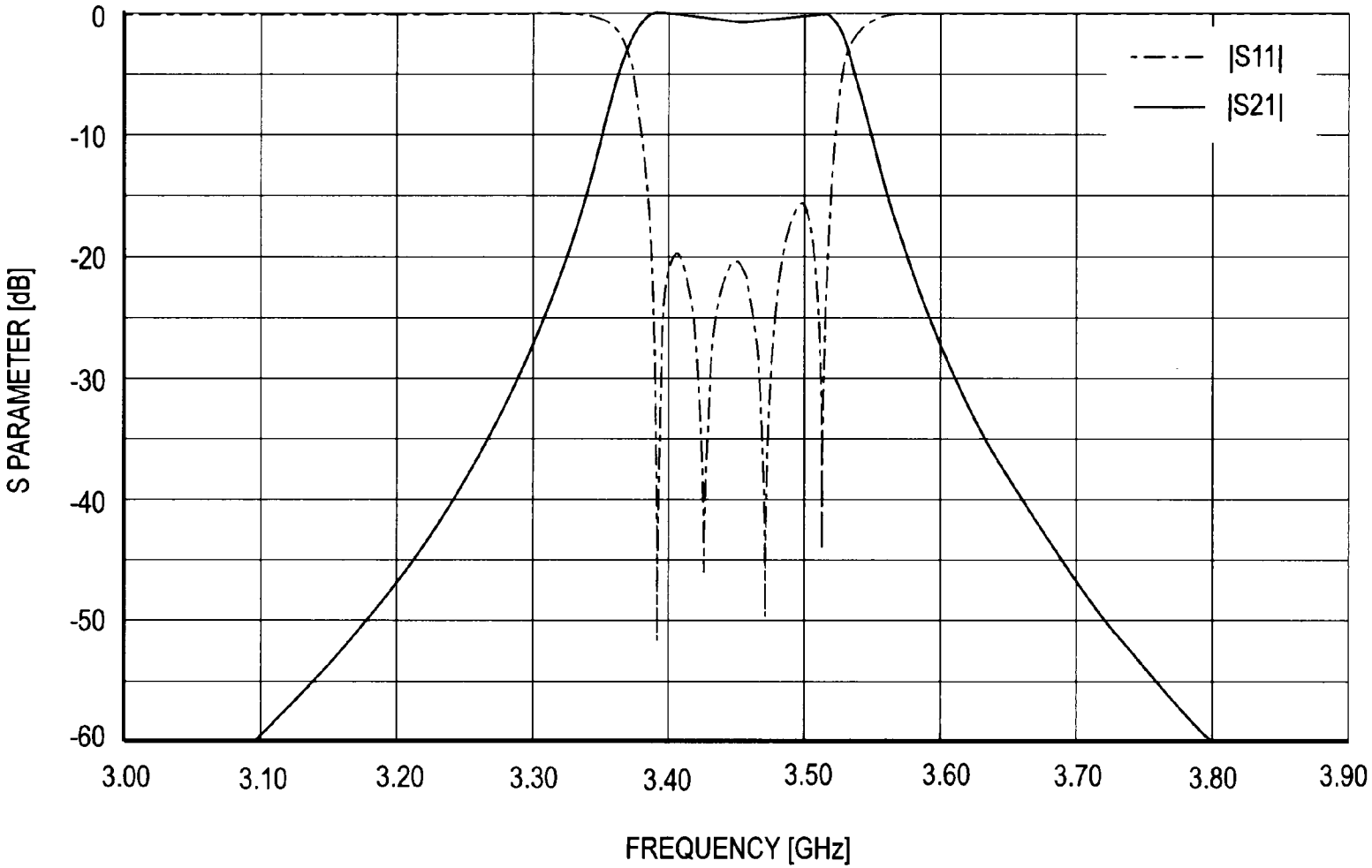
FIG. 16C is an enlarged view of a part of a higher pass band in FIG. 16A.

FIGS. 16A to 16C show results of simulation of electrical characteristics of a filter composed of four resonators cascaded to each other shown in FIG. 15. The filter shown in FIG. 15 is a four-stage dual-band bandpass filter composed of four dual-band bandpass resonators shown in FIG. 6 in which the stepped impedance short-circuit stub shown in FIG. 11 is disposed between each pair of opposed central conductor folding parts, and any opposed central conductor short-circuit parts are disposed with a space interposed therebetween as shown in FIG. 13. Without the stub conductors, the center frequency of the pass band of the dual-band bandpass resonator shown in FIG. 6 is 2.6 GHz.

FIG. 16A shows results of simulation of the reflection characteristics (S11; alternate long and short dash line) and the transmission characteristics (S21; solid line) of the filter configured as shown in FIG. 15 for input signals at frequencies ranging from 0.5 GHz to 5.0 GHz. FIGS. 16B and 16C are enlarged views of the respective pass bands in FIG. 16A or, more specifically, enlarged views of a frequency range of 1.8 GHz to 2.1 GHz and a frequency range of 3.0 GHz to 3.9 GHz, respectively. As can be seen from this result, two pass bands that differ in fractional bandwidth (ratio of the bandwidth to the center frequency) occur in the vicinity of 1.95 GHz and 3.45 GHz, and unwanted signals at frequencies other than the desired pass bands can be substantially blocked.

[Switchable Dual-Band Bandpass Resonator and Filter]

The resonators and filters according to the embodiments described above can simultaneously operate on signals in two frequency bands widely spaced apart from each other and allow wideband communication in a service environment in which two frequency bands are used. However, when a mobile terminal incorporating such a filter, such as a cellular phone, is roaming in a service area in which only one of the frequency bands is used, unwanted signals received in the other frequency band are regarded as interference signals, and therefore, the dual band operation is not preferred.

The embodiments described below differ from the embodiments described above in that the operation of the resonator (or filter) can be switched between the operation as a dual-band bandpass resonator (or a dual-band bandpass filter) and the operation as a single-band bandpass resonator (or a single-band bandpass filter). Such a configuration can block the interference signals in one of the two frequency bands that is not used.

[Tenth Embodiment]

Figure 17:
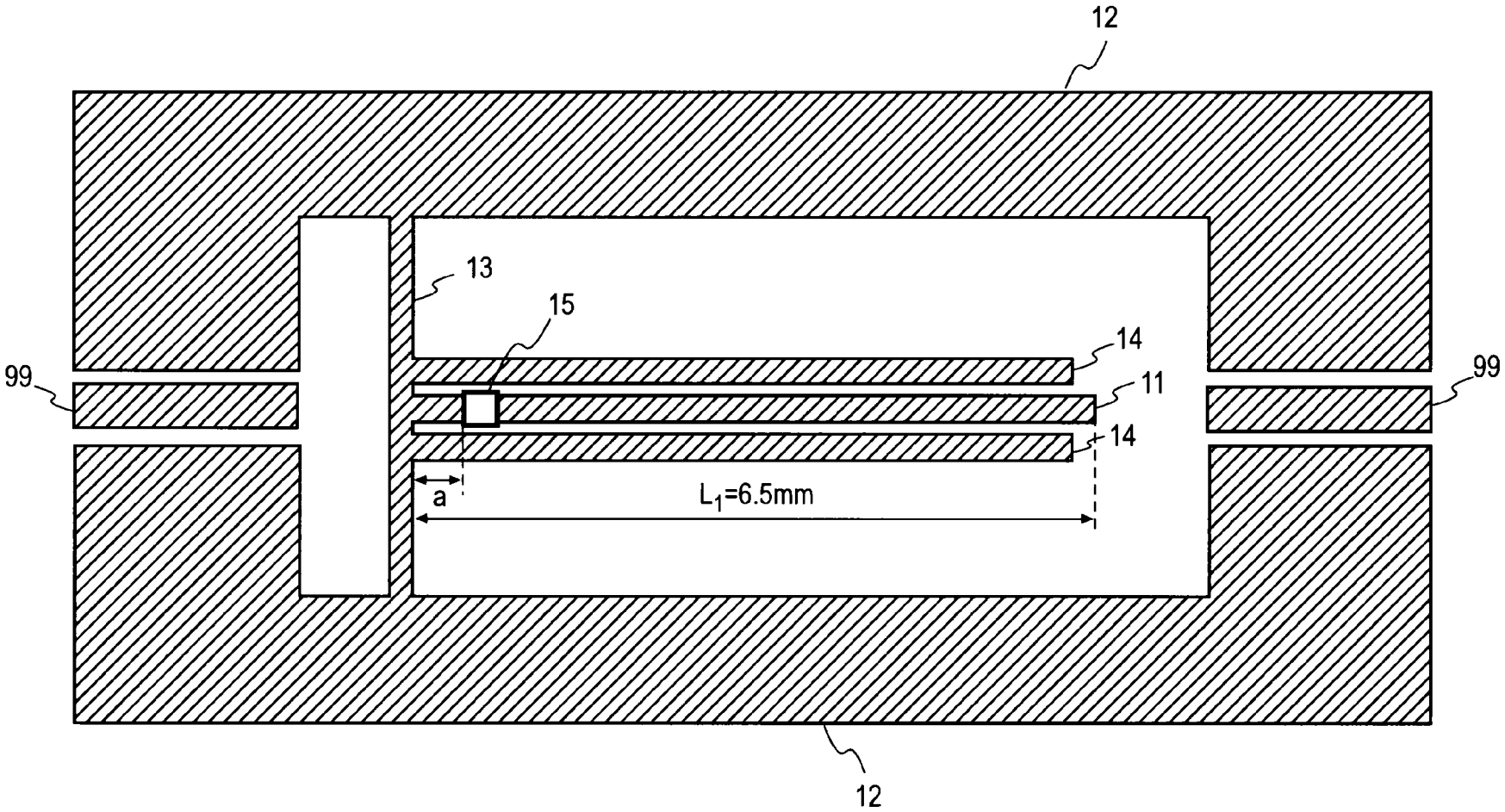
FIG. 17 is a plan view showing a configuration of a resonator according to a tenth embodiment that can be switched between a dual-band operation and a single-band operation.

FIG. 17 shows a modification of the resonator shown in FIG. 1 that can be switched between the dual-band operation and the single-band operation. According to this embodiment, the central conductor 11 shown in FIG. 1 is cut at a desired point along the length, and a switch 15 is inserted in series at the point. The remainder of the configuration is exactly the same as that shown in FIG. 1. The switch may be any switch, such as a semiconductor switch, such as a transistor switch and a diode switch, and a micro-electro-mechanical system (MEMS) switch.

Figure 18:
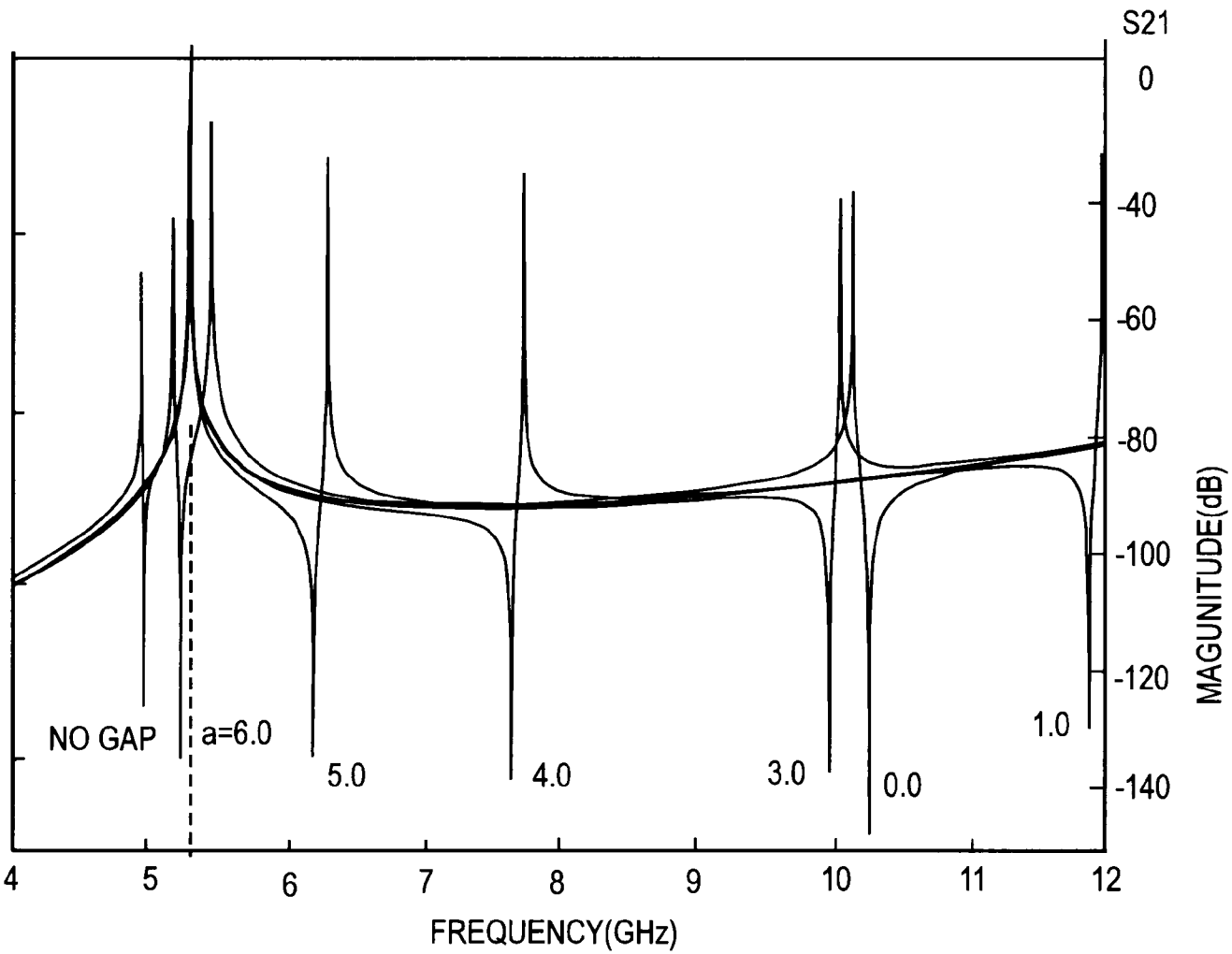
FIG. 18 is a graph showing transmission characteristics of the resonator shown in FIG. 17.

FIG. 18 shows results of simulation of variations of the transmission characteristics S21 with the position of the switch 15 in FIG. 17 in the case where the switch is in the off state (non-conductive state). The simulation is carried out on the assumption that the non-conductive state of the switch is produced by simply cutting the central conductor 11 at the position of the switch to form a gap having a length approximately equal to the line width. The position of the switch 15 is indicated by the distance "a" from the side edge of the central conductor short-circuit part 13 to the gap formed in the central conductor 11. "No gap" in FIG. 18 indicates the transmission characteristics in the case where no gap is formed (which means the case where the switch is in the conductive state, which is equivalent to the resonator shown in FIG. 1).

Regardless of the value of the distance "a", the lower one of the two resonance frequencies is close to 5.35 GHz shown by the dashed line. However, the higher resonance frequency gradually shifts to higher frequencies as the distance "a" decreases from 6 (mm) to 5 (mm), 4 (mm) and then 3 (mm). However, if the distance "a" is equal to or less than 3, the effect of the part of the central conductor 11 from the switch 15 to the open end becomes significant, and the resonance frequency shifts to lower frequencies. Similarly, in the case where no gap is formed (which is equivalent to the case where the switch is in the conductive state), there are two resonance frequencies, one of which is approximately 5.35 GHz. Thus, if the position "a" of the switch is determined so that the higher resonance frequency falls within a frequency band that is not used, the resonator can operate as a single-band bandpass resonator when the switch is in the non-conductive state (off state) and as a dual-band bandpass resonator when the switch is in the conductive state (on state).

[Eleventh Embodiment]

Figure 19:
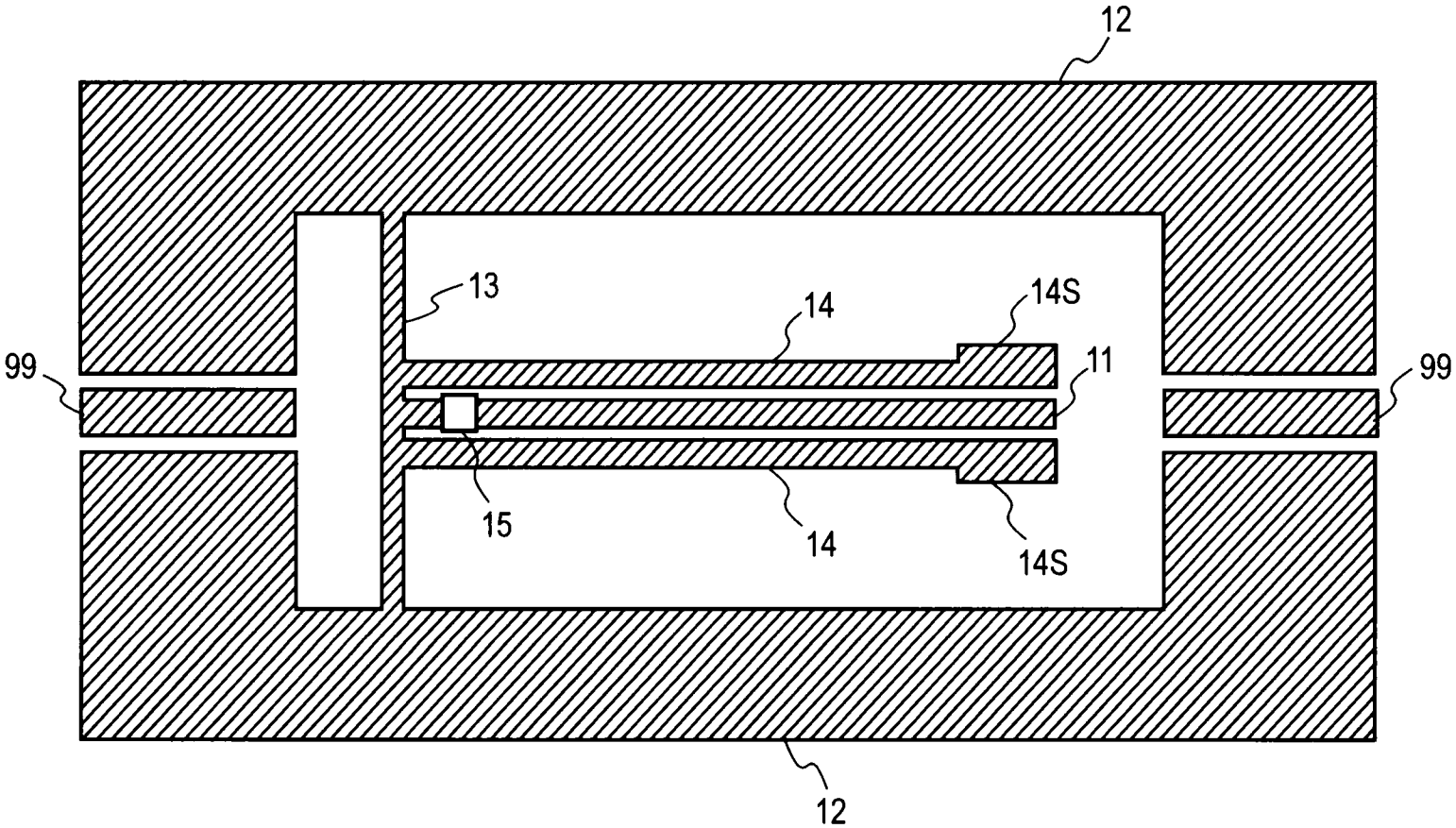
FIG. 19 is a plan view showing a configuration of a resonator according to an eleventh embodiment that can be switched between a dual-band operation and a single-band operation.

FIG. 19 shows a modification of the resonator shown in FIG. 8A that can be switched between the dual-band operation and the single-band operation, in which the switch 15 is inserted in the central conductor 11 as in the case shown in FIG. 18. The remainder of the configuration is the same as that shown in FIG. 8A, and the switching between the dual-band operation and the single-band operation by turning on and off the switch 15 is the same as in the case shown in FIG. 18.

Figure 20:
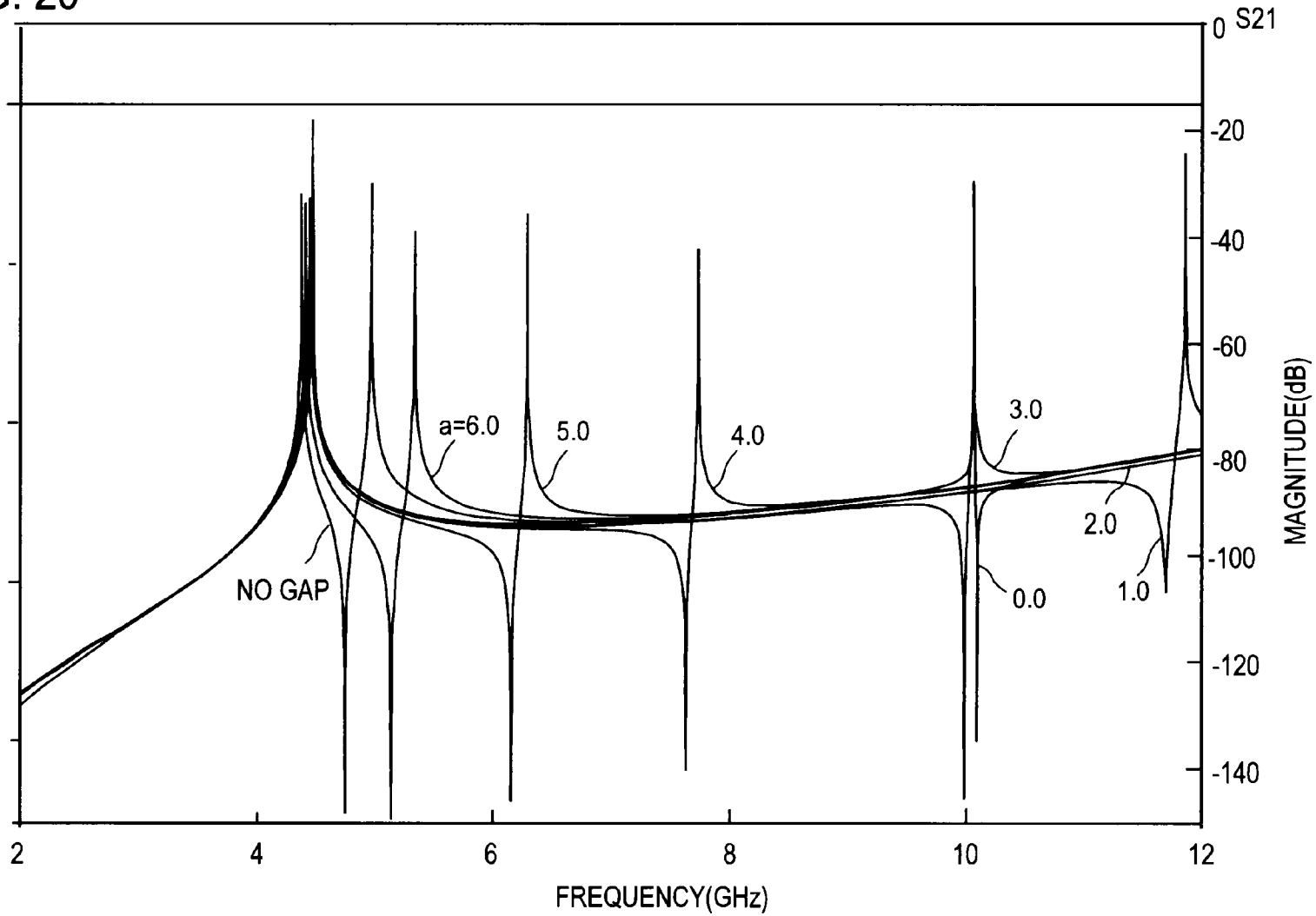
FIG. 20 is a graph showing transmission characteristics of the resonator shown in FIG. 19.

FIG. 20 shows the transmission characteristics S21 in the cases where the position "a" of the switch 15 of the resonator shown in FIG. 19 is 6, 5, 4, 3, 2, 1 and 0 mm (the definition of the position "a" is the same as in the case shown in FIG. 17). Regardless of the position "a" including the case where no gap is formed, the lower resonance frequencies lies in the vicinity of 4.2 GHz. The higher resonance frequency gradually shifts to higher frequencies as the value a decreases from 6 mm to 3 mm. Thus, as in the case shown in FIG. 18, the resonator can be designed as a bandpass resonator that can be switched between the dual-band operation and the single-band operation.

[Twelfth Embodiment]

Figure 21:
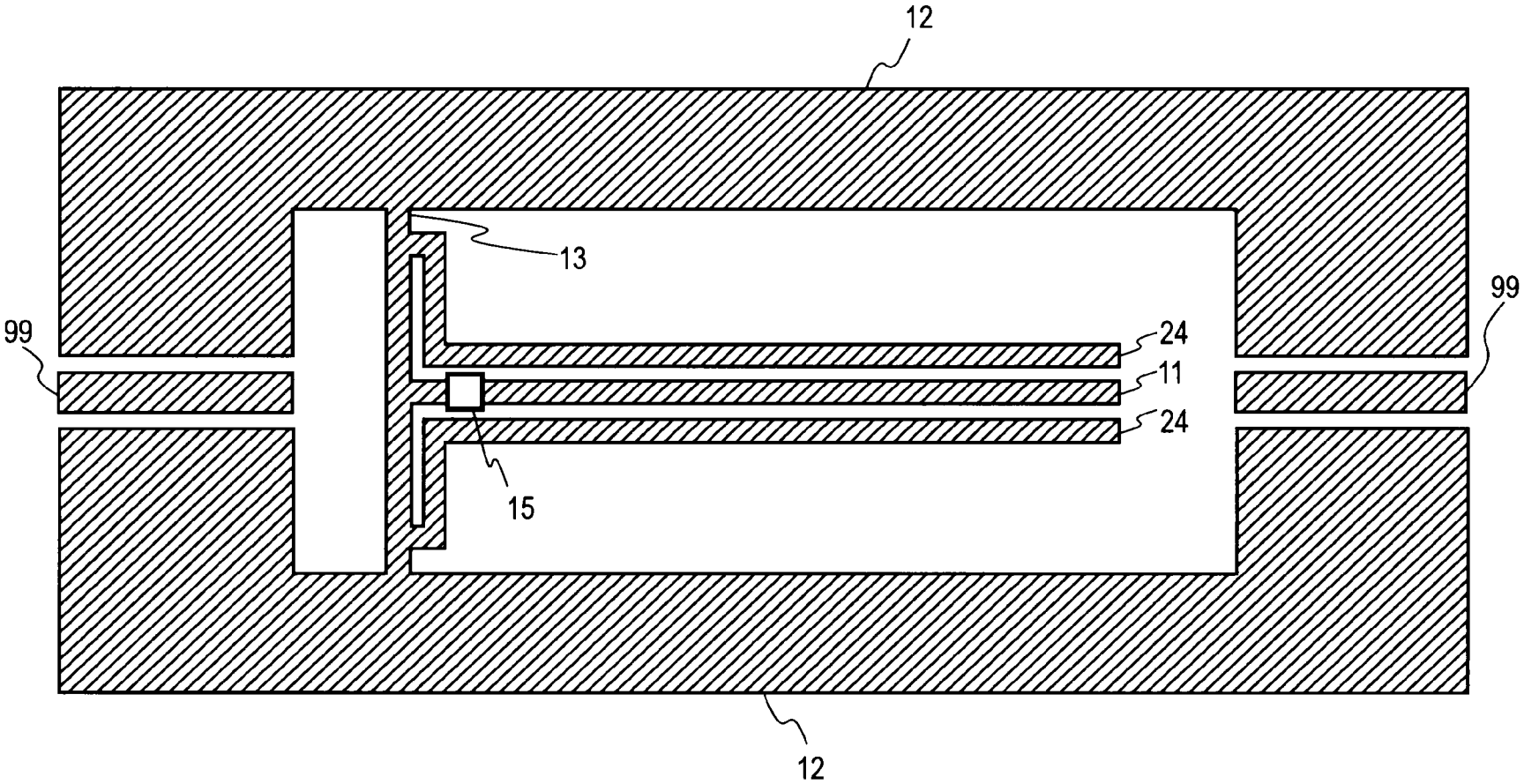
FIG. 21 is a plan view showing a configuration of a resonator according to a twelfth embodiment that can be switched between a dual-band operation and a single-band operation.

FIG. 21 shows a modification of the resonator shown in FIG. 3 that can be switched between the dual-band operation and the single-band operation, in which the switch 15 is inserted in the central conductor 11 as in the case shown in FIG. 18. The remainder of the configuration is the same as that shown in FIG. 3, and the switching between the dual-band operation and the single-band operation by turning on and off the switch 15 is the same as in the case shown in FIG. 18.

[Thirteenth Embodiment]

Figure 22:
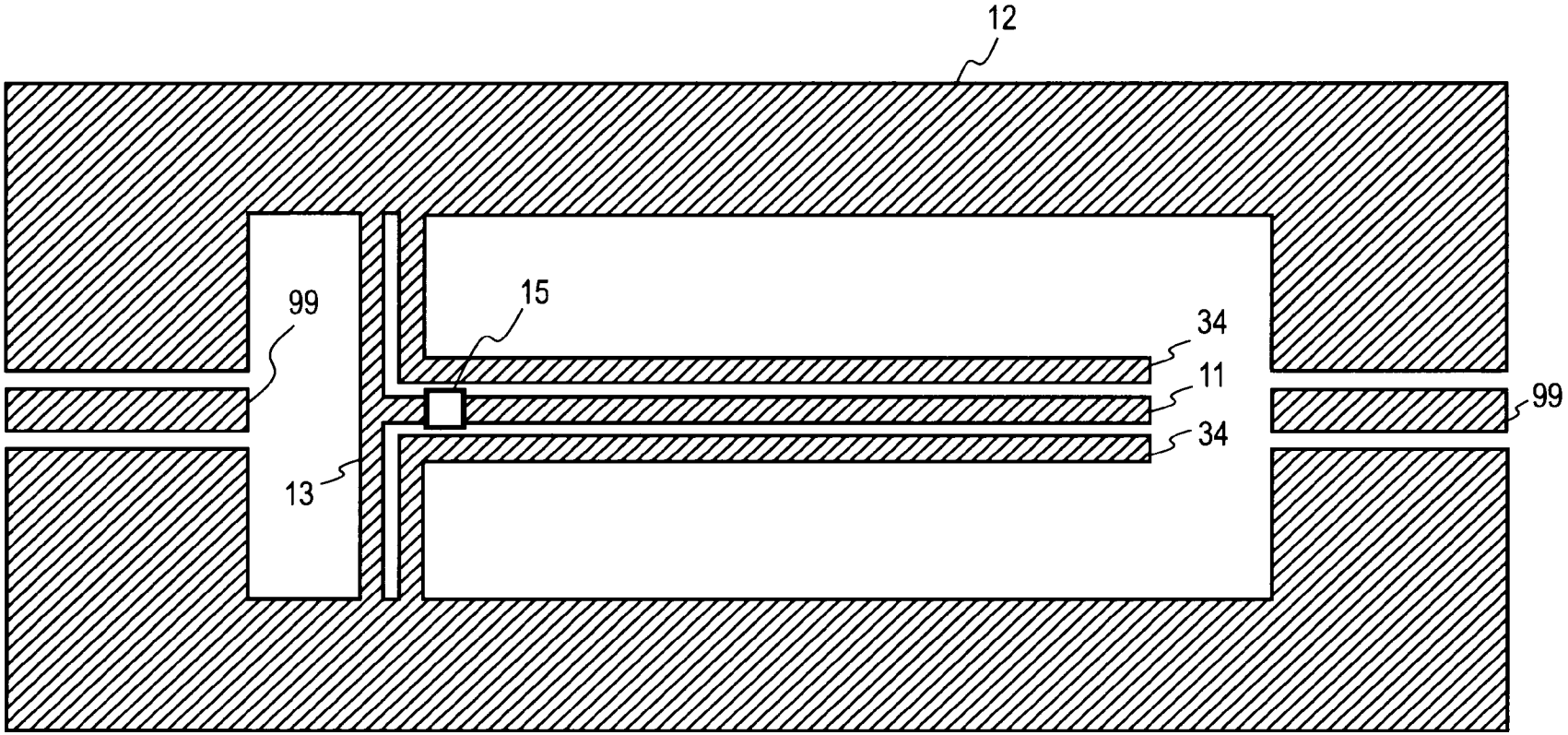
FIG. 22 is a plan view showing a configuration of a resonator according to a thirteenth embodiment that can be switched between a dual-band operation and a single-band operation.

FIG. 22 shows a modification of the resonator shown in FIG. 4 that can be switched between the dual-band operation and the single-band operation, in which the switch 15 is inserted in the central conductor 11 as in the case shown in FIG. 18. The remainder of the configuration is the same as that shown in FIG. 4, and the switching between the dual-band operation and the single-band operation by turning on and off the switch 15 is the same as in the case shown in FIG. 18.

[Fourteenth Embodiment]

Figure 23:
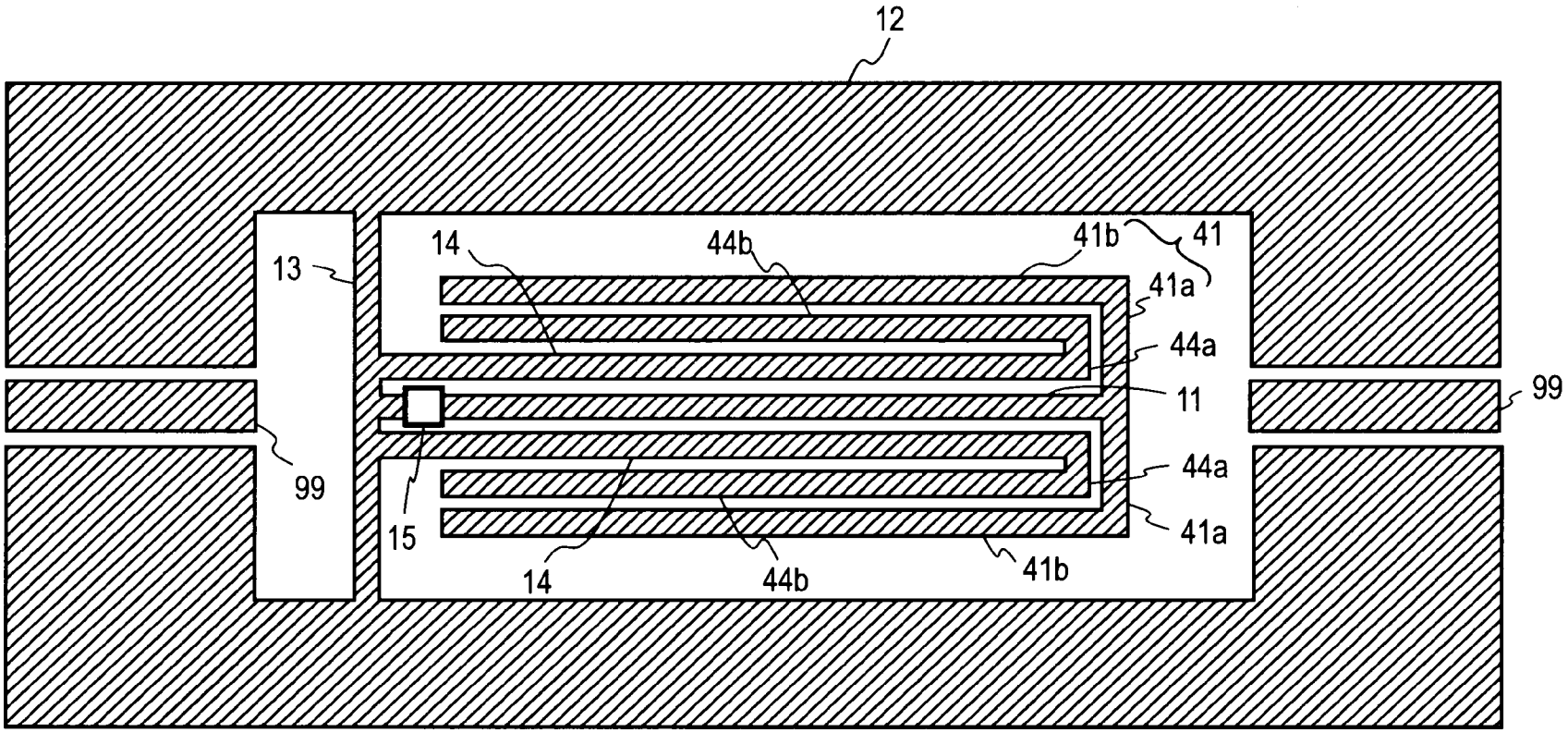
FIG. 23 is a plan view showing a configuration of a resonator according to a fourteenth embodiment that can be switched between a dual-band operation and a single-band operation.

FIG. 23 shows a modification of the resonator shown in FIG. 5 that can be switched between the dual-band operation and the single-band operation, in which the switch 15 is inserted in the central conductor 11 as in the case shown in FIG. 18. The remainder of the configuration is the same as that shown in FIG. 5, and the switching between the dual-band operation and the single-band operation by turning on and off the switch 15 is the same as in the case shown in FIG. 18.

[Fifteenth Embodiment]

Figure 24:
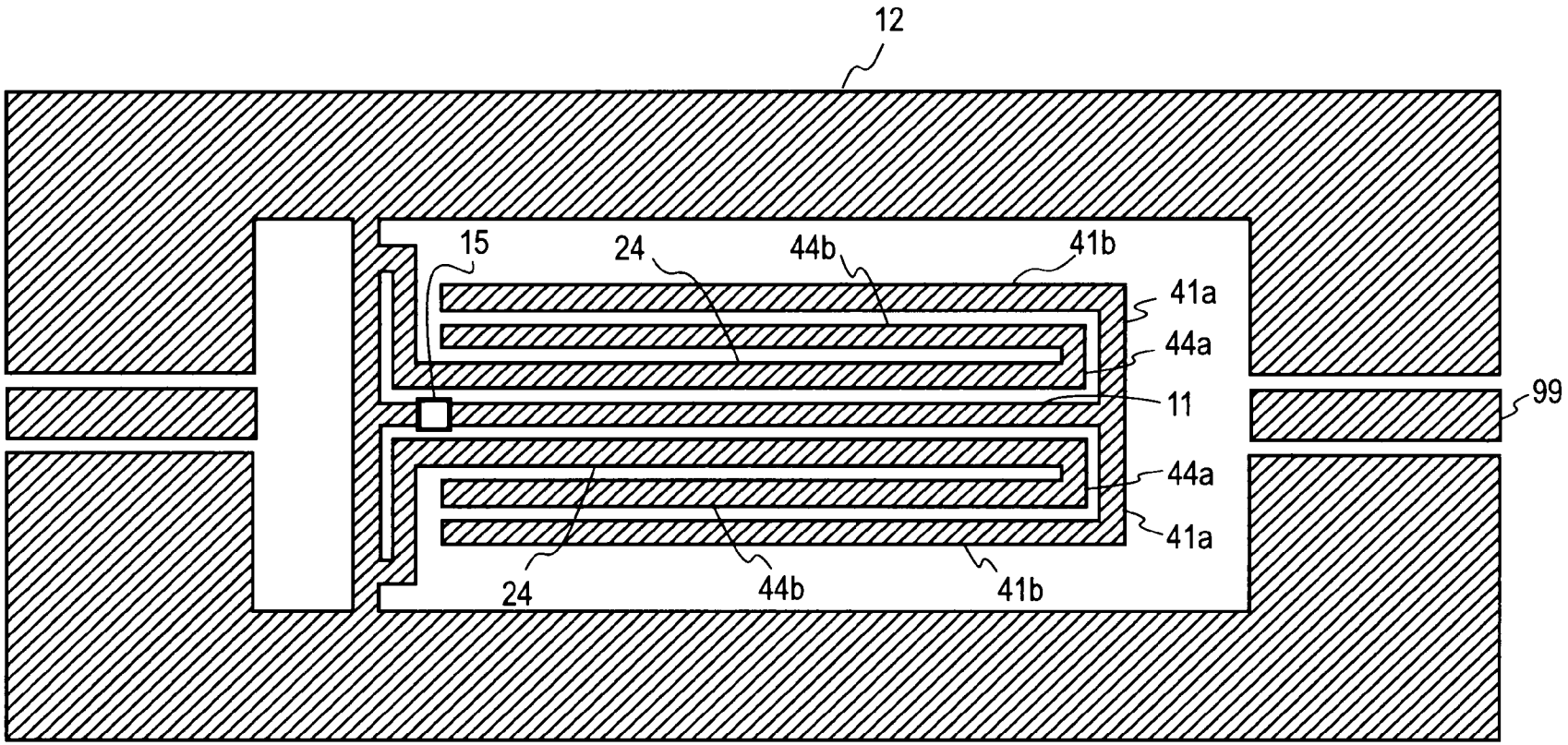
FIG. 24 is a plan view showing a configuration of a resonator according to a fifteenth embodiment that can be switched between a dual-band operation and a single-band operation.

FIG. 24 shows a modification of the resonator shown in FIG. 6 that can be switched between the dual-band operation and the single-band operation, in which the switch 15 is inserted in the central conductor 11 as in the case shown in FIG. 18. The remainder of the configuration is the same as that shown in FIG. 6, and the switching between the dual-band operation and the single-band operation by turning on and off the switch 15 is the same as in the case shown in FIG. 18.

[Sixteenth Embodiment]

Figure 25:
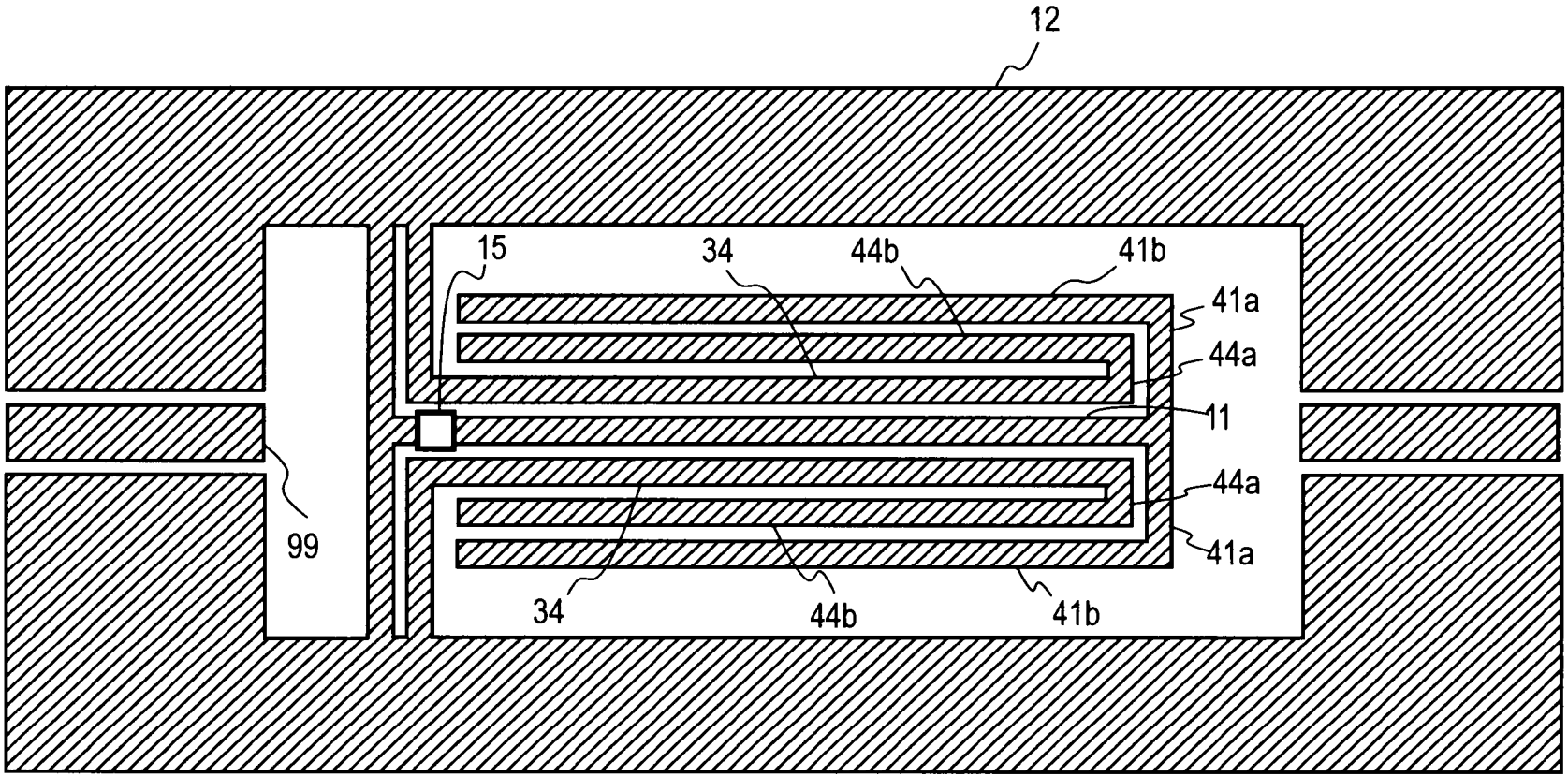
FIG. 25 is a plan view showing a configuration of a resonator according to a sixteenth embodiment that can be switched between a dual-band operation and a single-band operation.

FIG. 25 shows a modification of the resonator shown in FIG. 7 that can be switched between the dual-band operation and the single-band operation, in which the switch 15 is inserted in the central conductor 11 as in the case shown in FIG. 18. The remainder of the configuration is the same as that shown in FIG. 7, and the switching between the dual-band operation and the single-band operation by turning on and off the switch 15 is the same as in the case shown in FIG. 18.

[Seventeenth Embodiment]

Figure 26:
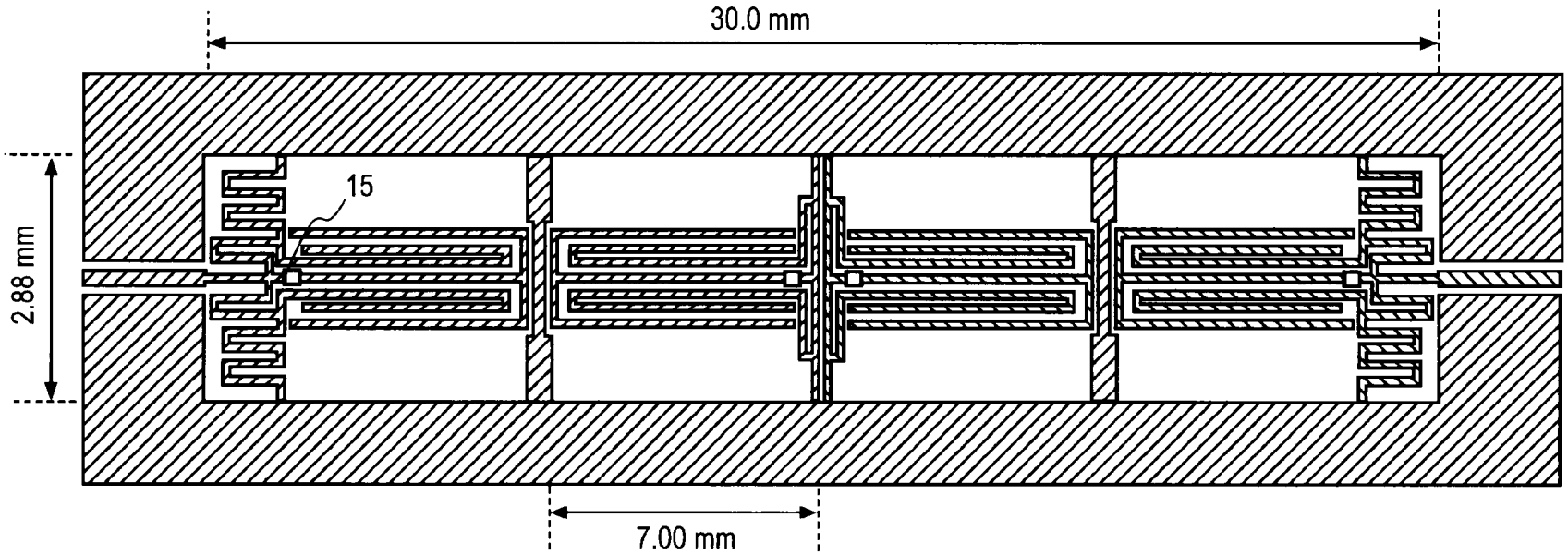
FIG. 26 is a plan view showing a configuration of a bandpass filter composed of a plurality of resonators shown in FIG. 24 cascaded to each other.
Figure 27:
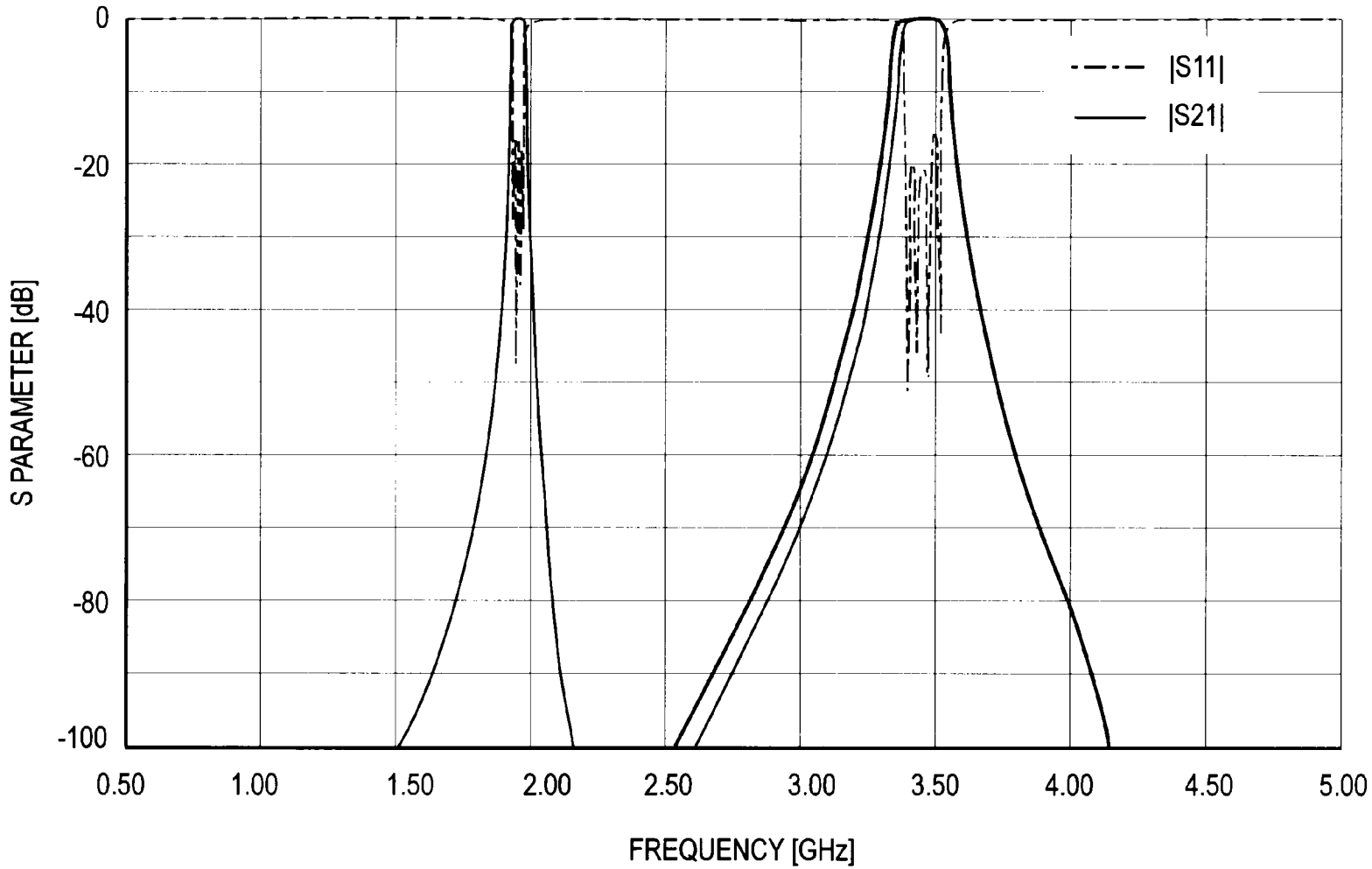
FIG. 27 shows results of simulation of frequency characteristics of the bandpass filter shown in FIG. 26.

FIG. 26 shows a bandpass filter composed of four resonators according to the embodiment shown in FIG. 24 cascaded to each other in the same manner as in the embodiment shown in FIG. 15. FIG. 27 shows results of simulation of the reflection characteristics (S11; alternate long and short dash line) and the transmission characteristics (S21; solid line) of the filter. When all the four switches 15 inserted in the central conductors of the resonators are in the on state, the dual-band transmission characteristics similar to that shown in FIG. 16A is achieved as shown by the thin solid line. However, when all the switches 15 are in the off state, the pass band at the lower frequency disappears, and the filter operates as a single-band bandpass filter having only the pass band at the higher frequency as shown by the thick solid line. In the cases of the resonators shown in FIGS. 17, 19, 21, 22, 23 and 25, similarly, a plurality of resonators can be cascaded to each other to form a bandpass filter that can be switched between the dual-band operation and the single-band operation.

[Eighteenth Embodiment]

Figure 28:
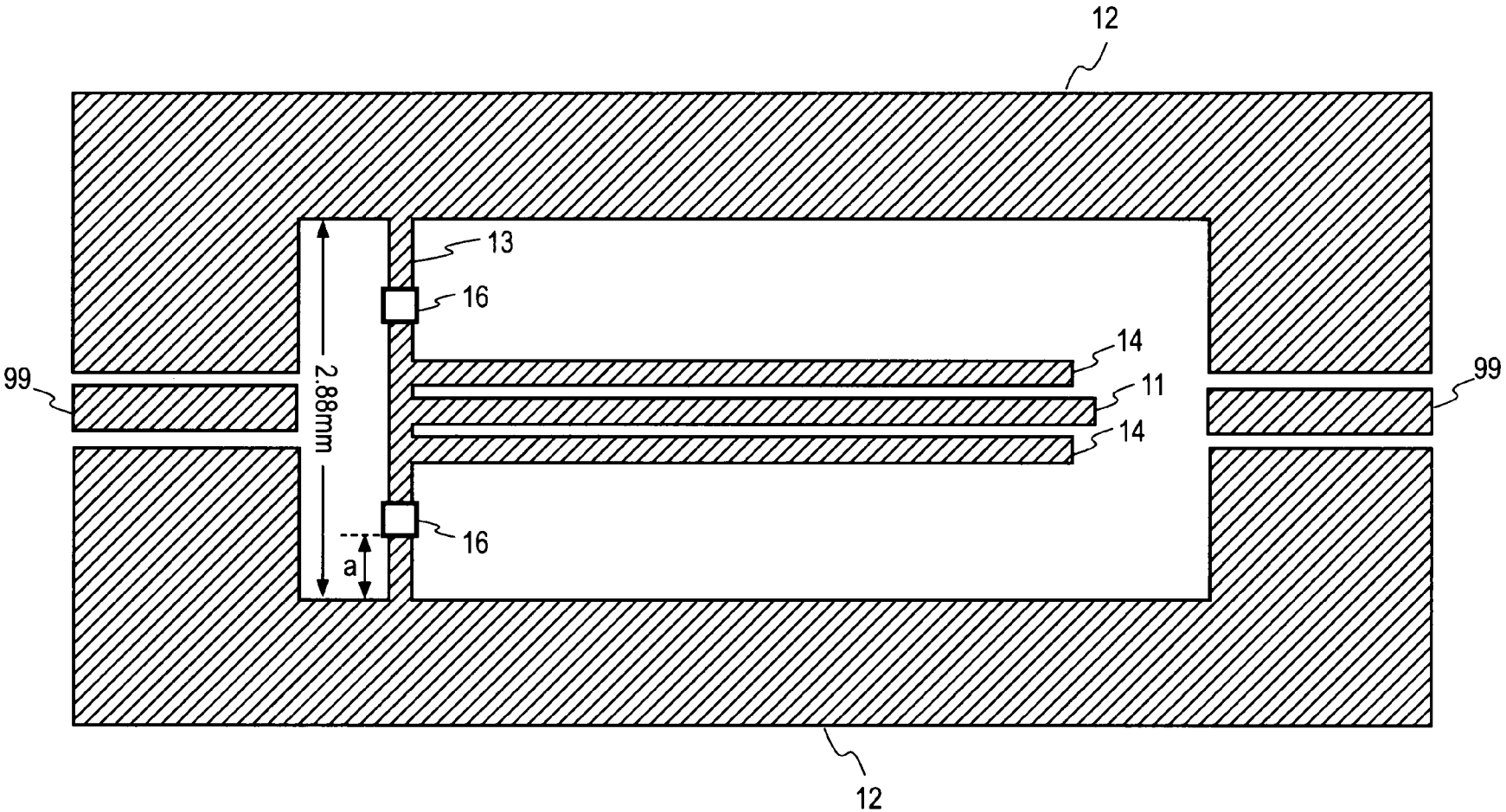
FIG. 28 is a plan view showing a configuration of a resonator according to a seventeenth embodiment that can be switched between a dual-band operation and a single-band operation.

FIGS. 17, 19, 21, 22, 23, 25 and 26 show examples of the resonator having the switch 15 inserted in the central conductor 11. However, a resonator that can be switched between the dual-band operation and the single-band operation can also be provided by inserting a switch in the central conductor short-circuit part 13. FIG. 28 shows such an embodiment. The resonator shown in FIG. 28 is a modification of the resonator shown in FIG. 1 in which switches 16 are inserted in the central conductor short-circuit part 13 at symmetrical positions with respect to the central conductor 11 between the stub conductors 14 and the grounding conductors 12, so that the central conductor short-circuit part 13 to which the central conductor 11 and the stubs 14 are connected can be separated from the two grounding conductors 12. The remainder of the configuration is the same as that shown in FIG. 1.

Figure 29:
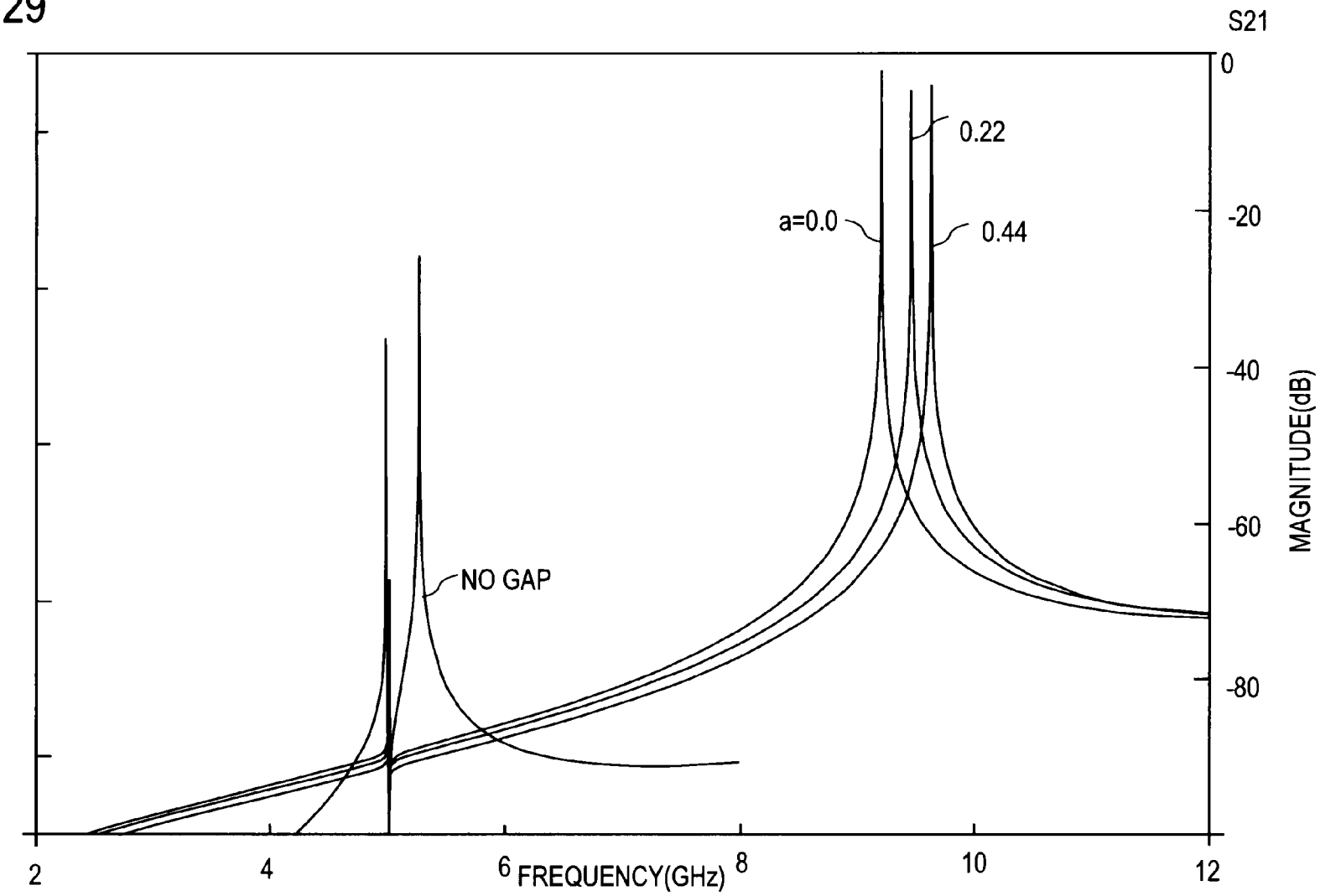
FIG. 29 shows results of simulation of frequency characteristics of the resonator shown in FIG. 28.

FIG. 29 shows the transmission characteristics S21 in the cases where the position "a" of the switches 16 in the resonator shown in FIG. 28 is 0.44 mm, 0.22 mm and 0.0 mm. When the two switches 16 are in the on state, which means that no gap is formed in the central conductor short-circuit part 13, the resonator operates as a dual-band bandpass resonator as with the resonator shown in FIG. 1 and has resonance frequencies at 5.0 GHz and 5.25 GHz. When the two switches 16 are in the off state, the resonator operates as a single-band resonator that operates only in the lower resonance frequency if the higher resonance frequency of the two resonance frequencies is set to fall within a frequency band that is not used. The lower resonance frequency in this case can be designed to be equal to the lower resonance frequency of 5.0 GHz when the switches 16 are in the on state (no gap is formed) as shown in FIG. 29.

[Nineteenth Embodiment]

Figure 30:
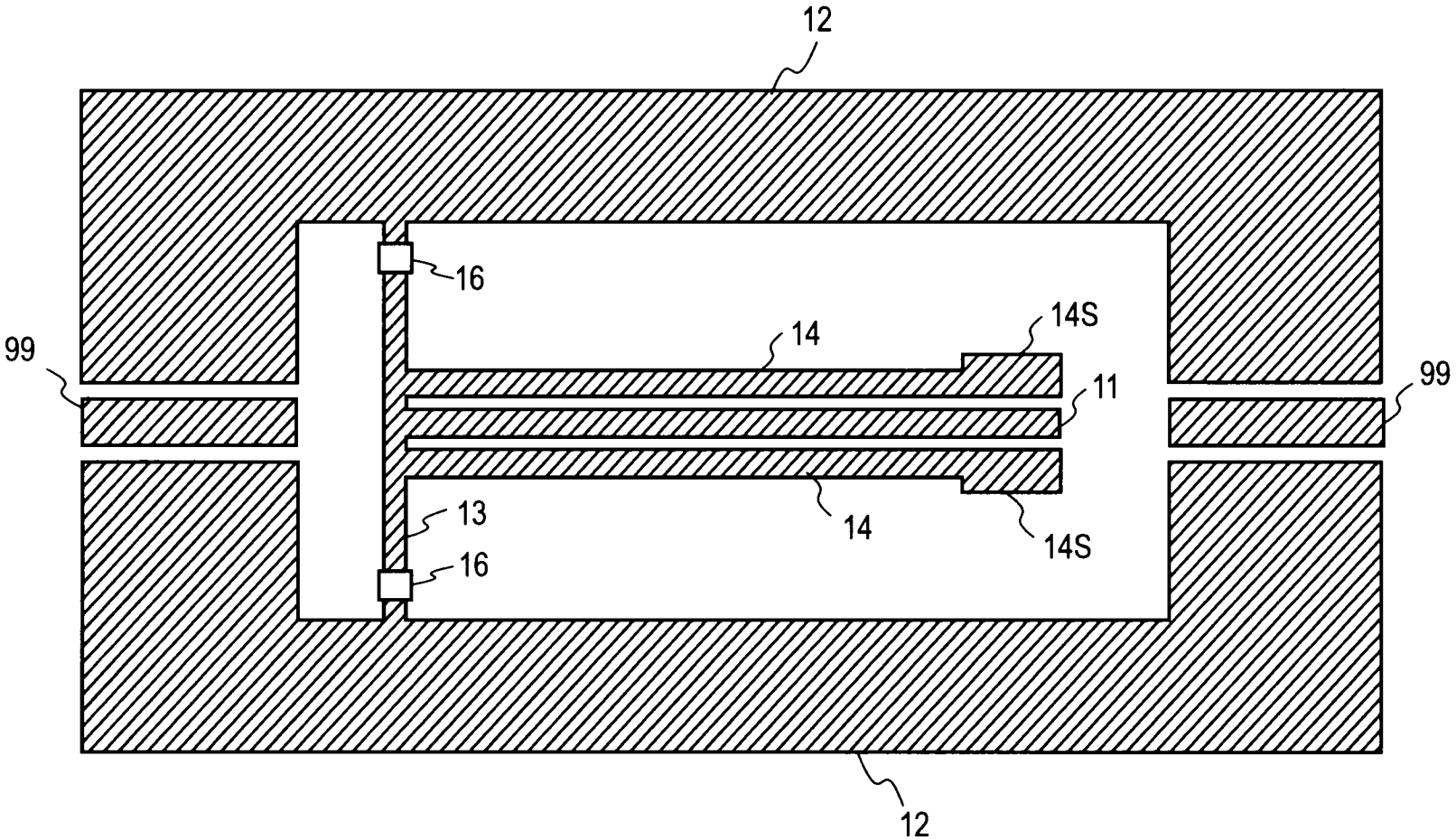
FIG. 30 is a plan view showing a configuration of a resonator according to a nineteenth embodiment that can be switched between a dual-band operation and a single-band operation.

FIG. 30 shows a modification of the resonator shown in FIG. 8A that can be switched between the dual-band operation and the single-band operation, in which the two switches 16 are inserted in the central conductor short-circuit part 13 as in the case shown in FIG. 28. The remainder of the configuration is the same as that shown in FIG. 8A, and the switching between the dual-band operation and the single-band operation by turning on and off the switches 16 is the same as in the case shown in FIG. 28.

[Twentieth Embodiment]

Figure 31:
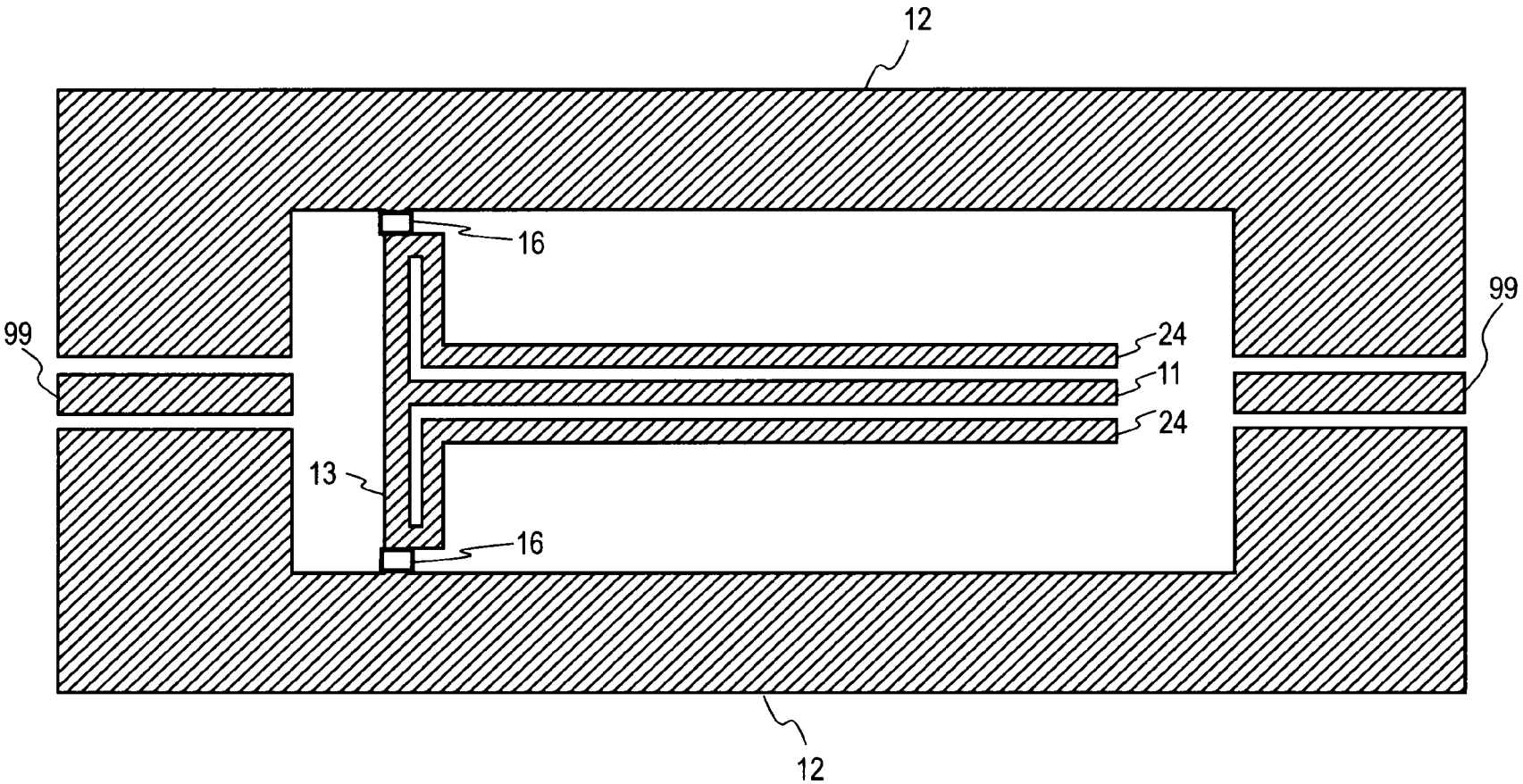
FIG. 31 is a plan view showing a configuration of a resonator according to a twentieth embodiment that can be switched between a dual-band operation and a single-band operation.

FIG. 31 shows a modification of the resonator shown in FIG. 3 that can be switched between the dual-band operation and the single-band operation, in which the switches 16 are inserted in the central conductor short-circuit part 13 at positions close to the opposite ends thereof as in the case shown in FIG. 28. The remainder of the configuration is the same as that shown in FIG. 3, and the switching between the dual-band operation and the single-band operation by turning on and off the switches 16 is the same as in the case shown in FIG. 28.

[Twenty-First Embodiment]

Figure 32:
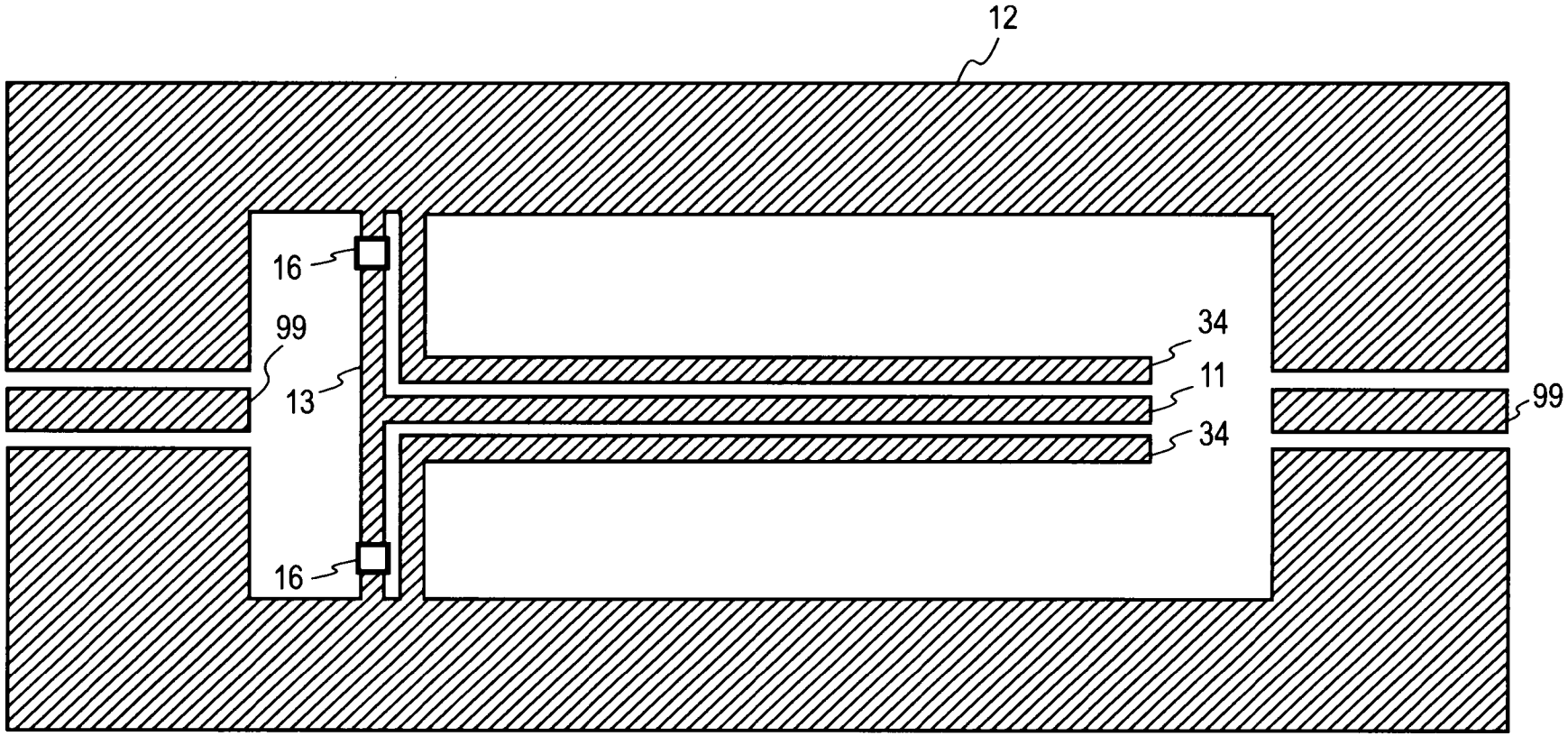
FIG. 32 is a plan view showing a configuration of a resonator according to a twenty-first embodiment that can be switched between a dual-band operation and a single-band operation.

FIG. 32 shows a modification of the resonator shown in FIG. 4 that can be switched between the dual-band operation and the single-band operation, in which the two switches 16 are inserted in the central conductor short-circuit part 13 as in the case shown in FIG. 28. The remainder of the configuration is the same as that shown in FIG. 4, and the switching between the dual-band operation and the single-band operation by turning on and off the switches 16 is the same as in the case shown in FIG. 28.

[Twenty-Second Embodiment]

Figure 33:
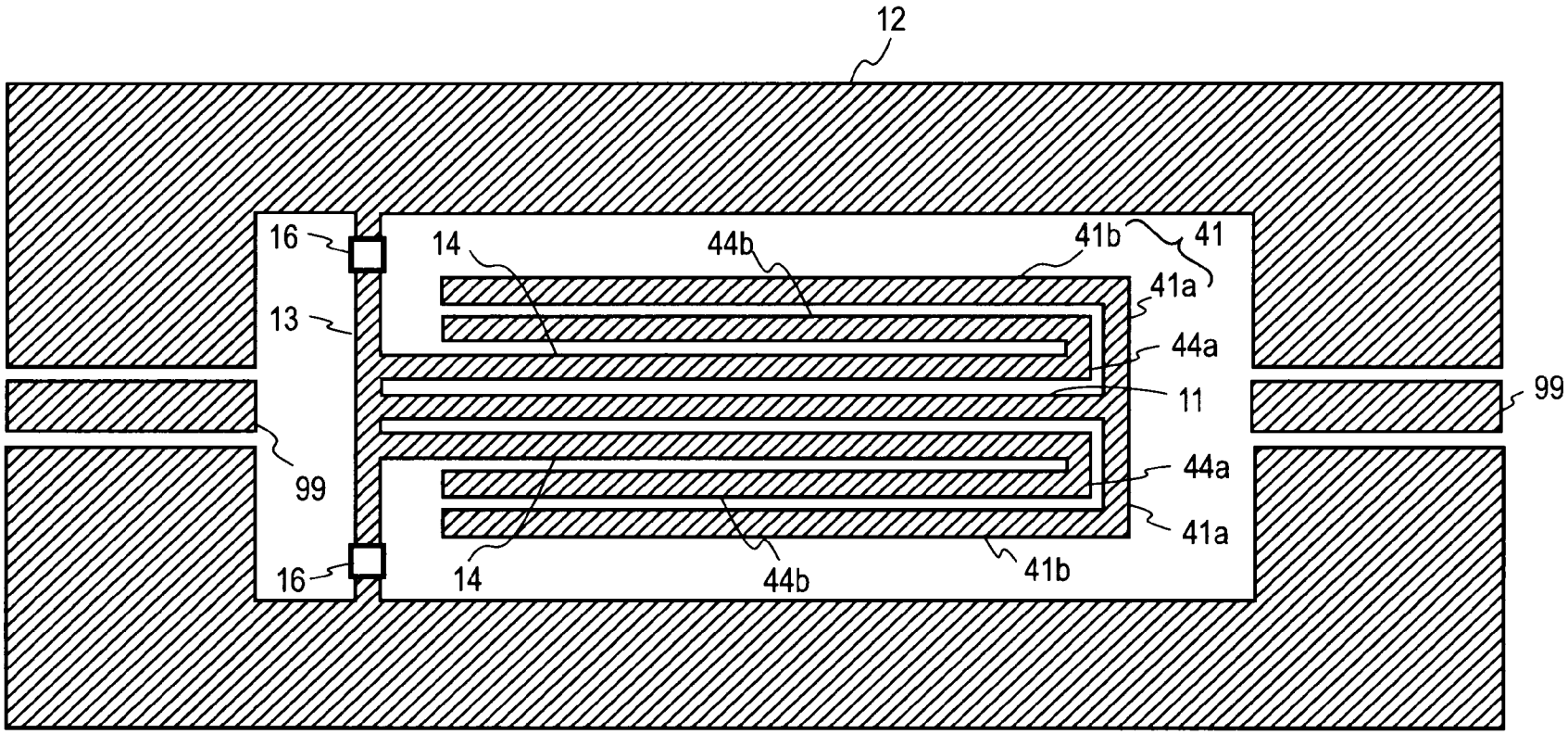
FIG. 33 is a plan view showing a configuration of a resonator according to a twenty-second embodiment that can be switched between a dual-band operation and a single-band operation.

FIG. 33 shows a modification of the resonator shown in FIG. 5 that can be switched between the dual-band operation and the single-band operation, in which the two switches 16 are inserted in the central conductor short-circuit part 13 as in the case shown in FIG. 28. The remainder of the configuration is the same as that shown in FIG. 5, and the switching between the dual-band operation and the single-band operation by turning on and off the switches 16 is the same as in the case shown in FIG. 28.

[Twenty-Third Embodiment]

Figure 34:
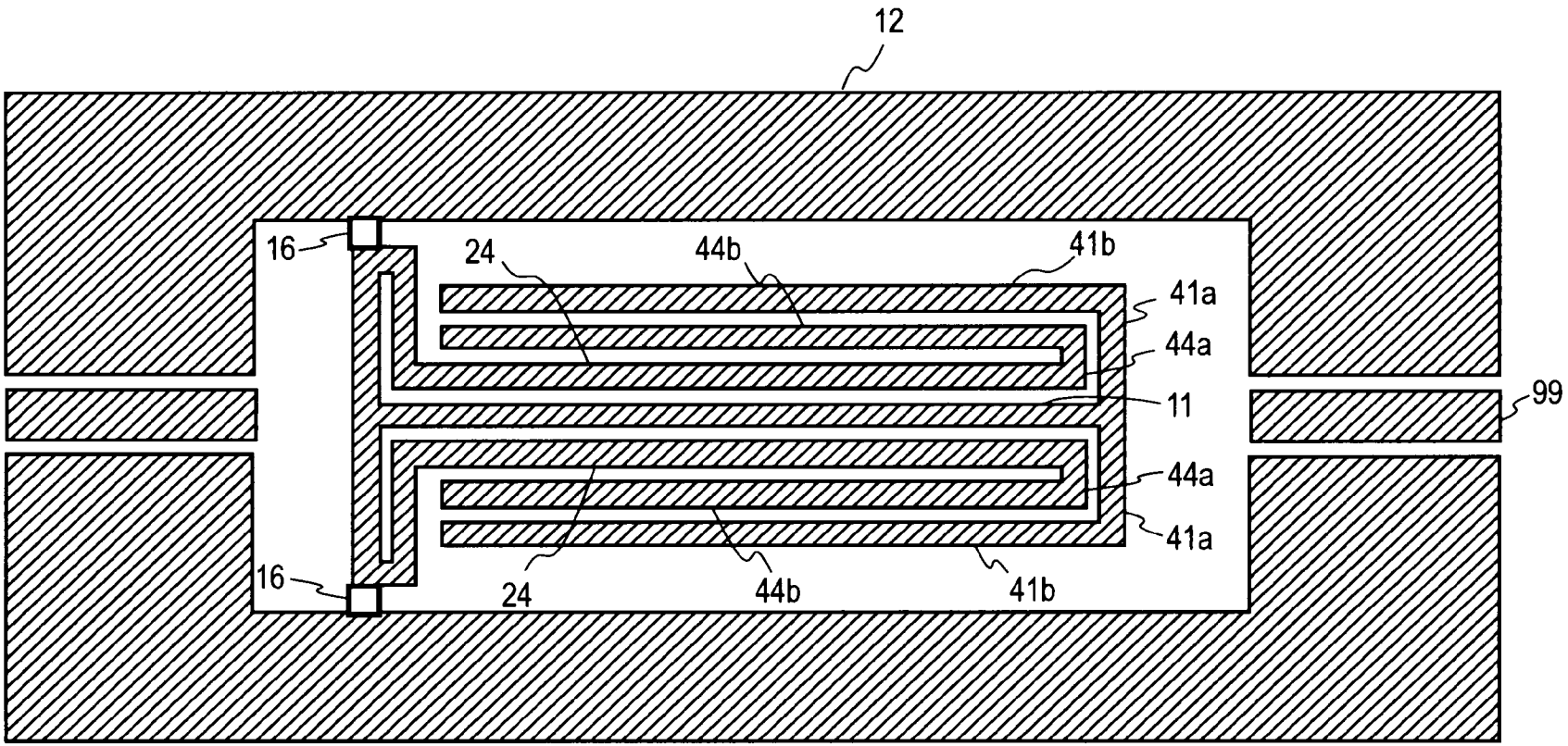
FIG. 34 is a plan view showing a configuration of a resonator according to a twenty-third embodiment that can be switched between a dual-band operation and a single-band operation.

FIG. 34 shows a modification of the resonator shown in FIG. 6 that can be switched between the dual-band operation and the single-band operation, in which the two switches 16 are inserted in the central conductor short-circuit part 13 as in the case shown in FIG. 28. The remainder of the configuration is the same as that shown in FIG. 6, and the switching between the dual-band operation and the single-band operation by turning on and off the switches 16 is the same as in the case shown in FIG. 28.

[Twenty-Fourth Embodiment]

Figure 35:
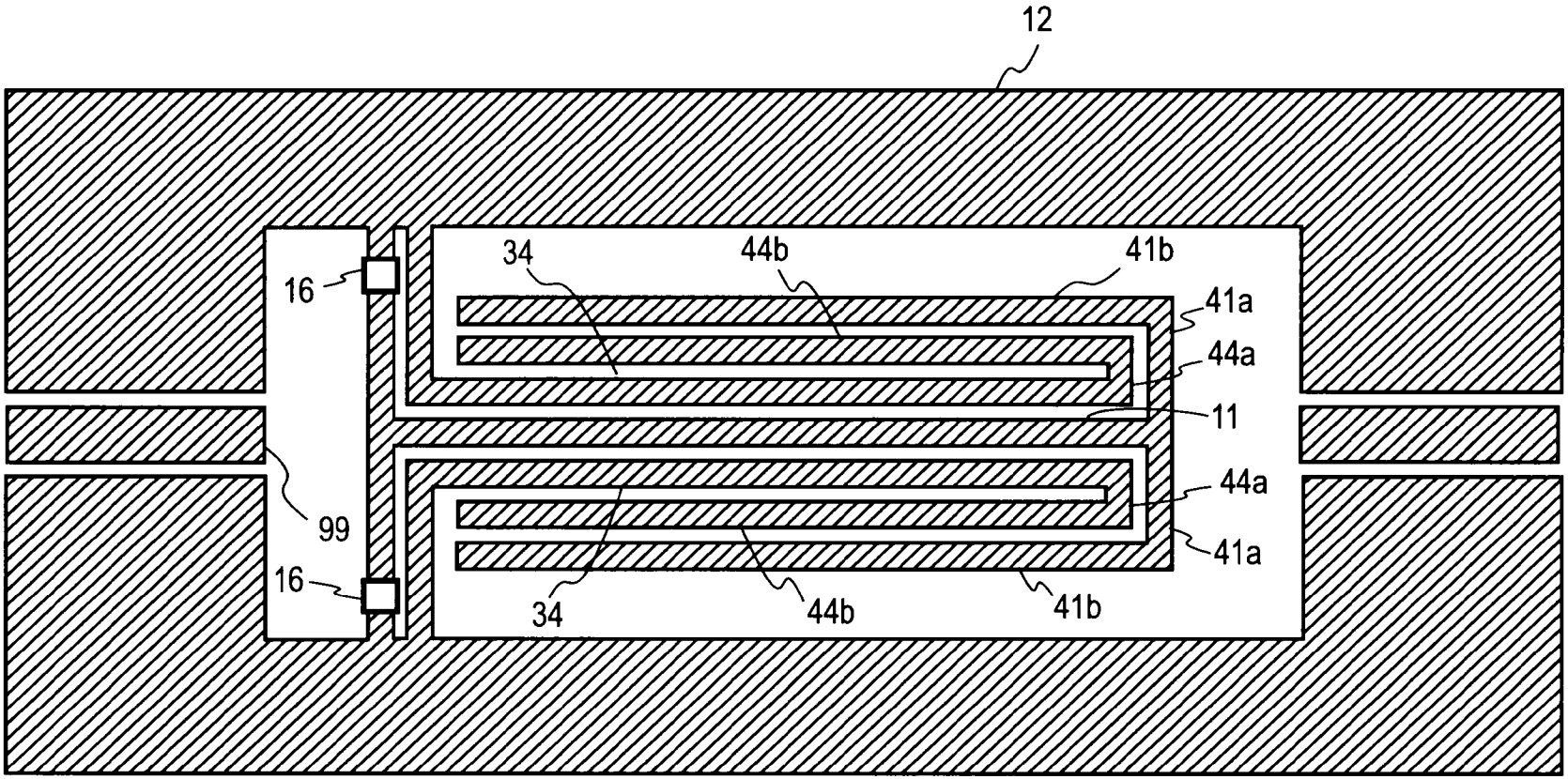
FIG. 35 is a plan view showing a configuration of a resonator according to a twenty-fourth embodiment that can be switched between a dual-band operation and a single-band operation.

FIG. 35 shows a modification of the resonator shown in FIG. 7 that can be switched between the dual-band operation and the single-band operation, in which the two switches 16 are inserted in the central conductor short-circuit part 13 as in the case shown in FIG. 28. The remainder of the configuration is the same as that shown in FIG. 7, and the switching between the dual-band operation and the single-band operation by turning on and off the switches 16 is the same as in the case shown in FIG. 28.

A plurality of such resonators having switches 16 inserted in the central conductor short-circuit part 13 shown in FIGS. 28 and 30 to 35 can also be cascaded to each other as shown in FIGS. 9, 11, 12, 13 and 15 to form a bandpass filter that can be switched between the dual-band operation and the single-band operation.

[Twenty-Fifth Embodiment]

The above description concerns bandpass resonators that can be switched between the dual-band operation and the single-band operation by switches inserted in the central conductor short-circuit part 13. However, as described below, a bandpass resonator can also be made switchable between the dual-band operation and the single-band operation by inserting switches in the stub conductors.

Figure 36:
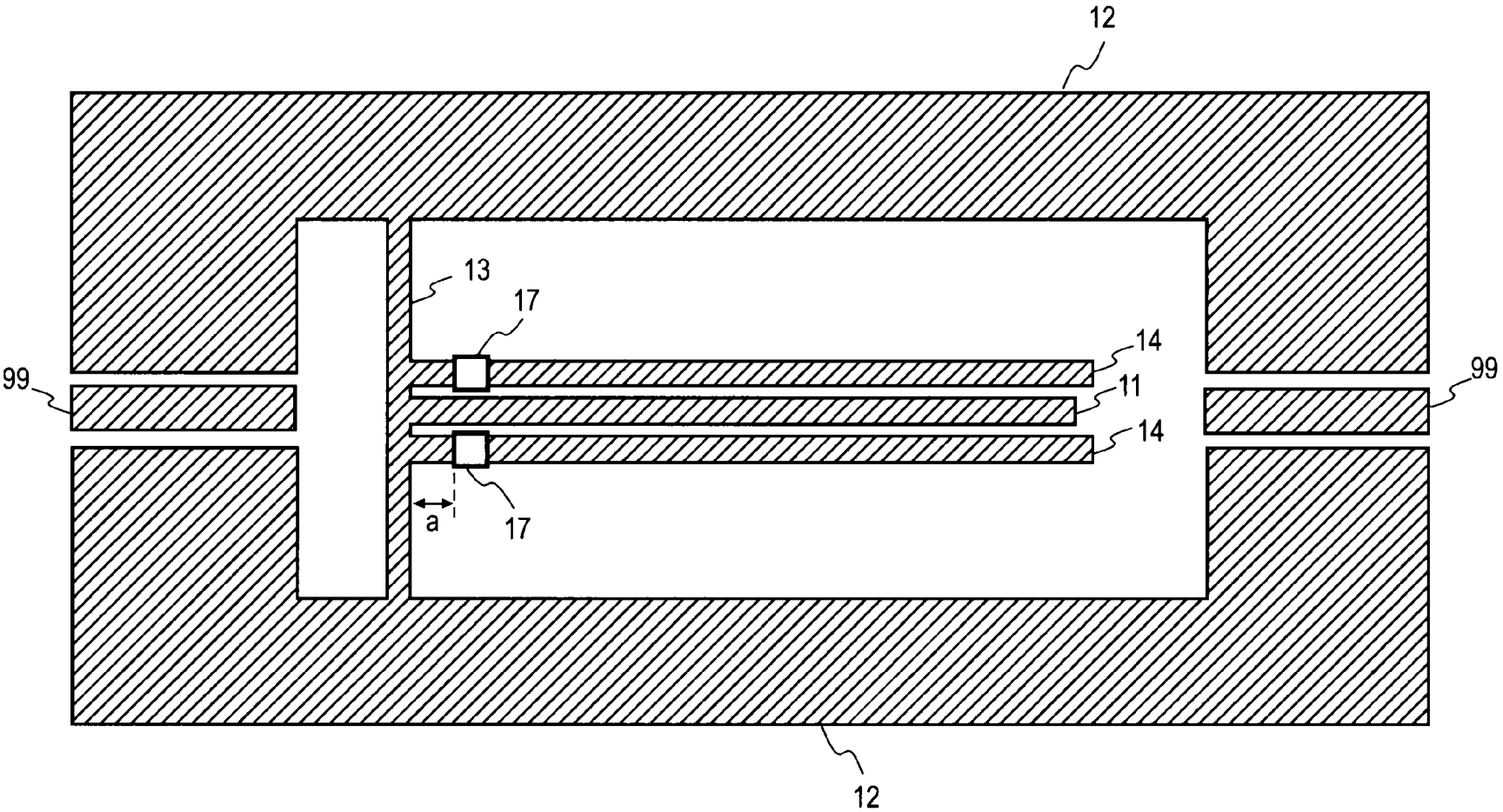
FIG. 36 is a plan view showing a configuration of a resonator according to a twenty-fifth embodiment that can be switched between a dual-band operation and a single-band operation.
Figure 37:
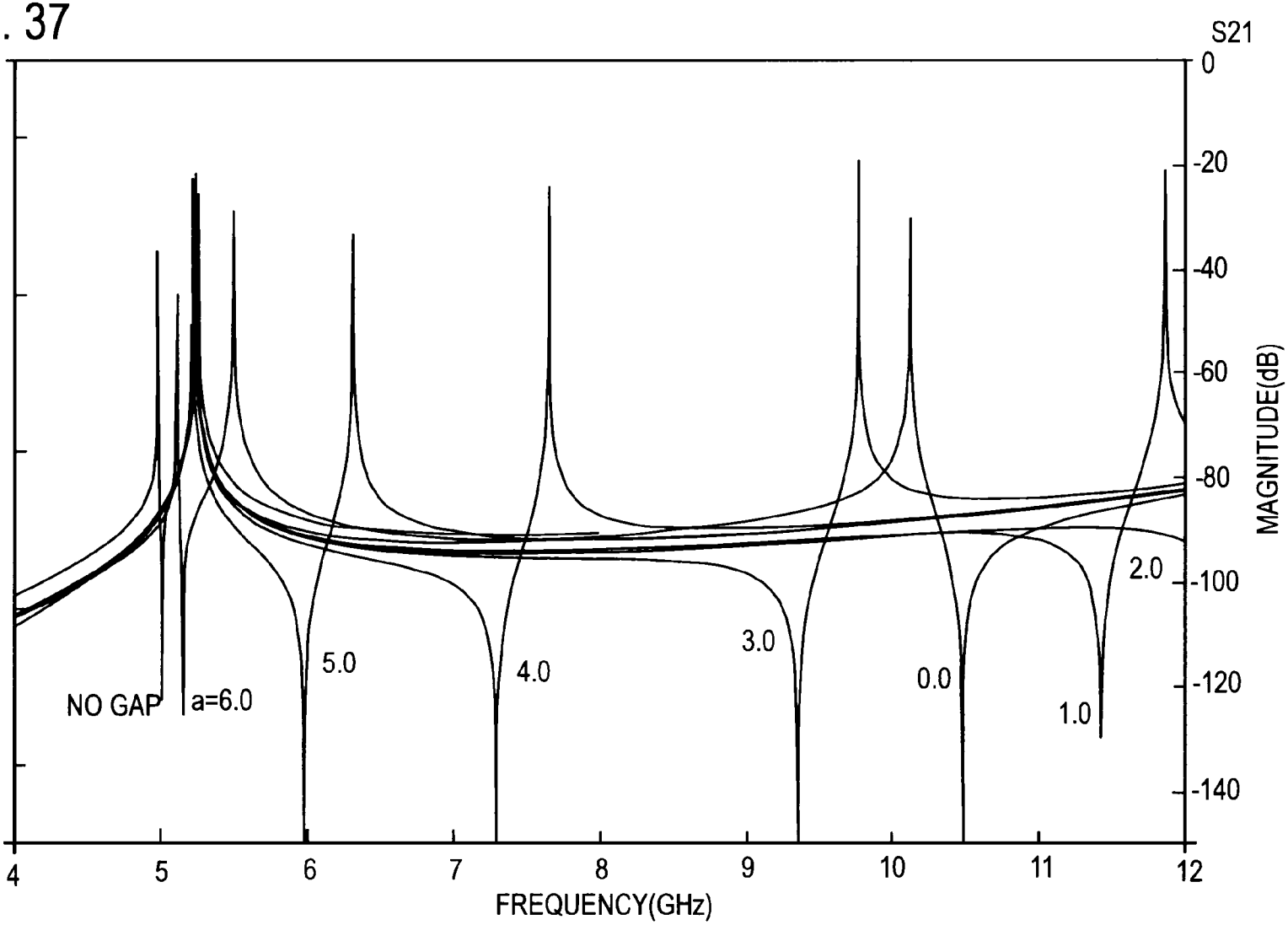
FIG. 37 is a graph showing variations of the transmission characteristics of the resonator shown in FIG. 36 with the position of switches.

FIG. 36 shows a modification of the embodiment shown in FIG. 1 in which a switch 17 is inserted in each of the two stub conductors 14 in such a manner that the two switches 17 are symmetrical with respect to the central conductor 11. FIG. 36 shows an example in which the central conductor 11 is shorter than the stub conductors 14. FIG. 37 shows results of simulation of the transmission characteristics S21 of the resonator shown in FIG. 36 in the case where the position "a" of the switches 17 is changed from 6 mm to 0 mm. The definition of the position "a" is the same as the definition in the embodiment shown in FIG. 17. When no gap is formed (that is, the switches 17 are in the conductive state), the resonator has resonance frequencies at 5 GHz and 5.25 GHz as with the characteristics of the resonator shown in FIG. 17 shown in FIG. 18. When the two switches 17 are in the non-conductive state, the higher resonance frequency shifts to higher frequencies as the value a decreases from 6 to 3 mm as in the example shown in FIG. 18. Therefore, also according to the twenty-fifth embodiment, a bandpass resonator that can be switched between the dual-band operation and the single-band operation can be designed.

[Twenty-Sixth Embodiment]

Figure 38:
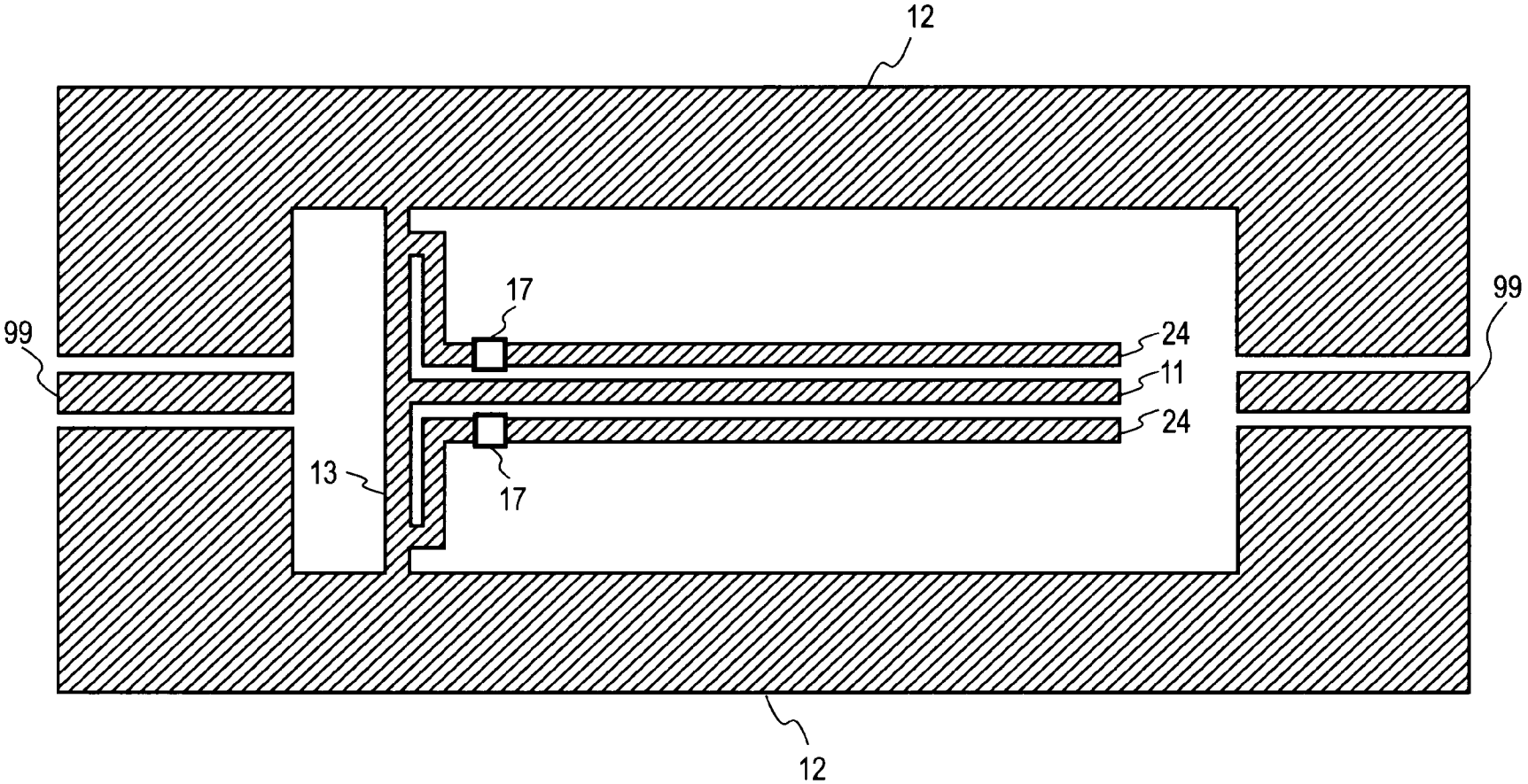
FIG. 38 is a plan view showing a configuration of a resonator according to a twenty-sixth embodiment that can be switched between a dual-band operation and a single-band operation.

FIG. 38 shows a dual-band bandpass resonator according to a twenty-sixth embodiment. This resonator is a modification of the resonator shown in FIG. 3 that can be switched between the dual-band operation and the single-band operation by switches 17 inserted in parts of the two stub conductors 24 that extend parallel with the central conductor 11 as in the case shown in FIG. 36. The remainder of the configuration is the same as that shown in FIG. 3, and the switching between the dual-band operation and the single-band operation by turning on and off the switches 17 is the same as in the case shown in FIG. 36.

[Twenty-Seventh Embodiment]

Figure 39:
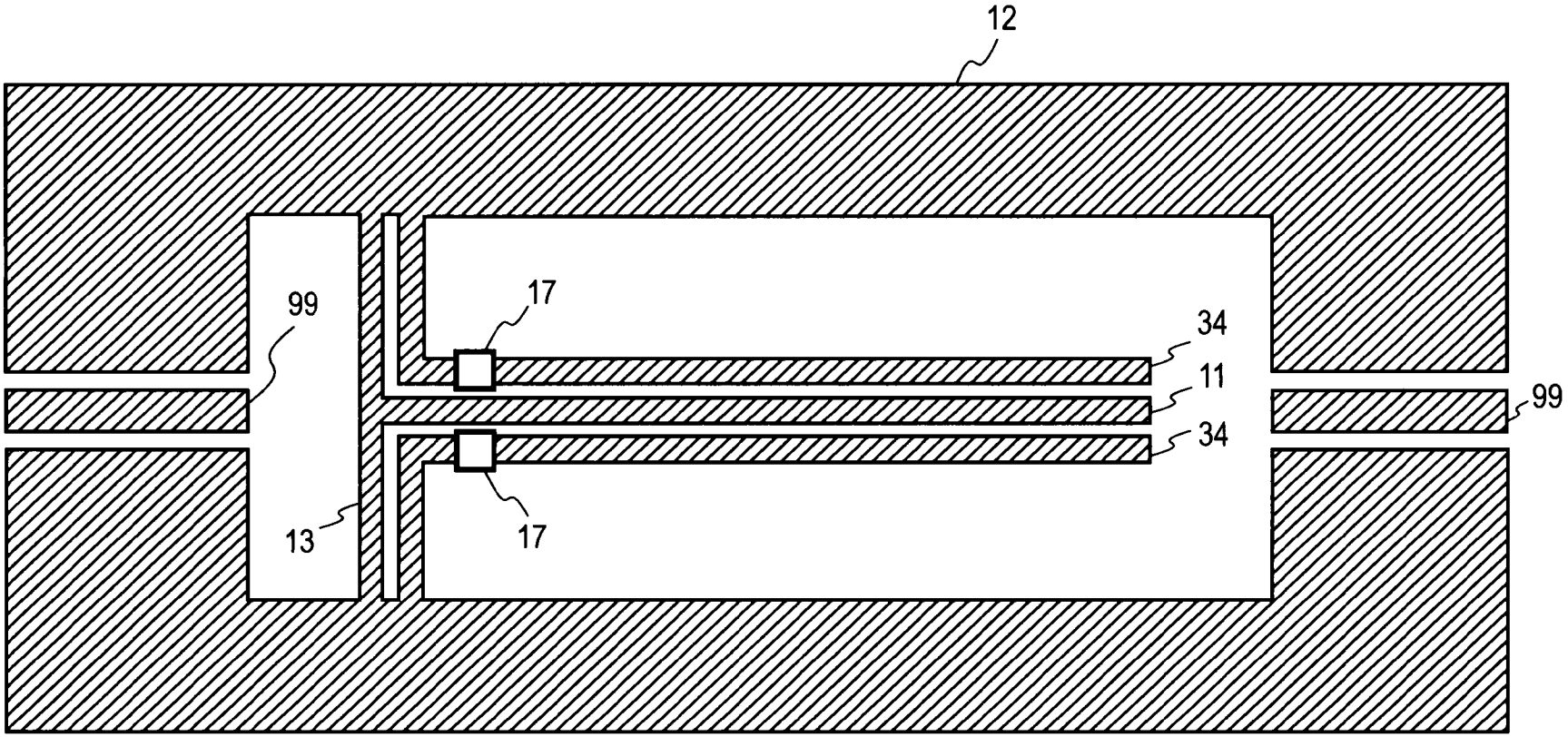
FIG. 39 is a plan view showing a configuration of a resonator according to a twenty-seventh embodiment that can be switched between a dual-band operation and a single-band operation.

FIG. 39 shows a dual-band bandpass resonator according to a twenty-seventh embodiment. This resonator is a modification of the resonator shown in FIG. 4 that can be switched between the dual-band operation and the single-band operation by switches 17 inserted in parts of the two stub conductors 34 that extend parallel with the central conductor 11 as in the case shown in FIG. 36. The remainder of the configuration is the same as that shown in FIG. 4, and the switching between the dual-band operation and the single-band operation by turning on and off the switches 17 is the same as in the case shown in FIG. 36.

[Twenty-Eighth Embodiment]

Figure 40:
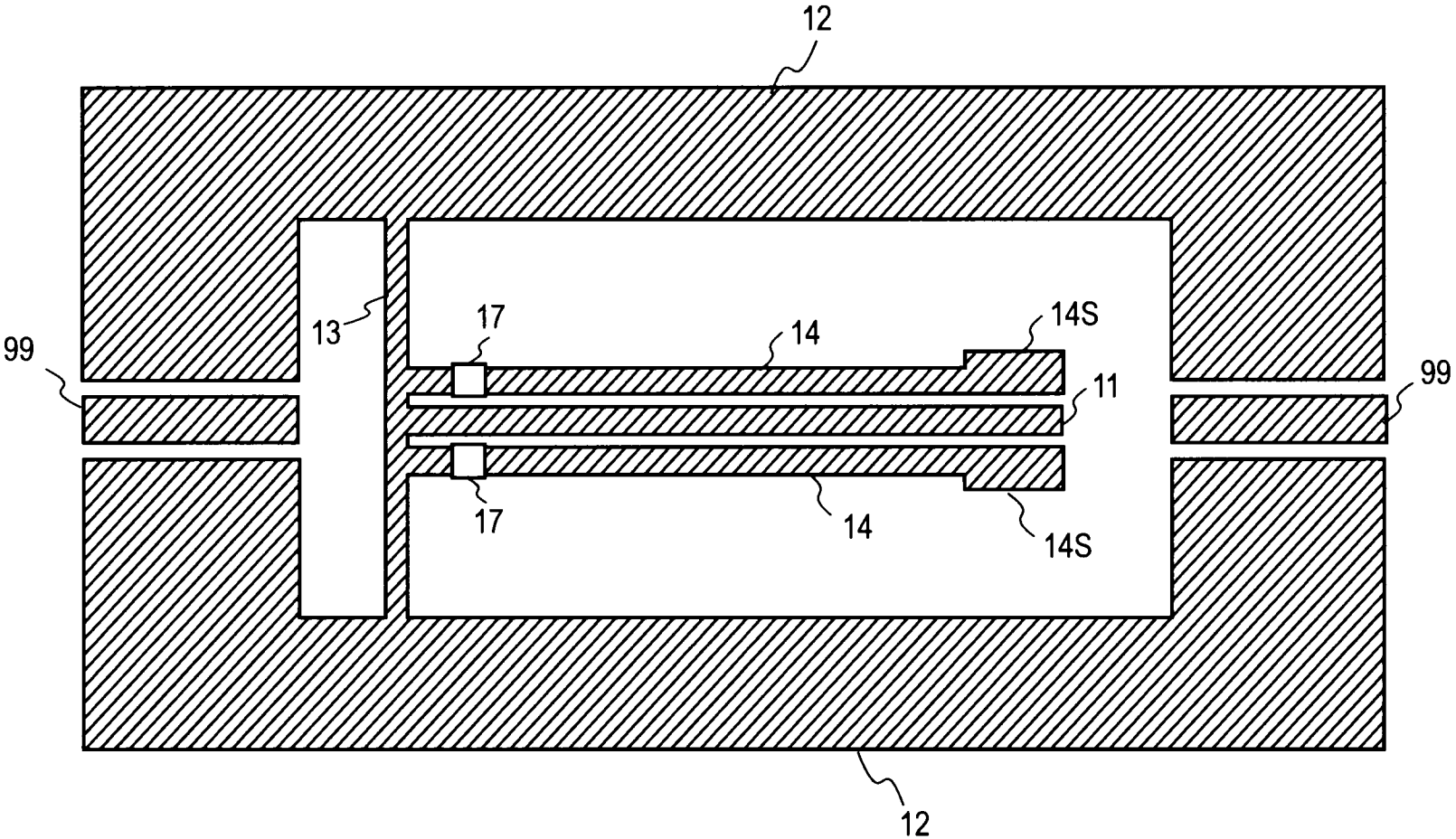
FIG. 40 is a plan view showing a configuration of a resonator according to a twenty-eighth embodiment that can be switched between a dual-band operation and a single-band operation.

FIG. 40 shows a dual-band bandpass resonator according to a twenty-eighth embodiment. This resonator is a modification of the resonator shown in FIG. 8A that can be switched between the dual-band operation and the single-band operation by switches 17 inserted in parts of the two stub conductors 14 that extend parallel with the central conductor 11 except the stepped parts 14S as in the case shown in FIG. 36. The remainder of the configuration is the same as that shown in FIG. 8A, and the switching between the dual-band operation and the single-band operation by turning on and off the switches 17 is the same as in the case shown in FIG. 36.

[Twenty-Ninth Embodiment]

Figure 41:
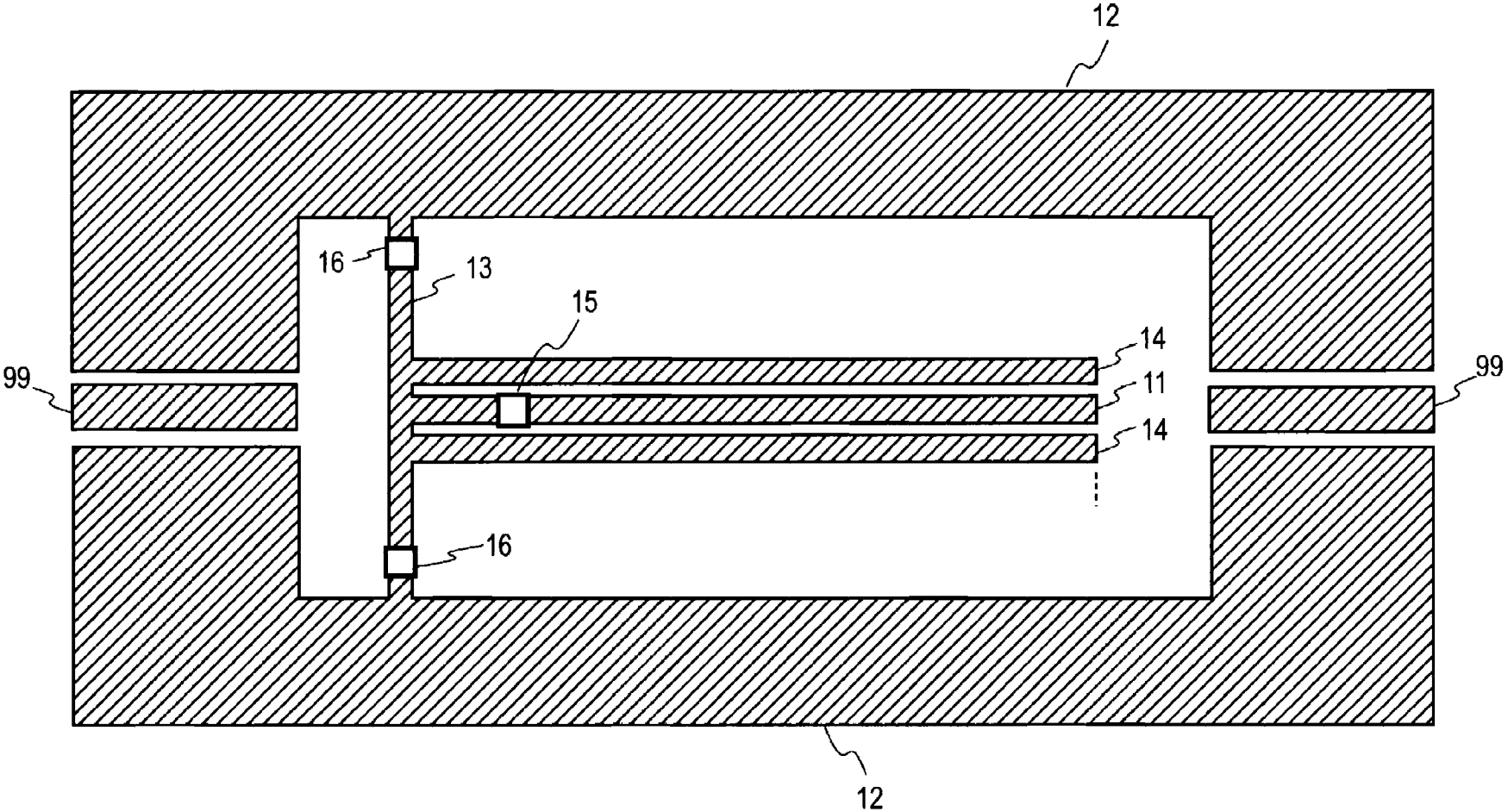
FIG. 41 is a plan view showing a configuration of a resonator according to a twenty-ninth embodiment that can be switched between a dual-band operation and a single-band operation.

The bandpass resonators that can be switched between the dual-band operation and the single-band operation described above are switched between the resonance operation at two resonance frequencies (dual-band operation) and the resonance operation at the lower resonance frequency (single-band operation). However, FIG. 41 shows an embodiment in which any one of the lower frequency band and the higher frequency band can be used for the single-band operation. The resonator according to this embodiment is a modification of the resonator shown in FIG. 17 in which two switches 16 similar to those in the resonator shown in FIG. 28 are inserted in the central conductor short-circuit part 13, and the remainder of the configuration is the same as that shown in FIG. 17. According to this design, the resonator operates as a dual-band bandpass resonator as in the case shown in FIG. 1 when all of the switch 15 and the two switches 16 are in the on state, operates as a single-band resonator that has only the higher frequency band when the switch 15 is in the off state and the two switches 16 are in the on state, and operates as a single-band resonator that has only the lower frequency band when the switch 15 is in the on state and the two switches 16 are in the off state.

[Thirtieth Embodiment]

Figure 42:
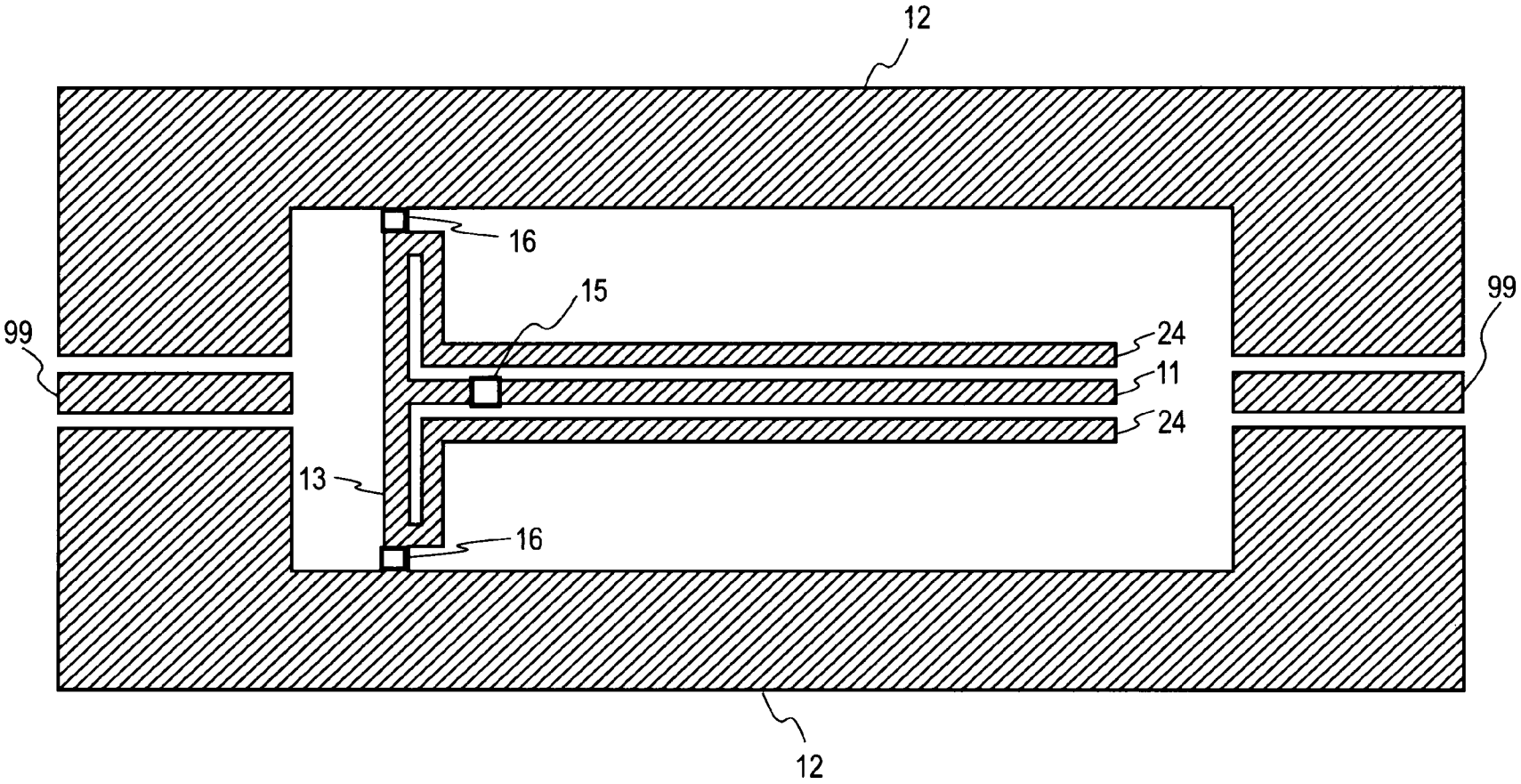
FIG. 42 is a plan view showing a configuration of a resonator according to a thirtieth embodiment that can be switched between a dual-band operation and a single-band operation.

FIG. 42 shows the resonator shown in FIG. 21 that additionally has two switches 16, which are the same as those in the resonator shown in FIG. 31, inserted in the central conductor short-circuit part 13. The remainder of the configuration is the same as that shown in FIG. 21. The relationship between the on/off state of the switch 15 and the two switches 16 and the frequency band selected is the same as in the case shown in FIG. 41.

[Thirty-First Embodiment]

Figure 43:
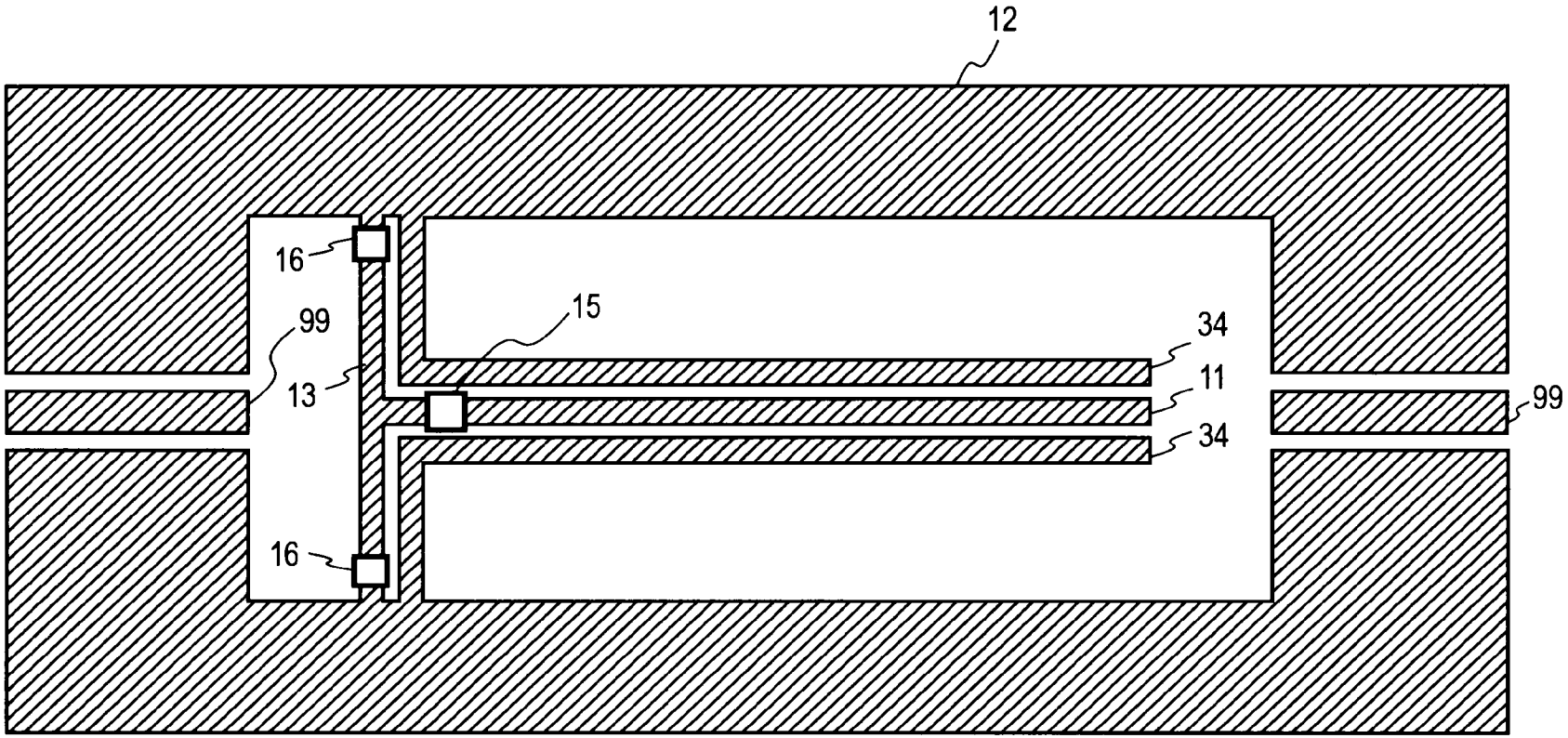
FIG. 43 is a plan view showing a configuration of a resonator according to a thirty-first embodiment that can be switched between a dual-band operation and a single-band operation.

FIG. 43 shows the resonator shown in FIG. 22 that additionally has two switches 16, which are the same as those in the resonator shown in FIG. 32, inserted in the central conductor short-circuit part 13. The remainder of the configuration is the same as that shown in FIG. 22. The relationship between the on/off state of the switch 15 and the two switches 16 and the frequency band selected is the same as in the case shown in FIG. 41.

[Thirty-Second Embodiment]

Figure 44:
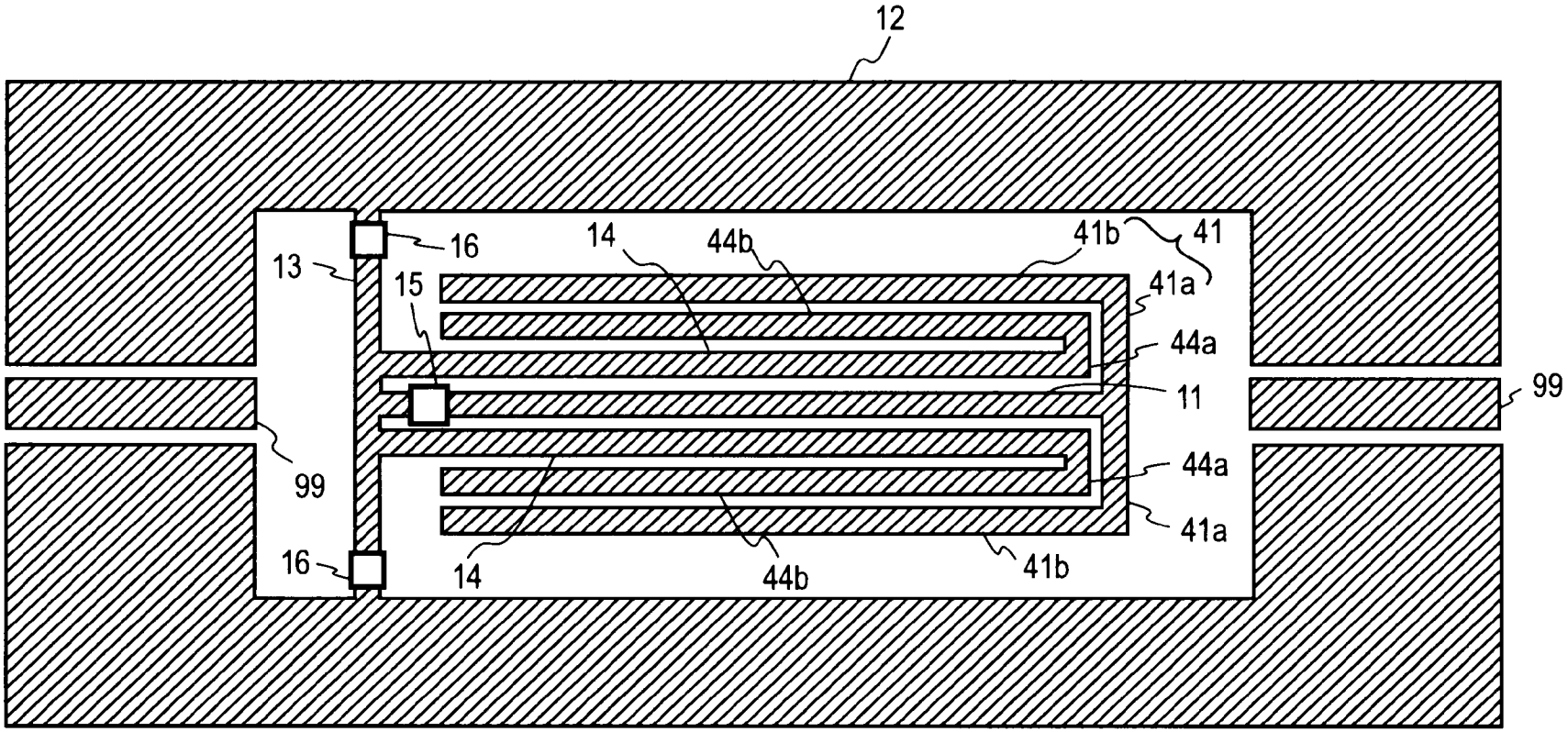
FIG. 44 is a plan view showing a configuration of a resonator according to a thirty-second embodiment that can be switched between a dual-band operation and a single-band operation.

FIG. 44 shows the resonator shown in FIG. 23 that additionally has two switches 16, which are the same as those in the resonator shown in FIG. 33, inserted in the central conductor short-circuit part 13. The remainder of the configuration is the same as that shown in FIG. 23. The relationship between the on/off state of the switch 15 and the two switches 16 and the frequency band selected is the same as in the case shown in FIG. 41.

[Thirty-Third Embodiment]

Figure 45:
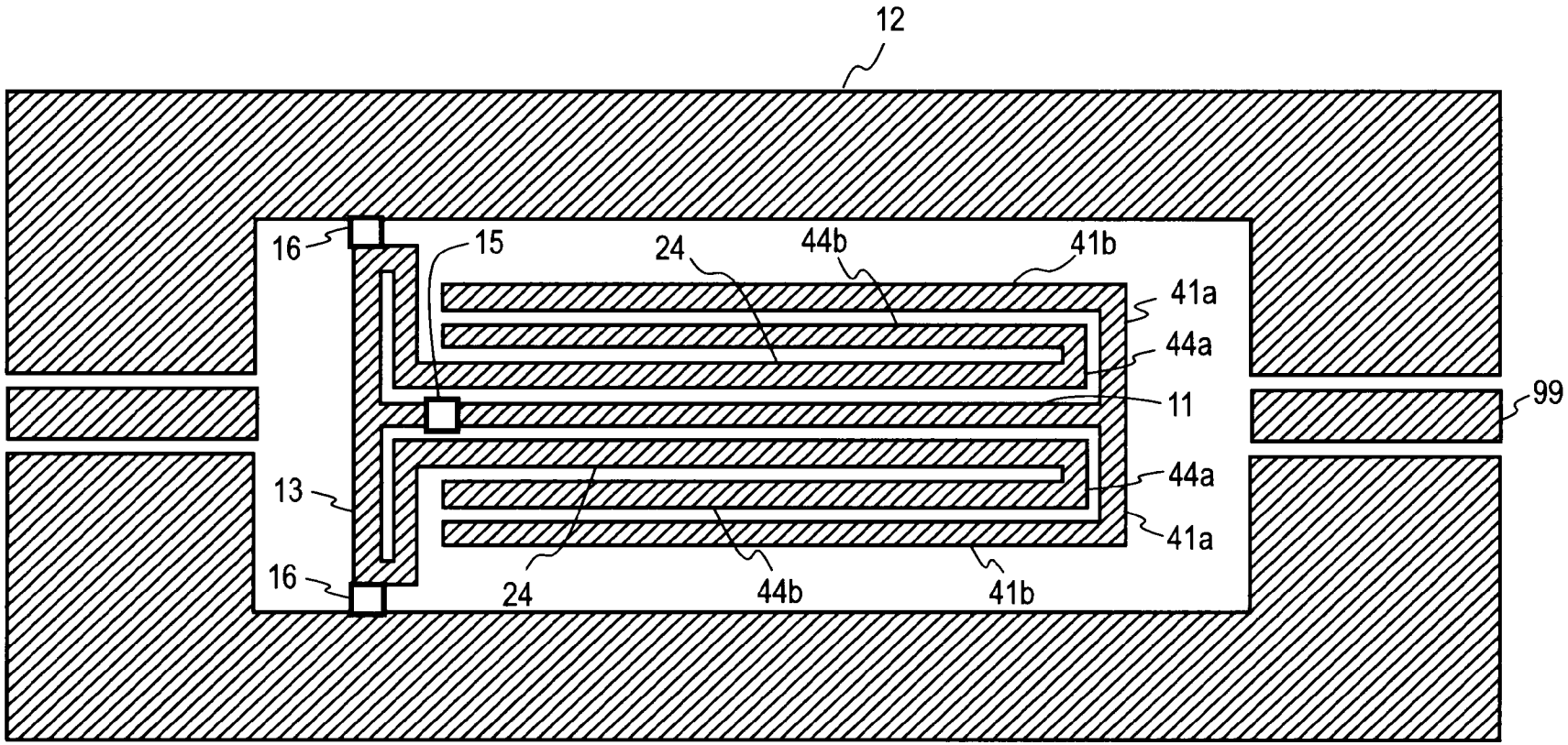
FIG. 45 is a plan view showing a configuration of a resonator according to a thirty-third embodiment that can be switched between a dual-band operation and a single-band operation.

FIG. 45 shows the resonator shown in FIG. 24 that additionally has two switches 16, which are the same as those in the resonator shown in FIG. 34, inserted in the central conductor short-circuit part 13. The remainder of the configuration is the same as that shown in FIG. 24. The relationship between the on/off state of the switch 15 and the two switches 16 and the frequency band selected is the same as in the case shown in FIG. 41.

[Thirty-Fourth Embodiment]

Figure 46:
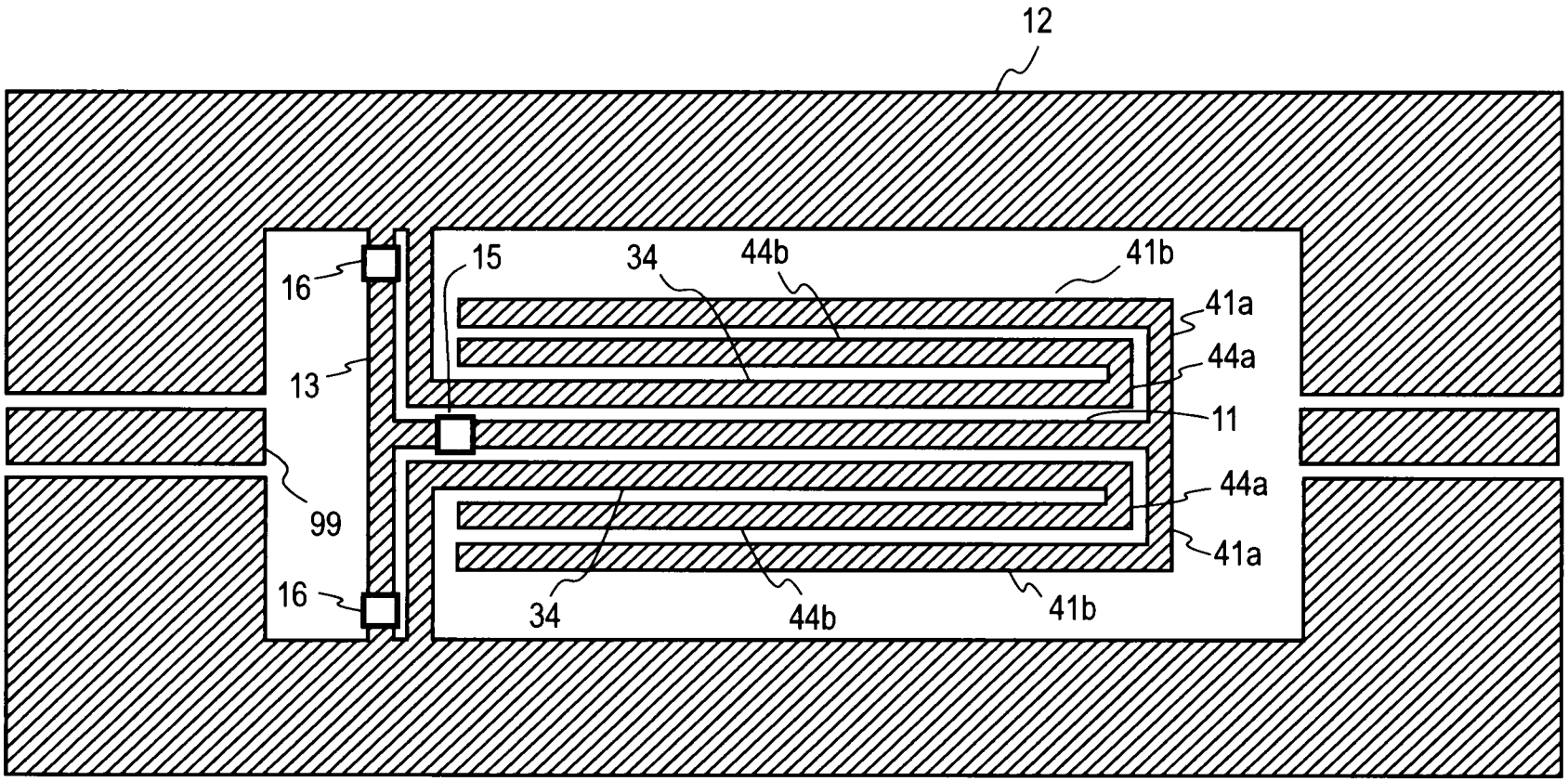
FIG. 46 is a plan view showing a configuration of a resonator according to a thirty-fourth embodiment that can be switched between a dual-band operation and a single-band operation.

FIG. 46 shows the resonator shown in FIG. 25 that additionally has two switches 16, which are the same as those in the resonator shown in FIG. 35, inserted in the central conductor short-circuit part 13. The remainder of the configuration is the same as that shown in FIG. 25. The relationship between the on/off state of the switch 15 and the two switches 16 and the frequency band selected is the same as in the case shown in FIG. 41.

A plurality of such resonators shown in FIGS. 41 to 46 that have the switches 15 and 16 inserted in the central conductor 11 and the central conductor short-circuit part 13, respectively, can be cascaded to each other as shown in FIGS. 9, 11, 12, 13 and 15 to form a bandpass filter that can be switched between the dual-band operation and the single-band operation.

[Thirty-Fifth Embodiment]

FIGS. 41 to 46 show examples of the resonator having the switches inserted in the central conductor and the central conductor short-circuit part. However, a resonator that can be switched between the dual-band operation and the single-band operation can also be provided by inserting switches in the two stub conductors and the central conductor short-circuit part.

Figure 47:
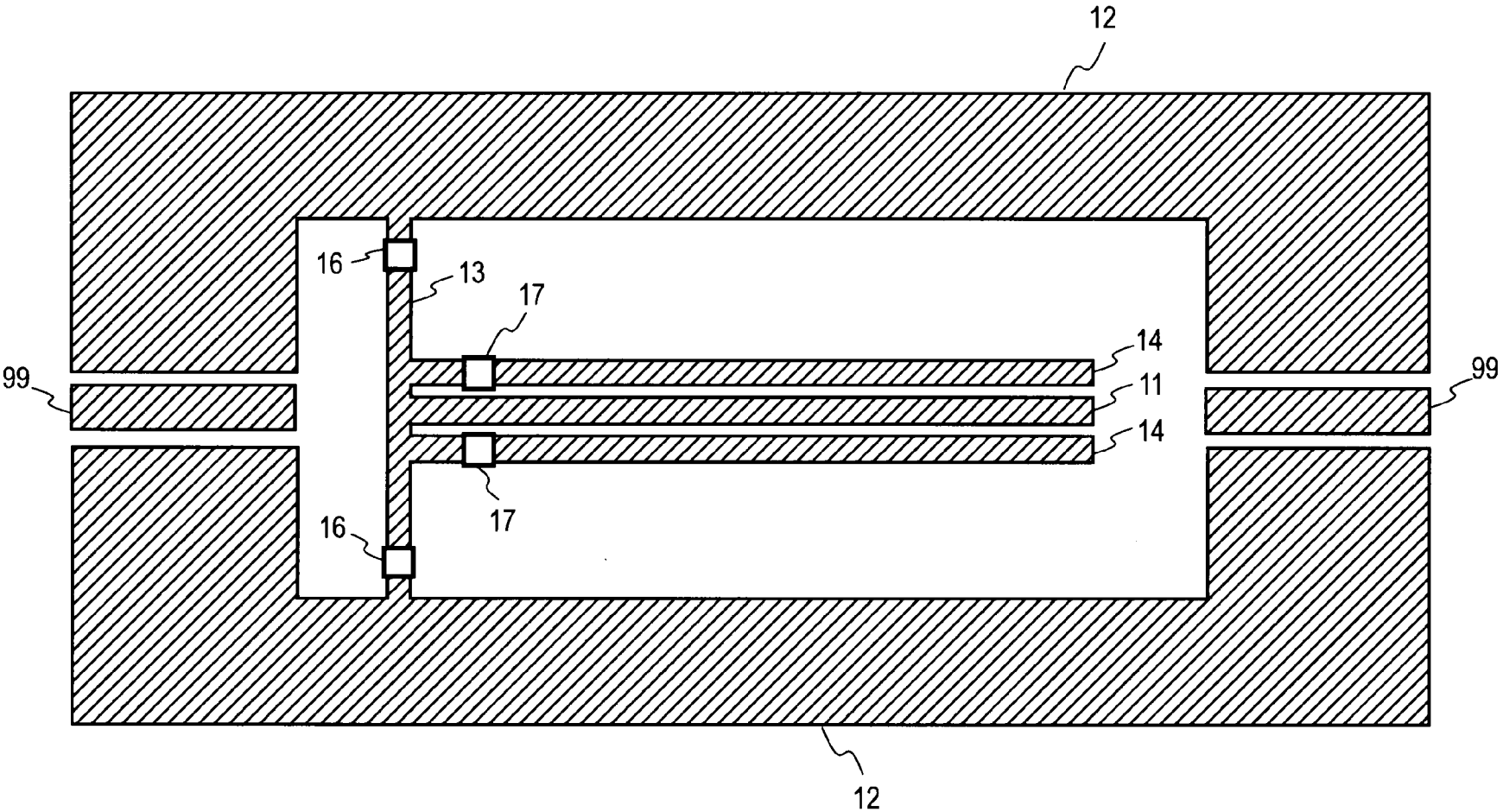
FIG. 47 is a plan view showing a configuration of a resonator according to a thirty-fifth embodiment that can be switched between a dual-band operation and a single-band operation.

FIG. 47 shows the resonator shown in FIG. 28 that additionally has switches 17 inserted in the two stub conductors 14 as in the case shown in FIG. 36. The remainder of the configuration is the same as that shown in FIG. 28. The resonator operates as a dual-band bandpass resonator as with the resonator shown in FIG. 28 whose switches 16 are in the on state when all of the switches 16 and 17 are in the on state (conductive state (see FIG. 29), operates as a single-band resonator that operates at the lower resonance frequency as with the resonator shown in FIG. 28 whose switches 16 are in the off state when the switches 16 are in the off state and the switches 17 are in the on state, and operates as a single-band resonator that operates at the higher resonance frequency of the two resonance frequencies (see FIG. 37) as with the resonator shown in FIG. 36 when the switches 16 are in the on state and the switches 17 are in the off state.

[Thirty-Sixth Embodiment]

Figure 48:
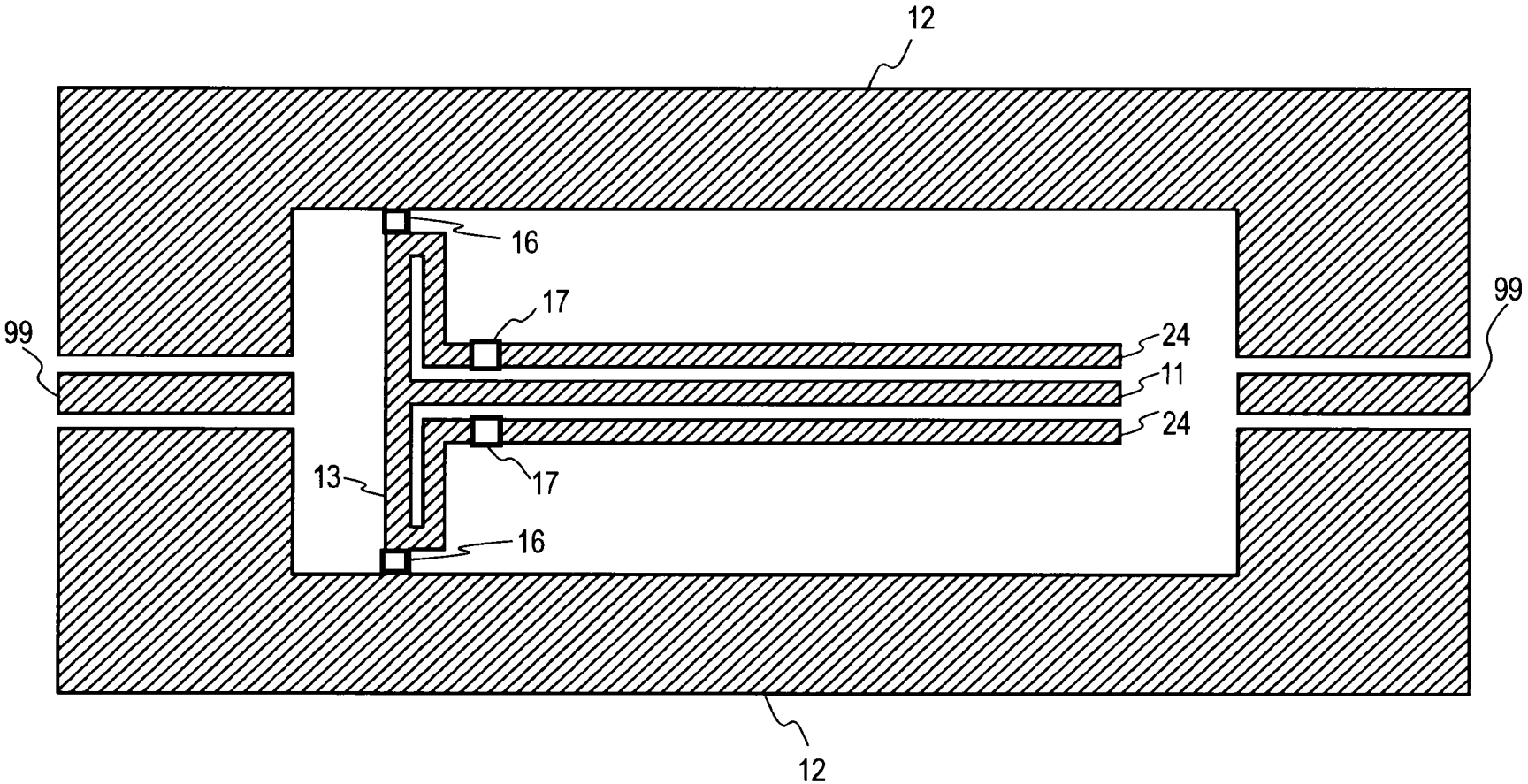
FIG. 48 is a plan view showing a configuration of a resonator according to a thirty-sixth embodiment that can be switched between a dual-band operation and a single-band operation.

FIG. 48 shows the resonator shown in FIG. 31 that additionally has switches 17 inserted in the two stub conductors 14 as in the case shown in FIG. 38. The remainder of the configuration is the same as that shown in FIG. 31. The relationship between the on/off state of the switches 16 and 17 and the frequency band selected is the same as in the case shown in FIG. 47.

[Thirty-Seventh Embodiment]

Figure 49:
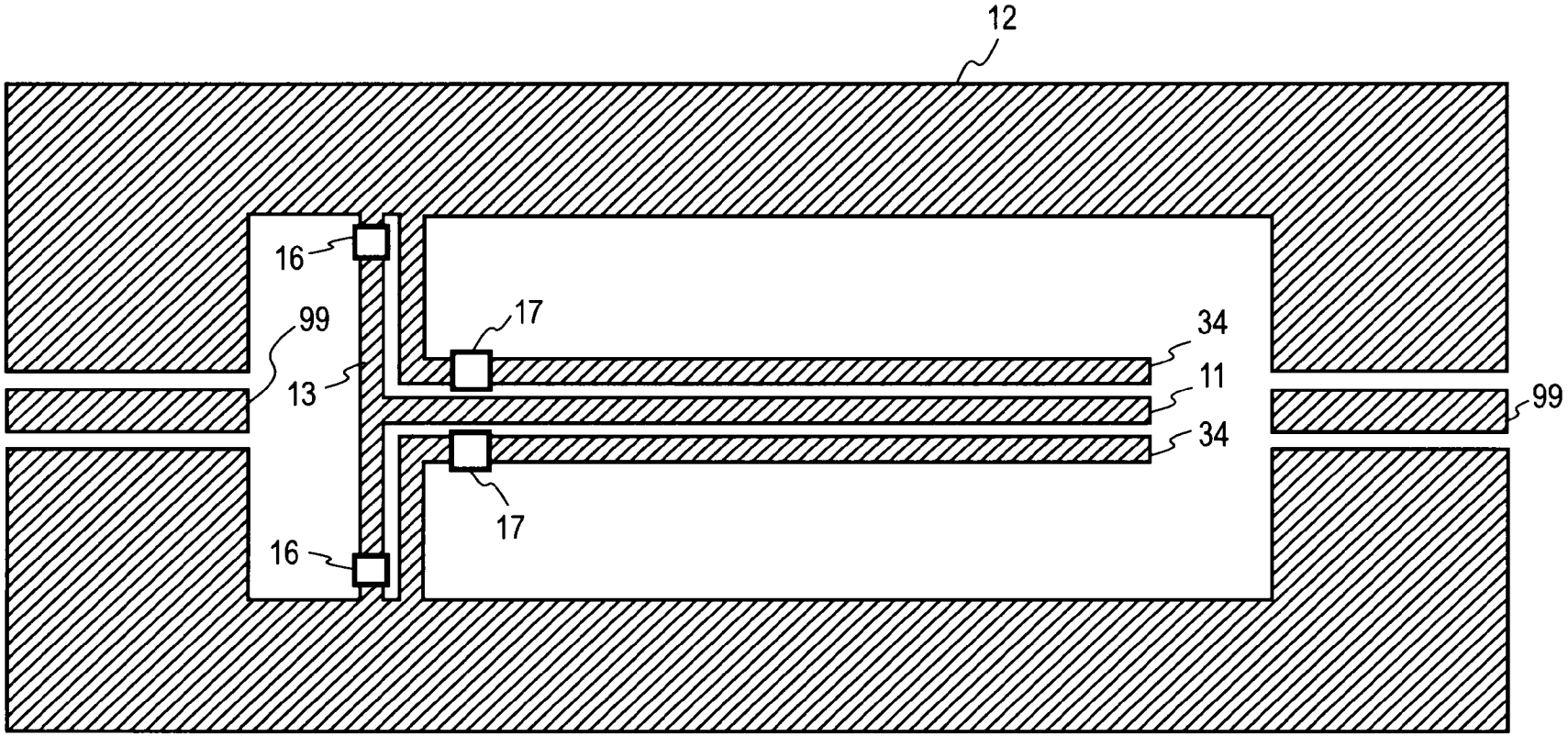
FIG. 49 is a plan view showing a configuration of a resonator according to a thirty-seventh embodiment that can be switched between a dual-band operation and a single-band operation.
Figure 50:
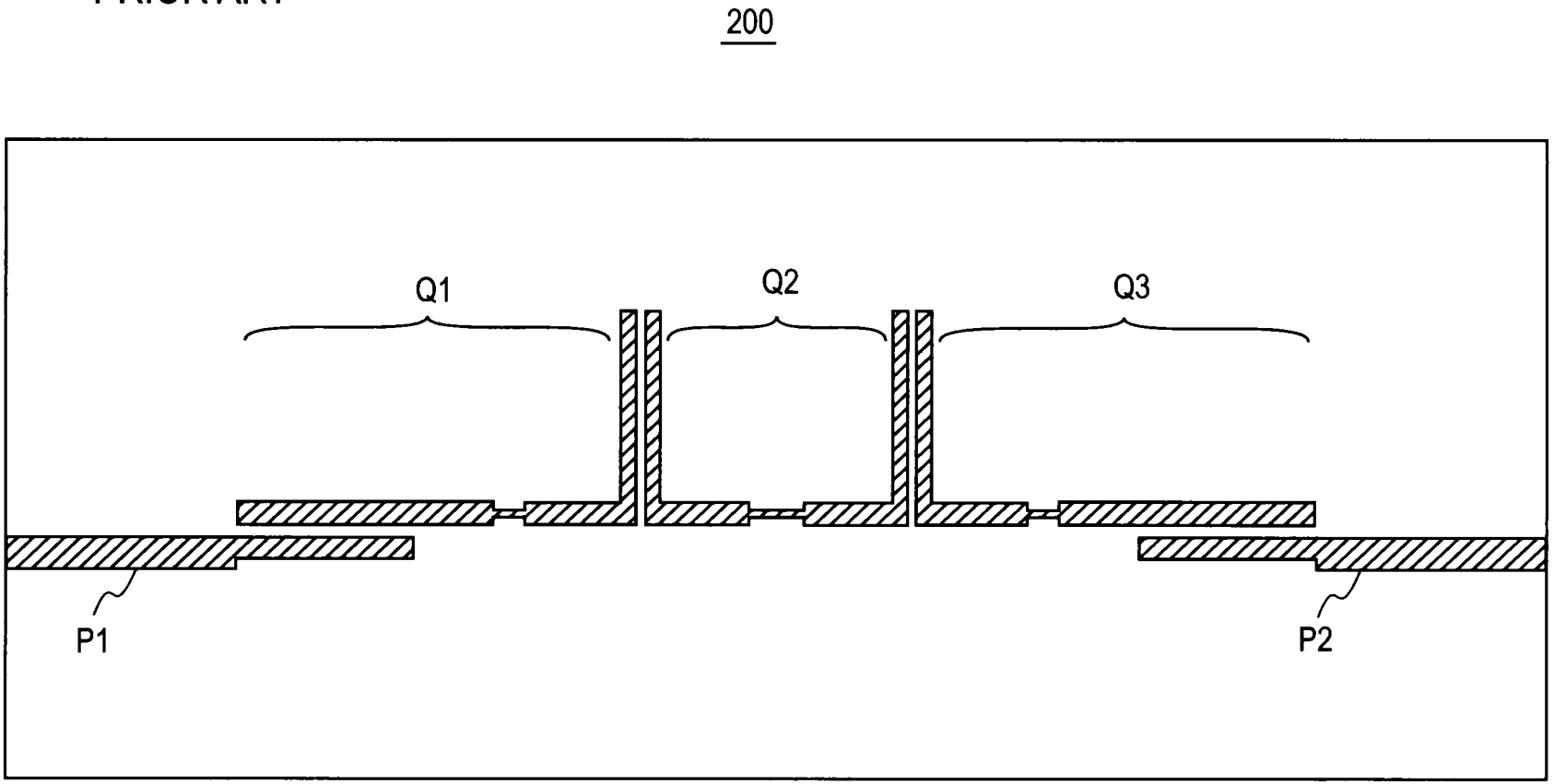
FIG. 50 PRIOR ART
FIG. 50 is a plan view showing an exemplary configuration of a conventional dual-band bandpass filter.
Figure 51:
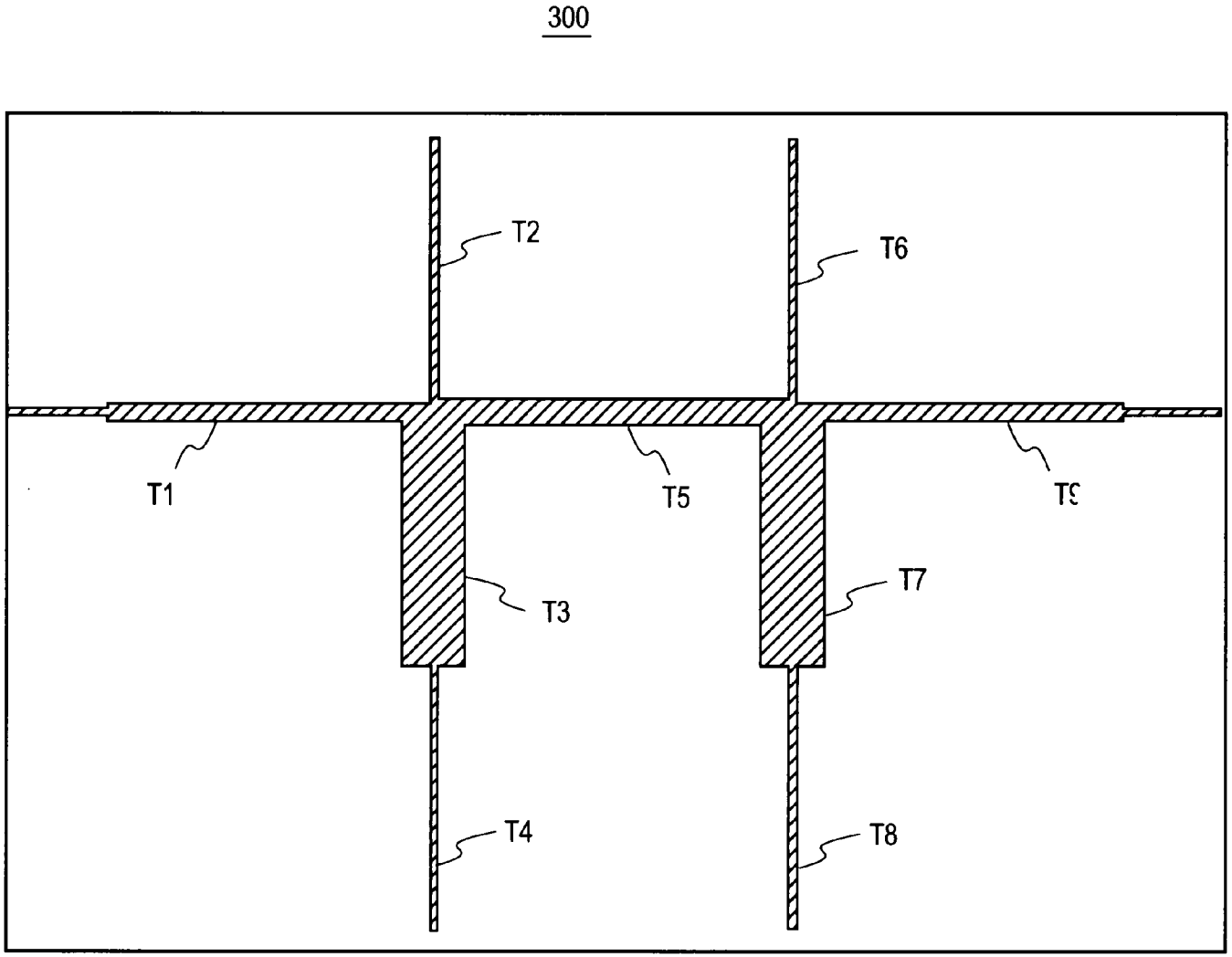
FIG. 51 PRIOR ART
FIG. 51 is a plan view showing an exemplary configuration of another conventional dual-band bandpass filter.

FIG. 49 shows the resonator shown in FIG. 32 that additionally has switches 17 inserted in the two stub conductors 14 as in the case shown in FIG. 39. The remainder of the configuration is the same as that shown in FIG. 32. The relationship between the on/off state of the switches 16 and 17 and the frequency band selected is the same as in the case shown in FIG. 47.

INDUSTRIAL APPLICABILITY

The present invention is useful as a component of a plane circuit for the microwave band or millimeter-wave band configured for dual-band operation.

What is claimed is:

1. A dual-band bandpass resonator, comprising:

a dielectric substrate;

a central conductor having a central axis aligned with an input/output direction formed on a surface of said dielectric substrate;

a pair of grounding conductors that are formed on the surface of said dielectric substrate and disposed on opposite sides of said central conductor with a space interposed therebetween;

a central conductor short-circuit part that is formed on the surface of said dielectric substrate and short-circuits said pair of grounding conductors to each other, and is connected to one end of said central conductor; and a pair of stub conductors that are formed on the surface of said dielectric substrate and disposed in the spaces on the opposite sides of said central conductor symmetrically with respect to the central axis of the central conductor, to extend at least partially parallel with the central conductor and are directly connected to said central conductor short-circuit part at one ends thereof.

2. The dual-band bandpass resonator according to claim 1, wherein a distance from a point of connection between each of said stub conductors and said central conductor short-circuit part to a point of connection between the central conductor and the central conductor short-circuit part is longer than a distance between said central conductor and the part of each of said stub conductors that extends parallel with the central conductor.

3. The dual-band bandpass resonator according to claim 1 or 2, further comprising:

a pair of central conductor extension parts that branch from the other end of said central conductor and are folded back to extend in the spaces between said pair of grounding conductors and said pair of stub conductors on the opposite sides of said central conductor, the pair of central conductor extension parts being disposed symmetrically with respect to the central axis of said central conductor; and a pair of stub conductor extension parts each of which extends from the other end of a corresponding one of said pair of stub conductors and is folded back to extend in the space between the central conductor extension part and the corresponding stub conductor, the pair of corresponding stub conductor extension parts being disposed symmetrically with respect to the central axis of said central conductor, wherein said central conductor extension parts include a central conductor folding part that extends parallel with said central conductor short-circuit part and a central conductor return part that extends parallel with said central conductor, and said pair of stub conductor extension parts include a stub folding part that extends parallel with said central conductor short-circuit part and a stub return part that extends parallel with said pair of stub conductors.

4. A dual-band bandpass filter, comprising a plurality of dual-band bandpass resonators each having features according to the dual-band bandpass resonator of claim 3 that are arranged with the central axes of the central conductors thereof aligned with each other.

5. The dual-band bandpass filter according to claim 4, wherein at least one pair of adjacent ones of the plurality of dual-band bandpass resonators are arranged with said central conductor extension parts thereof opposed to each other.

6. The dual-band bandpass filter according to claim 5, wherein a short-circuit stub that short-circuits said pair of grounding conductors is formed in the space between said opposed central conductor extension parts.

7. The dual-band bandpass filter according to claim 6, wherein said short-circuit stub has a stepped impedance configuration.

8. The dual-band bandpass filter according to claim 4, wherein at least one pair of adjacent ones of the plurality of dual-band bandpass resonators are arranged with said central conductor short-circuit parts thereof opposed to each other.

9. The dual-band bandpass resonator according to claim 1, wherein said central conductor has a gap formed by cutting the central conductor at a predetermined position along the length thereof to form central conductor segments, and a switch that electrically connects or disconnects the central conductor segments is provided in the gap.

10. The dual-band bandpass resonator according to claim 1, wherein said central conductor short-circuit part has gaps formed by cutting the central conductor short-circuit part at predetermined positions symmetrical with respect to the longitudinal center thereof to form central conductor short-circuit part segments, and a switch that electrically connects or disconnects the central conductor short-circuit part segments is provided in each gap.

11. The dual-band bandpass resonator according to claim 1, wherein each of said pair of stub conductors has a gap formed by cutting the stub conductor at a predetermined position along the length thereof to form stub conductor parts, and a switch that electrically connects or disconnects the stub conductor parts is provided in each gap.

12. The dual-band bandpass resonator according to claim 1, wherein said central conductor has a first gap formed by cutting the central conductor at a predetermined position along the length thereof to form central conductor parts, and a first switch that electrically connects or disconnects the central conductor parts is provided in said first gap, and said central conductor short-circuit part has second gaps formed by cutting the central conductor short-circuit part at predetermined positions symmetrical with respect to the longitudinal center thereof to form central conductor short-circuit part segments, and a second switch that electrically connects or disconnects the central conductor short-circuit part segments is provided in each second gap.

13. The dual-band bandpass resonator according to claim 1, wherein each of said pair of stub conductors has a first gap formed by cutting the stub conductor at a predetermined position along the length thereof to form stub conductor parts, and a first switch that electrically connects or disconnects the stub conductor parts is provided in said first gap, and said central conductor short-circuit part has second gaps formed by cutting the central conductor short-circuit part at predetermined positions symmetrical with respect to the longitudinal center thereof to form central conductor short-circuit part segments, and a second switch that electrically connects or disconnects the central conductor short-circuit part segments is provided in each second gap.

14. A dual-band bandpass filter, comprising a plurality of dual-band bandpass resonators each having features according to the dual-band bandpass resonator of claim 1 that are arranged with the central axes of the central conductors thereof aligned with each other.

15. The dual-band bandpass filter according to claim 14, each of said central conductors has a gap formed by cutting the central conductor at a predetermined position along the length thereof to form central conductor segments, and a switch that electrically connects or disconnects the central conductor segments is provided in the gap.

16. The dual-band bandpass filter according to claim 14, wherein each of said central conductor short-circuit parts has gaps formed by cutting the central conductor short-circuit part at predetermined positions symmetrical with respect to the longitudinal center thereof to form central conductor short-circuit part segments, and a switch that electrically connects or disconnects the central conductor short-circuit part segments is provided in each gap.

17. The dual-band bandpass filter according to claim 14, wherein each stub conductor in each of said pairs of stub conductors has a gap formed by cutting the stub conductor at a predetermined position along the length thereof to form stub conductor parts, and a switch that electrically connects or disconnects the stub conductor parts is provided in each gap.

18. The dual-band bandpass filter according to claim 14, wherein each said central conductor has a first gap formed by cutting the central conductor at a predetermined position along the length thereof to form central conductor parts, and a first switch that electrically connects or disconnects the central conductor parts is provided in said first gap, and each said central conductor short-circuit part has second gaps formed by cutting the central conductor short-circuit part at predetermined positions symmetrical with respect to the longitudinal center thereof to form central conductor short-circuit part segments, and a second switch that electrically connects or disconnects the central conductor short-circuit part segments is provided in each second gap.

19. The dual-band bandpass filter according to claim 14, wherein each stub conductor in each of said pairs of stub conductors has a first gap formed by cutting the stub conductor at a predetermined position along the length thereof to form stub conductor parts, and a first switch that electrically connects or disconnects the stub conductor parts is provided in said first gap, and said central conductor short-circuit part has second gaps formed by cutting the central conductor short-circuit part at predetermined positions symmetrical with respect to the longitudinal center thereof to form central conductor short-circuit part segments, and a second switch that electrically connects or disconnects the central conductor short-circuit part segments is provided in each second gap.

* * * * *